US006062671A

United States Patent [19]

Kanda et al.

[11] Patent Number: 6,062,671

[45] Date of Patent: May 16, 2000

[54] LIQUID EJECTION APPARATUS AND A RECOVERY METHOD THEREOF

[75] Inventors: Hidehiko Kanda, Kawasaki; Shinya Matsui, Tokyo; Toshio Kashino, Chigasaki; Hiroshi Tajika, Yokohama; Osamu Iwasaki, Tokyo; Masaya Uetsuki, Yokohama; Yoshie Asakawa, Nagano, all of Japan

[73] Assignee: Canon Kabushiki Kaisha, Tokyo, Japan

[21] Appl. No.: 08/890,764

[22] Filed: Jul. 11, 1997

[30] Foreign Application Priority Data

Jul. 12, 1996 [JP] Japan ..... 8-183890

[51] Int. Cl.[7] ..... B41J 2/165

[52] U.S. Cl. ..... 347/30; 347/65

[58] Field of Search ..... 347/65, 85, 6, 347/30

[56] References Cited

U.S. PATENT DOCUMENTS

| | | | |
|---|---|---|---|
| 4,480,259 | 10/1984 | Kruger et al. | 346/140 R |
| 4,646,110 | 2/1987 | Ikeda et al. | 347/48 |
| 4,723,129 | 2/1988 | Endo et al. | 346/1.1 |
| 5,030,973 | 7/1991 | Nonoyama et al. | 347/93 |
| 5,278,585 | 1/1994 | Karz et al. | 346/140 R |

FOREIGN PATENT DOCUMENTS

| | | |
|---|---|---|
| 55-081172 | 6/1980 | Japan . |
| 61-069467 | 4/1986 | Japan . |
| 63-199972 | 8/1988 | Japan . |

*Primary Examiner*—John Barlow
*Assistant Examiner*—Michael S Brooke
*Attorney, Agent, or Firm*—Fitzpatrick, Cella, Harper & Scinto

[57] ABSTRACT

An apparatus uses a liquid ejection head including a first liquid passage communicating with an ejection port, a second liquid passage separated from the first liquid passage by a separation wall, and a movable member formed as a part of the separation wall. In the second liquid passage, a thermal energy generation device is arranged at a position opposing to the movable member. The movable member has a free end portion and a fulcrum. Recovery of the first and second liquid passages is performed by suction and/or pressurization. Upon recovery by discharging the liquid in respective liquid passage having higher flow resistance, the pressurizing force and/or the suction force for the liquid passage having higher resistance is set to be greater that the pressurizing force and/or the suction force for the other liquid passage having lower flow resistance.

34 Claims, 49 Drawing Sheets

LIQUID EJECTION APPARATUS AND A RECOVERY METHOD THEREOF

BACKGROUND OF THE INVENTION

1. Field of the Invention

The present invention relates to a liquid ejection head ejecting a desired liquid by utilizing bubble generated by acting a thermal energy on the liquid, a head cartridge and a liquid ejecting apparatus employing the liquid ejection head, a fabrication process of the liquid ejection head, a liquid ejecting method, a printing method and a printed product obtained by utilizing the liquid ejecting method. The present invention further relates to an ink-jet kit having the liquid ejection head.

Particularly, the present invention relates to a liquid ejection head having a movable member displaced by utilizing generation of bubble, a head cartridge and a liquid ejecting apparatus employing the ejecting head. The present invention relates to a liquid ejecting method and a printing method ejecting a liquid by displacing the movable member utilizing generation of bubble.

Furthermore, the present invention is applicable to a printer performing printing on a printing medium, such as paper, yarn, fiber, cloth, leather, metal, plastic, glass, wood, ceramic or the like, a copy machine, a facsimile machine having a communication system, a word processor having a printing portion and the like, and further to an industrial printing apparatus which is able to compose to various processing devices.

It should be noted that, in the present invention, a word "print" not only means forming a meaningful image per se, such as character, drawing and the like, but also means forming a meaningless image, such as a pattern.

2. Description of the Related Art

Conventionally, so-called bubble-jet printing method has been known as an ink-jet printing method. The method comprises the steps of providing an ink with an energy such as a thermal energy to cause abrupt volume variation (generation of bubble) of the ink, and of ejecting the ink through ejection ports by an acting force on the basis of the state variation to deposit the ejected ink on a printing medium to form an image. In a printing apparatus employing the bubble-jet printing method, ejection ports for ejecting the ink, ink passages communicating with the ejection ports, and electrothermal transducers as energy generating means for ejecting ink in the ink passages are typically arranged as disclosed in U.S. Pat. No. 4,723,129 and the like.

With such printing method, high quality image can be printed at high speed and low noise. A printing head implementing this method has many merits that high resolution image and color image can be easily obtained because the ejection ports for ejecting the ink can be arranged at high density. Recently, the bubble-jet printing method has been employed in a large number of office use apparatus, such as printers, copy machines, facsimile machines and the like, and is also applicable to industrial system, such as a textile printing apparatus.

According to spreading of application of the bubble-jet technology in various kinds of products, the following demands are recently growing:

For example, optimization of a heater as energy generating means is studied in order to demand for improvement of an energy efficiency. As the optimization of the heater, adjustment of a thickness of a protective layer for standing between the heater and the ink can be nominated. This method is effective for improvement of a transmission efficiency to a generated head to the liquid such as the ink.

On the other hand, in order to obtain high quality image, there has been proposed a driving condition for providing the liquid ejecting method or the like enabling high speed ink ejection and ink injection in good condition based on stable bubble generation. Also, in viewpoint of high speed printing, there has been proposed a printing apparatus with an improved liquid passage configuration for obtaining the liquid ejection head having high speed re-fill. Here, "re-fill" means liquid supply from the common liquid chamber to ejection ports through liquid passages when liquid is ejected from the ejection port to generate negative pressure near the ejection port in the liquid passage or when bubbles in the liquid shrinks after the pressure generated on growth of the bubbles are utilized for ejection of the liquid.

Among the liquid passage configuration, the flow passage structure as shown in FIGS. 48A and 48B has been disclosed in Japanese Patent Application Laid-Open No. 199972/1988. The disclosed liquid passage structure and the head fabrication method are inventions work out in view of a back wave generated associating with generating of the bubble. The back wave is generated by pressure directed toward opposite direction to a direction toward the ejection port, namely a pressure directed to a liquid chamber 12. The back wave is not an energy directed in an ejecting direction and thus is known as a lost energy reducing an ejecting energy.

FIGS. 48A and 48B disclose a valve 10 located at a position away from a region, in which the bubble is generated by the heater 2, and at opposite side to the ejection port 11 with respect to the heater 2.

In FIG. 48B, the valve 10 has an initial position attached to an upper plate as a ceiling of the liquid passage 3. Associating with generation of bubble, it hangs down into the liquid passage. This invention is disclosed to restrict energy loss by controlling a part of the back wave by means of the valve 10.

However, in the shown construction, as can be appreciated from study for behavior of the liquid upon generation of bubble in the liquid passage retaining the liquid to be ejected, it is not practical to restrict a part of the back wave by means of the valve for ink ejection.

In nature, the back wave per se is not directly associated with ejection as set forth above. When the back wave is generated within the liquid passage 3 as shown in FIG. 48A, a pressure directly associated with ejection of the liquid is already places the liquid from the liquid passage 3 in condition permitting ejection thereof. Accordingly, even when a part of the back wave is restricted, no significant effect may be provided for ejection.

On the other hand, in the bubble-jet printing method, since the heater repeats heating in a condition contacting with the ink, a deposit due to baking of the ink is generated on the surface of the heater. In certain kind of the liquid or ink, large amount of deposit is generated to make generation of bubble unstable. Also, when the liquid to be ejected has a property to be easily degraded the quality by heat, or when the liquid is difficult to obtain sufficient bubbling, it has been desired to provide a method to achieve good ejection without causing change of property of the liquid to be ejected.

In such viewpoint, a method to use a liquid (bubbling liquid) to generate bubble by a heat, which is different from a liquid (ejection liquid) to be ejected, to transmit a pressure generated by bubbling to the ejection liquid to perform ejection, has been disclosed in Japanese Patent Application Laid-Open No. 69467/1986, Japanese Patent Application Laid-Open No. 81172/1980, U.S. Pat. No. 4,480,259 and so on. In these publications, an ink as the ejection liquid and the bubbling liquid are completely separated by a flexible membrane formed of a silicon rubber or the like so that the ejection liquid may not contact with the heater directly, and pressure generated by bubbling of the bubbling liquid is transmitted to the ejection liquid by deformation of the flexible diaphragm. By such construction, prevention the surface of the heater from being deposited, improvement of freedom in selection of the ejection liquid and so on can be achieved.

However, in the ejection head having a construction, in which the ejection liquid and the bubbling liquid are separated completely as set forth above, since the pressure generated by bubbling of the bubbling liquid is transmitted to the ejection liquid by expanding and contracting deformation of the flexible diaphragm, the pressure of the bubbling can be absorbed by the flexible diaphragm in significant extent. Also, magnitude of deformation of the flexible diaphragm is not so large. Therefore, while it is possible to separate the ejection liquid and the bubbling liquid by the flexible diaphragm, it is possible to lower energy efficiency and ejection force.

It is necessary to elevate a basic ejection characteristic to a high level unpredictable from the conventional technique, the conventional level being obtained by a conventional method comprising the steps of forming a bubble within a liquid passage (particularly, a bubble generated by a film boiling) to eject the liquid.

In order to elevate such level, it is necessary to return to a principal for liquid ejection, and to develop a new method for ejecting a liquid and a new liquid ejection head performing such a new method, the method using a bubble which can not be obtained by the conventional technique. Here, a movement of a movable member within a liquid passage is analyzed as a starting point to obtain a first technical analysis which analyzes a principal mechanism of the movable member with the liquid passage. A principal of liquid ejection by a bubble is analyzed as a starting point to obtain a second technical analysis. A bubble forming region is analyzed as a starting point to obtain a third technical point.

Because of these analyses, a new technique for controlling the bubble positively can be established that the free end of the movable member should be arranged at the ejection port side or at the downstream of the liquid flow within the liquid passage, and that the movable member should be arranged opposing the thermal energy generation device or the bubble generation region.

Considering quantity of the ejected liquid which is influenced by the bubble per se, it is realized that the consideration of component of the bubble growing toward the downstream is the biggest element in order to extremely improve the ejection characteristics. In other words, it is found that the efficient conversion of the component of the bubble toward the ejection direction serves to improve the ejection efficiency and the ejection rate. Therefore, it is noted that the new technique level is higher than the convention technique level because the new technique positively leading the downstream component toward the free end of the movable member.

Furthermore, it is preferable to consider structural elements such as the thermal generation region for forming the bubble, for example, the downstream side with respect to a line passing a center of area of one surface relating to liquid flow direction of the electro-thermal transducer, or the movable member and the liquid passages relating to the downstream side of bubble growing with respect to a line passing a center of area of one surface relating to the bubble generation.

On the other hand, it is found that a re-fill rate can be improved by considering the arrangement of the movable member and the structure of the liquid supply passage.

The applicant has already been file the patent application the excellent principal of the liquid ejection on the basis of the knowledge obtained by the investigation and the study as described above and the total viewpoints. The present invention has been made by the inventors on the basis of their preferable idea as a premise of such liquid ejection principal.

Several points which are acknowledged by the inventors are as follows:

In the liquid ejection head as described above, after the liquid ejection method is not performed at a long period, it is considered that the ejection ports are clogged up by virtue of the high viscous ink and dusts. In the case, it prevents the ejection liquid from the preferable ejection, and also it prevents the liquid from the preferable ejection because the bubbles are generated within the liquid of the second liquid passage. These problems must be avoided or instantly removed. Furthermore, in the liquid ejection method as described above, in case of using two liquids, namely the ejection liquid and the bubbling liquid, after the liquid ejection method is not performed at a very long period, it is considered that the ejection liquid and the bubbling liquid are slightly admixed. Since a preferable printing is influenced in such cases, these cases must be avoided or instantly removed. The recovery of the difficulty ejection is performed by pressurizing and/or sucking the liquid within the liquid passage. In this case, it is important that the recovery is not sufficient by virtue of the flow resistance in the respective passages.

SUMMARY OF THE INVENTION

A first aspect of the present invention is accomplished by a liquid ejection apparatus, employing

- a liquid ejection head having
  - a first liquid passage communicating with an ejection port for ejecting a liquid,
  - a second liquid passage having a bubble generating region for generating bubble in the liquid by applying heat on the liquid, and
  - a movable member disposed between the first liquid passage and the bubble generating region of the second liquid passage, the movable member having a free end on the side of the ejection port, the free end being displaced toward the first liquid passage in response to a pressure of bubble generation within the bubble generating region to lead the pressure to the ejection port side of the first liquid passage, the apparatus, having:

- a pressurizing means to fill the liquid by respective pressurization of the first liquid passage and the second liquid passage;
- opening and closing apparatus for opening and closing the first liquid passage and the second liquid passage; and
- a suction means for filling the liquid by sucking the ejection port from the outside of the first liquid passage, wherein the pressurizing means, the open and closing apparatus, and the suction means are independently controllable.

Here, the movable member may form a part of a separation wall arranged between the first liquid passage and the second liquid passage.

The separation wall may be disposed between a grooved member integrally including a plurality of grooves for forming a plurality of the first liquid passages directly communicated with corresponding ejection ports and a recessed portion for defining a first common liquid chamber for supplying liquid to a plurality of the first liquid passages, and an element substrate arranged a plurality of heaters for generating bubble in the liquid by applying a heat to the liquid, and the movable member may be displaced toward the first liquid passage side in response to a pressure by generation of bubble at a position opposing the heater.

Pressures of respective of the pressurizing means and the suction means may be variably controllable.

The liquid ejection head further may have a recovery port communicated with the second liquid passage for discharging the liquid in the second liquid passage.

Here, it further may have suction means for sucking a liquid through the recovery port to refill the liquid in the second liquid passage.

The sucking means may be equal to means for sucking a liquid through the ejection port to refill the liquid in the first liquid passage, and the suction pressure may be variably controllable.

It further may have capping means for capping at least one of the ejection port and the recovery port.

It further may have a pump which is included in at least one of the pressurizing means and the suction means.

It further may have drive signal supply means for supplying a drive signal for effecting ejection from the liquid ejection head.

It further may have printing medium transporting means for transporting a printing medium which receives the liquid ejected from the liquid ejection head.

The printing medium may be selected from the group consisting of printing paper, cloth, plastic, metal, wood and leather.

The apparatus may eject a plurality of color liquids from ejection ports of the liquid ejection head to deposit the plurality of color liquids on a printing medium for color printing.

A plurality of the ejection ports of the liquid ejection head may be arranged over the entire width of a region to be printed of a printing medium.

A second aspect of the present invention is accomplished by a recovery method of a liquid ejection apparatus, employing a liquid ejection head having a first liquid passage communicating with an ejection port, a second liquid passage having a bubble generating region for generating bubble in the liquid by applying heat on the liquid, and a movable member disposed between the first liquid passage and the bubble generating region of the second liquid passage, the movable member having a free end on the side of the ejection port, the free end being displaced toward the first liquid passage in response to a pressure of bubble generation within the bubble generating region to lead the pressure to the ejection port side of the first liquid passage, the method, having:

upon recovery of the liquid ejection head by discharging a liquid in the first liquid passage and a liquid in the second liquid passage through the ejection port, a larger pressure is applied to the liquid passage having greater flow resistance.

Here, the movable member may form a part of a separation wall disposed between the first liquid passage and the second liquid passage.

The separation wall may be disposed between a grooved member integrally including a plurality of grooves for forming a plurality of the first liquid passages directly communicated with corresponding ejection ports and a recessed portion for defining a first common liquid chamber for supplying liquid to a plurality of the first liquid passages, and an element substrate arranged a plurality of heaters for generating bubble in the liquid by applying a heat to the liquid, and the movable member may be displaced toward the first liquid passage side in response to a pressure by generation of bubble at a position opposing the heater.

Upon recovery of an ejection force of an ejection head by discharging the liquid from at least one of the ejection port and a recovery port communicating with the second liquid passage, a pressure to be applied to a liquid passage having high flow resistance, may be larger.

One of the first and second liquid passages having greater flow resistance may be pressurized and the other liquid passage having low flow resistance may be sucked.

A suction force for one of the first and second liquid passages having greater flow resistance may be greater than that applied the other liquid passage having low flow resistance.

A pressurizing force for one of the first and second liquid passages having greater flow resistance may be higher than that applied the other liquid passage having low flow resistance.

A liquid passage having greater flow resistance may be recovered by pressurizing and suction, and the liquid passage having low flow resistance may be recovered by suction.

A liquid passage having greater flow resistance may be recovered by pressurizing and suction, and the liquid passage having low flow resistance may be recovered by pressurization.

A terminating end of the recovery operation of the liquid having smaller diameter may be later than terminating end of recovery operation of the liquid passage having greater flow resistance.

The liquid may be discharged by sucking the liquid from, the ejection port using a suction means via a cap capping the ejection port.

The liquid may be discharged by sucking the liquid, the ejection port and the recovery port using a suction to outer side of the cap capping the ejection port and the recovery port.

The suction means and the pressuring means may include a pump.

The liquid may be discharged by pressurizing the liquid in the head.

As set forth above, with the liquid ejecting method, head and so on according to the present invention made on the basis of a quite novel principle of ejection, synergistic effect of generation of bubble and movement of the movable member by bubbling can be obtained to permit efficient ejection of the liquid in the vicinity of the ejection port. Therefore, ejection efficiency can be improved in comparison with the ejection method, head and so on of the conventional bubble-jet system. For example, in the most preferred embodiment of the present invention, the significant improvement of ejection efficiency to be double or more of the conventional bubble-jet system can be achieved.

According to characterized construction of the present invention, it becomes possible to avoid ejection failure even by leaving for long period under low temperature and low humidity. Furthermore, even if ejection failure is caused, normal condition can be instantly resumed by slightly performing recovery process, such as preliminary ejection or suction recovery.

Particularly, even under a condition leaving for a long period in the extent where the most of the heads of the conventional bubble-jet system having 64 ejection ports causes ejection failure, the head according to the present invention merely causes ejection failure in the ejection ports, number of which is less than or equal to half of the total number of the ejection ports in the head. On the other hand, when these heads are recovered by preliminary ejection, the conventional head requires several thousands' times of preliminary ejection for each ejection port. In contrast to this, according to the present invention, preliminary ejection in the extent of 100 times of ejection is sufficient for satisfactory recovery. This means that shortening of recovery period, reducing of loss of the liquid, and significant reduction of the running cost can be achieved.

On the other hand, with the construction of the present invention, in which re-fill characteristics is improved, response characteristics in continuous ejection, stable growth of bubble, stable formation of liquid droplet, high speed printing by high speed liquid ejection and high quality printing can be achieved.

Other effects of the present invention should be understood from description of respective embodiment.

It should be noted that, in the description of the present invention, "recovery port" means a liquid discharging opening having dimensions and arrangements so as to be prevented liquid from passing by virtue of change of the pressure of liquid within a head usually generated by liquid ejection, and to permit passing liquid by virtue of suction or pressure for recovery performance. The recovery port is predetermined so as to have a so-called low-pass function.

It should be noted that, in the description of the present invention, "upstream" and "downstream" is related to a flow direction of the liquid directed from a supply source of the liquid to the ejection port via a bubble generating region (or the movable member) or an expression with respect to a direction in construction.

On the other hand, "downstream side" with respect to the bubble per se represents ejection port side portion of the bubble considered to directly act for the ejection of the liquid droplet. More particularly, with respect to the center of the bubble, it means the downstream side relative to the flow direction or the direction in construction, or the bubble generated in the region of the downstream side with respect to the center of the area of the heater.

The passage "substantially enclosed" used in description of the present invention means the condition that when the bubble grows, the bubble may not pass through a gap (slit) around the movable member before displacement of the movable member.

Furthermore, "separation wall" in the present invention means a wall (may include the movable member) disposed for separating the bubble generating region and the region directly communicated with the ejection port, in broad sense, and means the member which separates the liquid passage including the bubble generating region and the liquid passage directly communicated with the ejection port for admixing of the liquids in respective regions.

The above and other objects, effects, features and advantages of the present invention will become more apparent from the following description of embodiments thereof taken in conjunction with the accompanying drawings.

DETAILED DESCRIPTION OF LIQUID EJECTION PRINCIPAL APPLICABLE TO THE PRESENT INVENTION

Hereinafter, the examples of liquid ejection principal applicable to the present invention will be explained in detail with reference to the drawings.

At first, in this example, explanation is given for an example of the case where an ejection force and ejection efficiency are improved by controlling transmitting direction of a pressure by generation of bubble or a direction of growth of the bubble for ejecting a liquid.

Figure 1A:
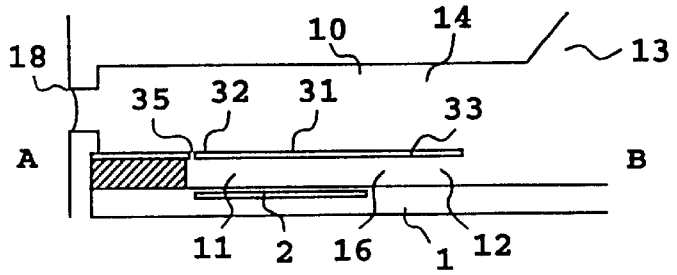
FIGS. 1A to 1D are diagrammatic sections showing one example of a liquid ejection head applicable to the present invention.
Figure 1B:
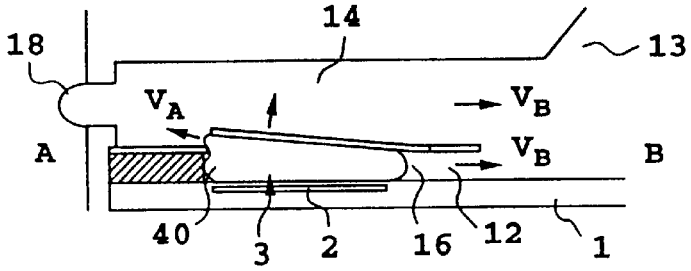
Figure 1C:
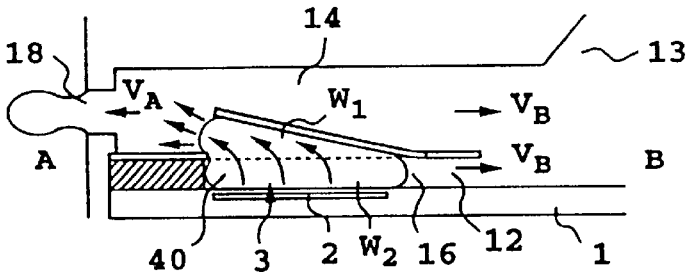
Figure 1D:
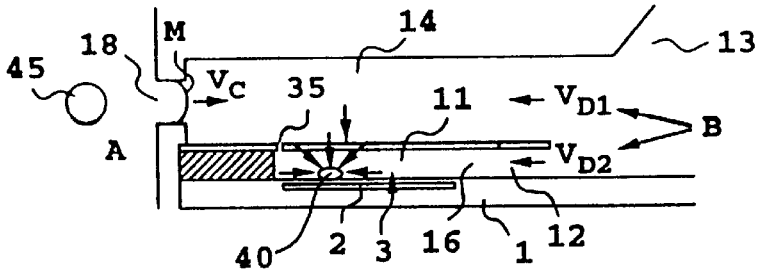
Figure 2:
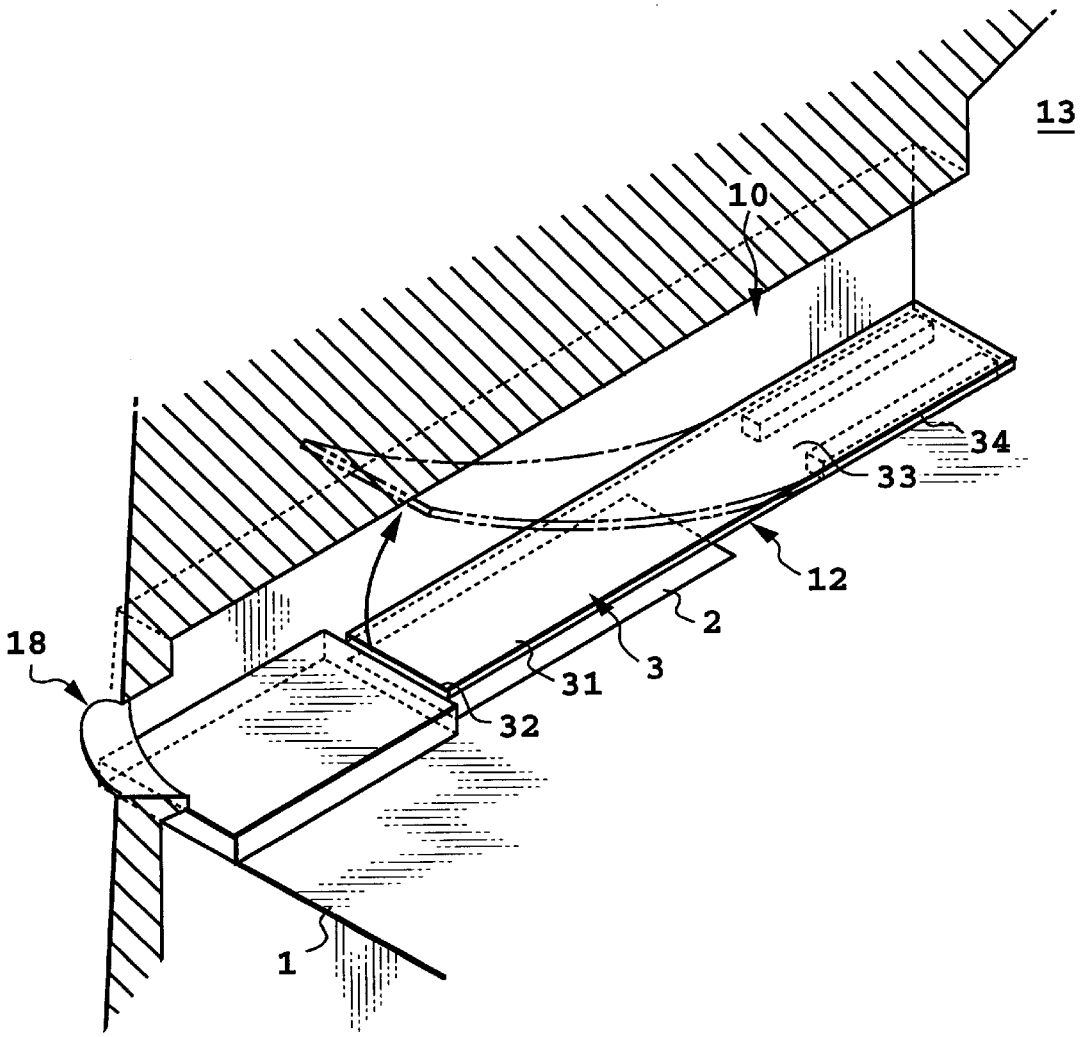
FIG. 2 is a partially cut-out perspective view of the liquid ejection head applicable to the invention.

FIGS. 1A to 1D are diagrammatic sections showing one example of a liquid ejection head according to the present invention, and FIG. 2 is a partially cut-out perspective view of the liquid ejection head according to the invention.

A liquid ejection head of the example is provided with a heater 2 (in this example, a heating resistor of the shape of 40 $\mu$m×105 $\mu$m) acting a thermal energy on a liquid, as an ejection energy generating element for ejecting the liquid, on an element substrate 1. On the element substrate, a liquid passage 10 is arranged corresponding to the heater 2. The liquid passage 10 is communicated with an ejection port 18, and also communicated with a common liquid chamber 13 for supplying a liquid to a plurality of the liquid passages 10 for receiving the liquid in an amount corresponding to the amount of liquid ejected from the ejection port from the common liquid chamber 13.

On the element substrate of the liquid passage 10, a plate form movable member 31 is provided opposing the heater 2, in cantilever fashion. The movable member 31 is formed with a material having resiliency, such as metal or the like and has a flat surface portion. One end of the movable member is fixed to a base (support member) 34 formed by patterning of a photosensitive resin on the wall of the liquid passage 10 or the element substrate. By this, the movable member is held and a fulcrum (fulcrum portion) 33 is constructed.

The movable member 31 is arranged in such a manner that it has a fulcrum (fulcrum portion: fixed end) 33 at the upstream side of a flow flowing from the common liquid chamber 13 to the ejection port 18 via the movable member 31, and a free end (free end portion) 32 at the downstream side with respect to the fulcrum 33, and that it is located at a position opposing to the heater 2 in a condition covering the heater 2 with a distance about 15 $\mu$m from the heater 2. A gap between the heater and movable member becomes a bubble generating region. It should be noted that kind, shape and arrangement of the movable member are not limited to the shown kind, shape and arrangement, and can be of any shape and arrangement which can control growth of bubble and transmission of pressure as will be discussed later. It should be noted that the foregoing liquid passage 10 will be explained separately dividing into a portion directly communicated with the ejection port 18 as a first liquid passage 14, and a portion having the bubble generating region 11 and the liquid supply passage 12 as a second liquid passage 16, across the movable member 31, for explaining flow of the liquid to be explained later.

By applying a heat for the liquid of the bubble generating region 11 between the movable member 31 and the heater 2 by heating the heater 2, bubble is generated in the liquid by film boiling as disclosed in U.S. Pat. No. 4,723,129. The pressure by generation of bubble and bubble per se are preferentially act on the movable member, and then, the movable member 31 is displaced to toward the ejection port to open widely about the fulcrum 33 as shown in FIGS. 1A, 1B or 2. By displacement or displaced condition of the movable member 31, transmission of the pressure generated by bubble generation and growth of the bubble are directed toward the ejection port.

Here, the basic principle of ejection will be explained. In an ejection mechanism applicable to the present invention, one of the most important principle is that by the movable member arranged opposing bubble is displaced from the first position in the steady state to the second position after displacement by the pressure of the bubble or the bubble per se, to feed the pressure associating with generation of bubble or the bubble per se toward the downstream side where the ejection port 18 is arranged, by displacement of the movable member 31.

Figure 3:
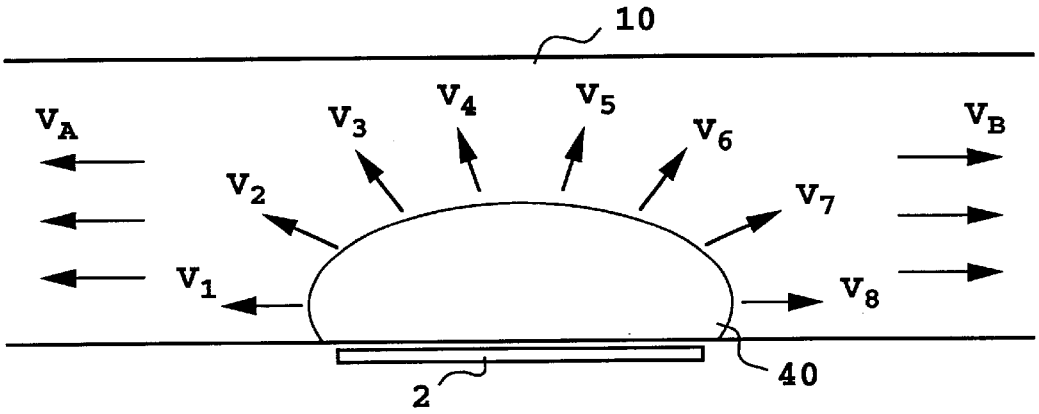
FIG. 3 is a diagrammatic view showing pressure transmission from a bubble in the conventional head.
Figure 4:
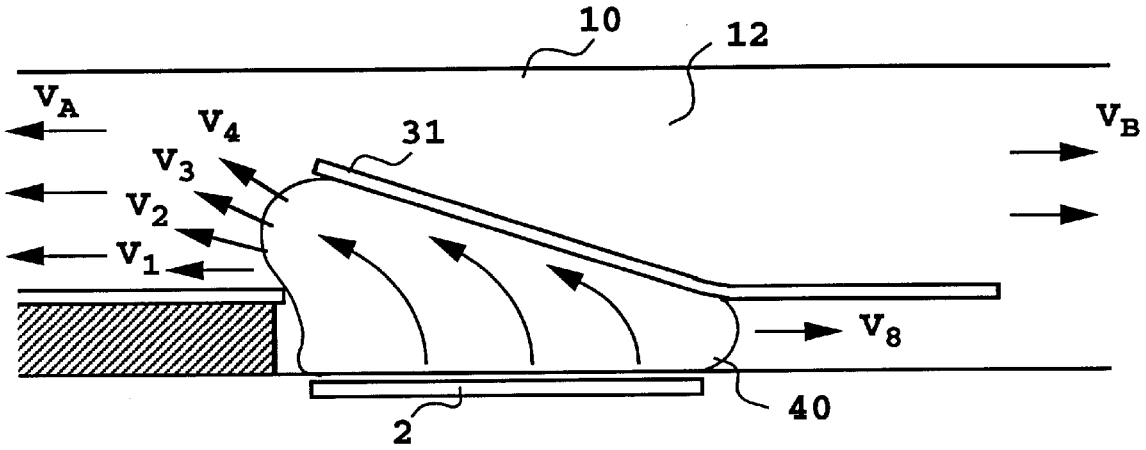
FIG. 4 is a diagrammatic view showing pressure transmission from a bubble in the liquid ejection mechanism applicable to the present invention.

This principle will be further explained with comparing FIG. 3 diagrammatically showing the conventional liquid passage structure without employing the movable member and FIG. 4 diagrammatically showing the liquid passage structure with employing the movable member showing the ejection mechanism as described above. It should be noted that here, a transmitting direction of the pressure toward the ejection port is VA and the transmitting direction of the pressure toward the upstream side is Vs.

In the conventional head shown in FIG. 3, there is no construction to restrict transmitting direction of the pressure generated by the generated bubble 40. Therefore, pressure transmitting direction of the bubble 40 becomes perpendicular line directions of the surface of bubble as shown by arrows V1 to V8 and thus is directed in various directions. Amongst, one having a component having largest influence in liquid ejection and having pressure transmitting direction in VA direction, is the direction component of the pressure transmission at the portion of the ejection port side with respect to the substantially half position of the bubble. This portion is important portion directly contributing for liquid ejection efficiency, liquid ejection force, ejection speed and so on. Furthermore, V1 is closest to the direction of ejection VA, and thus act efficiently. Conversely, V4 has relatively small component directed toward VA.

In contrast to this, in case of construction as shown in FIG. 4, the movable member 31 directs the transmitting direction of the pressure in various directions in the conventional head as illustrated in FIG. 3 to the direction of V1 to V4 to lead the pressure toward the downstream side to convert into the pressure transmitting direction of VA. By this, the pressure of the bubble 40 can directly and efficiently contribute for ejection. Furthermore, since the growth direction of the bubble per se is also led toward the downstream side similarly to the pressure transmitting direction V1 to V4 to grow to be greater at the downstream side than the upstream side. As set forth, by controlling the growth direction per se of the bubble and transmitting direction of the pressure of the bubble, ultimate improvement of the ejection efficiency, ejection force, ejection speed and so on can be achieved.

Next, returning to FIGS. 1A to 1D, the ejecting operation of the example of the liquid ejection head will be described in detail.

FIG. 1A shows a condition before application of an energy, such as an electrical energy or the like to the heater 2 and thus shows the condition before the heater generates heat. The important thing at this condition is that the movable member 31 is provided at a position at least opposing to the downstream side portion of the bubble in relation to the bubble to be generated by the heater. Namely, so that the downstream side portion of the bubble may act on the movable member, the movable member 31 is arranged at least to the downstream position (downstream of a line extending through the center 3 of the area of the heater in a direction perpendicular to the longitudinal direction of the liquid passage) of the center 3 of the area of the heater in the liquid passage structure.

FIG. 1B shows a condition, in which the electrical energy or the like is applied to the heater 2, the heater 2 is thus heated, a part of the liquid filling the bubble generating region 11 is headed by the generated heat, and thus bubble is generated by film boiling.

At this time, the movable member 31 is displaced from the first position to the second position by the pressure generated by generation of bubble 40 so that the transmitting direction of the pressure of the bubble 40 may be directed toward the ejection port. The important matter herein is that the movable member 31 is arranged to place the free end 32 of the movable member 31 at the downstream side (ejection port side) and to place the fulcrum 33 at the upstream side (common liquid chamber side) to make at least a part of the movable member to opposite the downstream side portion of the heater, i.e., the downstream side portion of the bubble.

FIG. 1C shows the case where the bubble 40 is further grown. According to increasing of pressure due to generation of the bubble, the movable member 31 is further displaced. The generated bubble grows to be greater at the downstream side than that in the upstream position, and in conjunction therewith, the bubble is grown to be greater beyond the first position (position shown by broken line). Thus, by gradually displacing the movable member 31 according to growth of the bubble, the ejection efficiency of the head can be elevated by uniformly directing the transmitting direction of the pressure of the bubble 40 and the direction of easily shifting of volume, namely the grown direction toward the free end 32 of the movable member 31, toward the ejection port. This also contributes for enhancing the ejection efficiency. Upon guiding the bubble, the bubble pressure toward the ejection port, the movable member will never cause interference, and can control transmitting direction of the pressure or the growth direction of bubble depending upon magnitude of the pressure to be transmitted.

FIG. 1D shows a condition where the internal pressure of the bubble 40 is lowered to cause shrinking of the bubble 40 to extinct, after film boiling.

The movable member 31 displaced to the second position then returns to the initial position (first position) of FIG. 1A by vacuum pressure due to shrinking of the bubble and by restitutive force due to the resiliency of the movable member 31 per se. On the other hand, during shrinking of bubble to extinct, in order to compensate the shrinking volume and thus to compensate the ejected amount of the liquid, the liquid flows from the upstream side, i.e. the common liquid chamber side as flows VD1 and VD2 and from the ejection port side as flow Vc.

While the operation of the movable member and liquid ejecting operation associating with generation of bubble have been explained, re-filling of liquid in the liquid ejection head will be described in greater detail.

A liquid supply mechanism in the present invention will be described in greater detail with reference to FIGS. 1A to 1D.

After FIG. 1C, when the bubble 40 enters into extinction stage after the state of the maximum volume, the liquid in the volume compensating the extinction volume of the bubble flows into the bubble generating region from the ejection port 18 side of the first liquid passage 14 and from the common liquid chamber 13 side of the second liquid passage 16. In the conventional liquid passage structure having no movable member 31, the amount of liquid flowing into the bubble extinction position from the ejection port side and the amount of liquid from the common liquid chamber depend on flow resistance at the portion located at the ejection port side with respect to the bubble generating region and the portion located at the common liquid chamber side with respect to the bubble generating region (depending upon flow resistance of the passage and the inertia of the liquid).

Therefore, when the flow resistance at a portion near the ejection port is smaller, greater amount of liquid flows into the bubble extinction position to increase retracting magnitude of the meniscus. Particularly, when the flow resistance at the portion near the ejection port is made smaller for enhancing ejection efficiency, retraction magnitude of the meniscus upon extinction of bubble becomes greater to take longer re-fill period to obstruct high speed printing.

In contrast to this, since the example is provided the movable member 31, assuming that the volume of bubble 40 is W1 at upper side and W2 at the bubble generating region 11 side across the first position of the movable member 31, retraction of meniscus is stopped at a timing where the movable member returned to the initial (first) position, and remaining volume of W2 is mainly supplied by the flow VD2 of the second liquid passage 16. By this, the retraction amount of meniscus which corresponds to approximately half of the volume W of the bubble in the prior art, can be retracted to be about half of W1 which is smaller than half of W.

Furthermore, liquid supply for the column of W2 is performed along the heater side surface of the movable member 31 utilizing the negative pressure upon extinction of bubble, forcedly mainly from the upstream side (VD2) of the second liquid passage, quicker re-fill can be achieved.

The feature is that, if the re-filling utilizing the pressure upon extinction of bubble in the conventional head, vibration of meniscus becomes large to cause degradation of printed image quality, whereas, in the high speed re-fill in this example, liquid communication between the first liquid passage at the ejection port side and the bubble generating region is restricted by the movable member, vibration of the meniscus can be restricted to be quite small.

As set forth, according to the principal, by forced re-fill into the bubble generating region via the liquid supply passage of the second liquid passage 16 and high speed re-fill with restricting retraction and vibration of meniscus, stability of ejection, high speed repeated ejection can be achieved. Furthermore, when the construction is applied for image printing, improvement of printed image quality and high speed printing can be realized.

The following effective function can be achieved: Transmission of the pressure generated by the bubble toward the upstream side (back wave) can be restricted. Among bubbles generated on the heater 2, the most pressure generated by the bubble within the common liquid chamber 13 side (upstream side) serves as a force to push back the liquid toward the upstream side (back wave). This back wave caused increasing of pressure at the upstream side, the liquid movement, and inertia force due to motion of the liquid to lower performance of re-filling the liquid passage to obstruct high speed driving. In the principal, these effects toward the upstream side can be restricted by the movable member 31 to improve re-fill performance.

Next, further particular structure and effect to be achieved by the example will be explained.

The second liquid passage 16 of the example has a liquid supply passage 12 having internal wall jointed with the heater in substantially flush surface. In such case, supply of the liquid to the bubble generating region 11 and the surface of the heater 2 is performed along the surface at closer side to the bubble generating region 11 of the movable member 31. Therefore, stagnation of the liquid on the surface of the heater 2 can be prevented to promote separating out of the gas dissolved in the liquid and removal of residual bubble remained without extinction. Furthermore, excessive accumulation of the heat can also be prevented. Accordingly, stable bubble generation can be repeated at high speed. It should be noted that while the example has been described in terms of the head having the liquid supply passage 12 with substantially flat inner wall, it is only required to be smoothly jointed with the surface of the heater and to have smooth inner wall in the liquid supply passage so as not to cause stagnation of the liquid on the heater and significant disturbance in supply of the liquid.

Also, supply of the liquid to the bubble generating region is also performed from VD1 through the side portion (slit 35) of the movable member. However, in case that, in order to guide the pressure upon generation of bubble more effectively to the ejection port, a large movable member to cover entire bubble generating region (covering the heater surface) as shown in FIG. 1A, and the flow resistance of the liquid in the bubble generating region 11, the region of the first liquid passage in the vicinity of the ejection port is increased by returning the movable member 31 to the first position, the liquid flow from VD1 to the bubble generating region 11 is blocked. However, in the head structure applicable to the present invention, because of presence of flow VD1 for supplying the liquid to the bubble generating portion, liquid supply performance becomes quite high so as not to cause lowering of the liquid supply performance even with the construction seeking for improvement of ejection efficiency, such as the movable member 31 entirely covering the bubble generating region 11.

Figure 5:
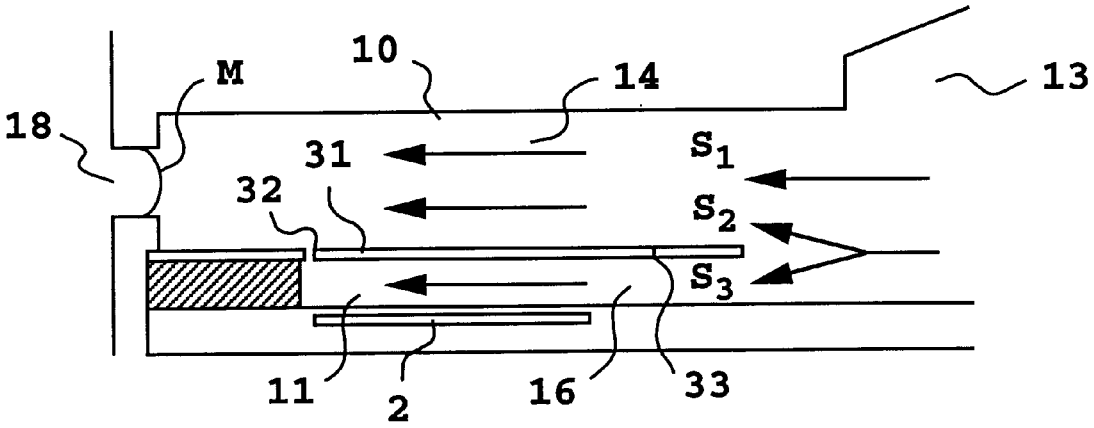
FIG. 5 is a diagrammatic view for explaining flow of the liquid in the liquid ejection mechanism applicable to the present invention.

On the other hand, the positional relationship of the free end 32 of the movable member 31 and the fulcrum 33 is that the free end 32 is located at downstream side relative to the fulcrum 33. For such construction, the function and effect to direct the transmission direction of the bubble and the growth direction of the bubble toward the ejection port side upon generation of bubble as set forth above can be efficiently realized. Furthermore, this positional relationship achieves not only the function and effect for ejection as set forth above but also the effect to permit high speed re-fill with reduced flow resistance for the liquid flowing through the liquid passage 10 during supplying of the liquid. As shown in FIG. 5, this is because when the meniscus retracted by ejection is returned to the ejection port 18 by capillary effect, or when the liquid is supplied in response to extinction of bubble, the free end of the fulcrum 33 are arranged so as not to resist against the flows S1, S2 and S3 flowing in the liquid passage 10 (including first liquid passage 14 and the second liquid passage 16).

Additionally, in this example of FIGS. 1A to 1D, the free end 32 of the foregoing movable member 31 is extended with respect to the heater 2 so as to be placed at the downstream side position than the center 3 of the area (line extending across the center of the area of the heater in perpendicular to the longitudinal direction of the liquid passage) dividing the heater into the upstream side region and the downstream side region. By this, the pressure or bubble significantly contribute for ejection of the liquid generated at the downstream side of the center position of the area of the heater is received by the movable member 31 to guide the pressure and bubble toward the ejection port side to significantly improve the ejection efficiency and ejection force.

Furthermore, in addition, many effects are achieved by utilizing the upstream side of the bubble.

On the other hand, in the construction of the example, momentary mechanical displacement of the free end of the movable member 31 also effectively contributes for ejection of the liquid.

Figure 6:
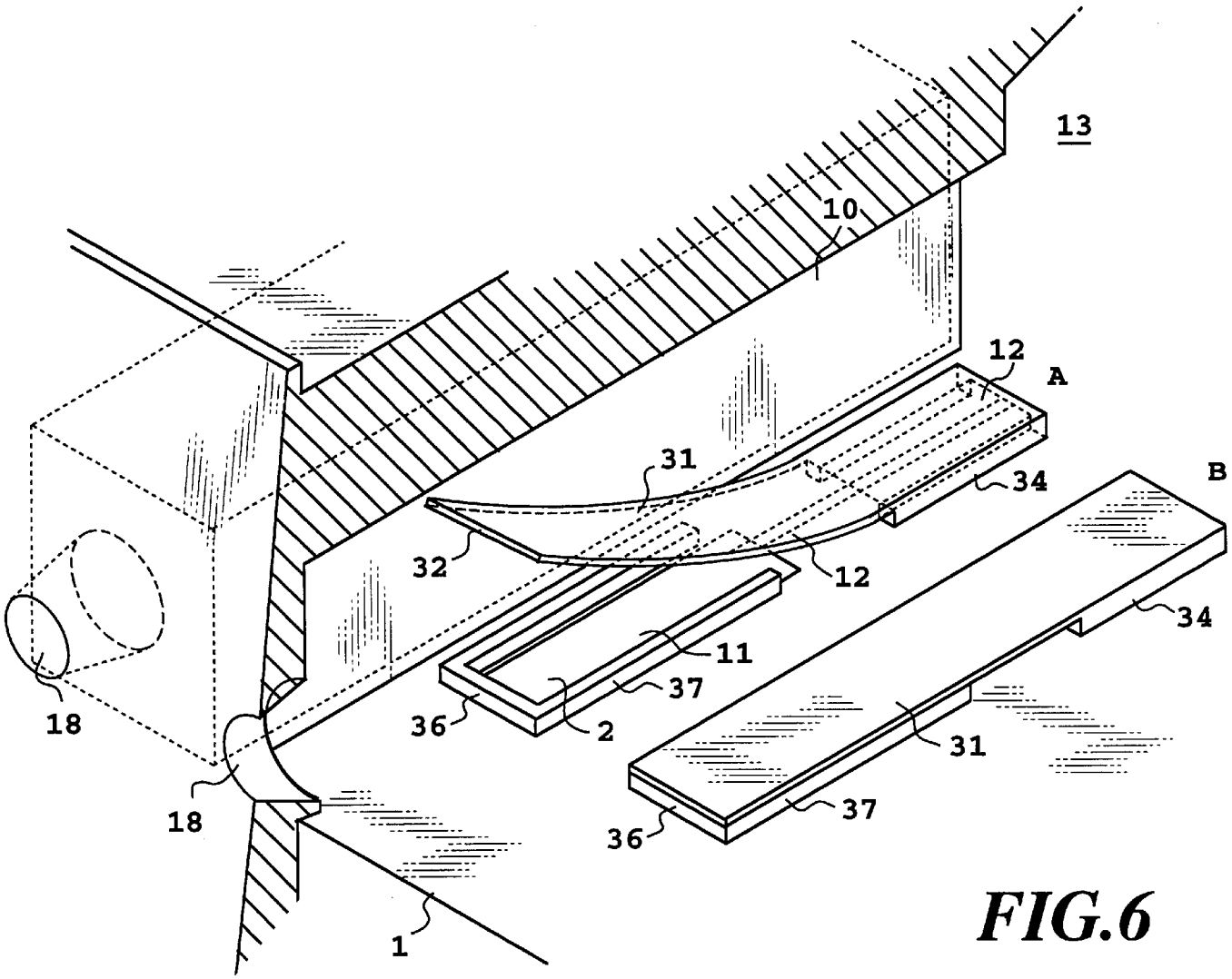
FIG. 6 is a partially cut-out perspective view of the second embodiment of a liquid ejection head applicable to the present invention.

FIG. 6 shows a second example of the liquid ejection principal applicable to the present invention. In FIG. 6, A shows the condition where the movable member is displaced (bubble is not shown), and B shows the movable member in the initial position (first position). At the condition of B, the movable member substantially enclosed the bubble generating region 11 with respect to the ejection port 18. (Here, while not shown, the wall of the liquid passage is arranged between A and B to separate the flow passages.)

In FIG. 6, the movable member 31 is provided two bases 34 which are separated from each other, and which are arranged along a direction perpendicular to the longitudinal direction of the liquid passage. Between the bases 34, the liquid supply passage 12 is defined. By this, along the heater side surface of the movable member 31, or, in the alternative, from the liquid supply passage having the surface of the movable member 31 is placed in substantially flush with the surface of the heater, or the smoothly joining surface, the liquid can be supplied.

Here, in the initial position (first position) of the movable member 31, the movable member 31 is placed in proximity or in tight contact with the downstream side wall of the heater and the side wall 37 of the heater arranged at the downstream side and the lateral direction of the heater 2 to substantially enclose the ejection port 18 side of the bubble generating region 11. Therefore, the pressure of the bubble, particularly the pressure of the downstream side of the bubble upon bubbling can be concentrically act on the free end side of the movable member without causing escape.

On the other hand, upon extinction of bubble, the movable member is returned to the first position. Then, since the ejection port 18 side in the bubble generating region 11 is substantially enclosed, the liquid supply to the heater upon extinction of bubble can obtain various effects explained in the former example such as retraction of meniscus or the like. Concerning effect in re-fill, similar function and effect to the former example can be obtained.

On the other hand, in this example, as shown in FIGS. 2 and 6, by providing the base 34 for supporting and fixing the movable member 31 at the upstream side distance from the heater 2, and in conjunction therewith, by providing smaller width for the base 34 than the liquid passage 10, liquid supply to the liquid supply passage 12 is performed. On the other hand, the shape of the base 34 is not limited to the shown shape, it can be of any shape which permit smooth re-fill.

It should be noted that, while the distance between the movable member 31 and the heater 2 is in the extent of 15 $\mu$m in the present example, it can be within a range to sufficiently transmit the pressure generated by the growth of bubbles.

Figure 7:
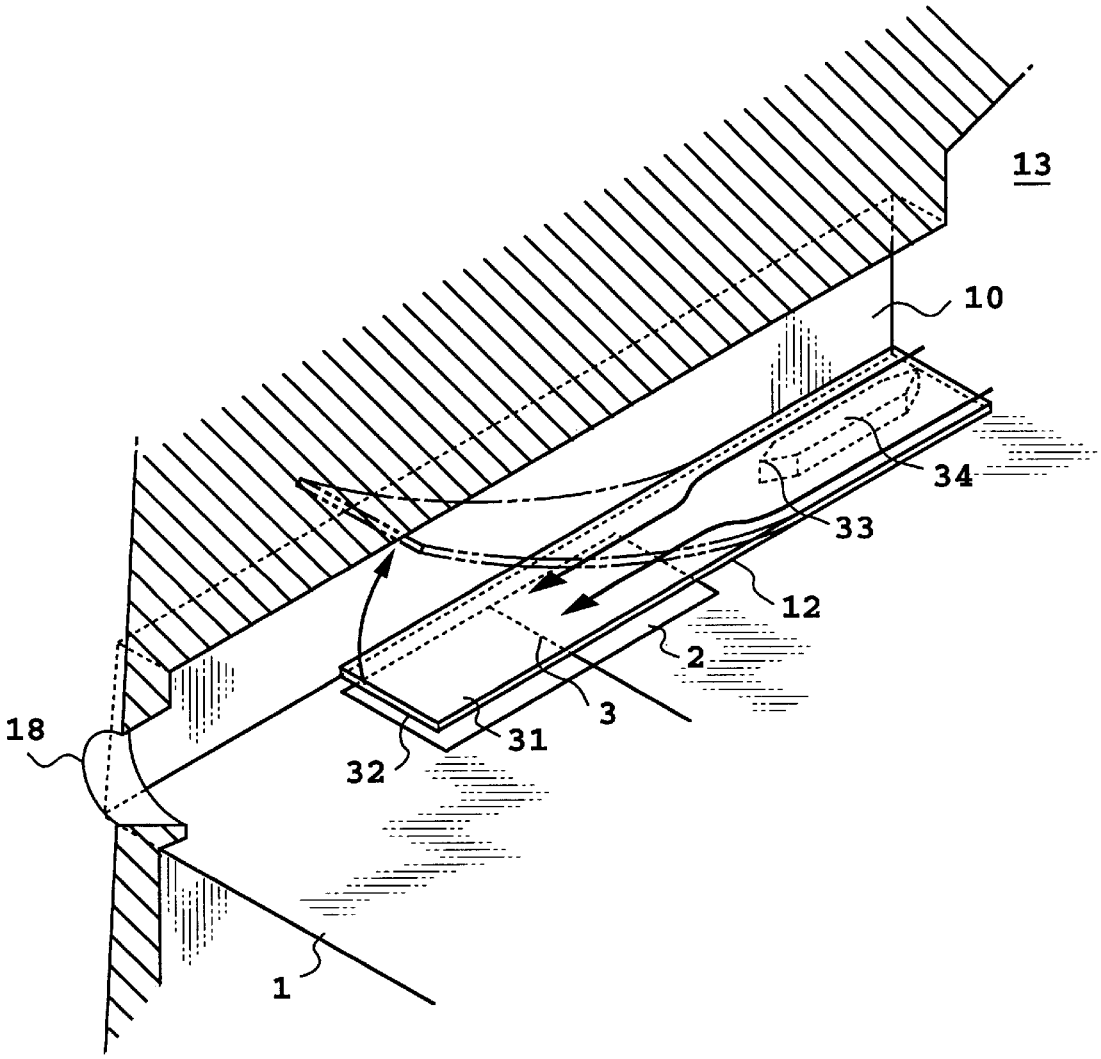
FIG. 7 is a partially cut-out perspective view of the third embodiment of a liquid ejection head applicable to the present invention.

FIG. 7 shows one of basic concept of the present example, and forms a third example of the present invention. FIG. 7 shows a positional relationship between the bubble generating region in one liquid passage and the bubble generated therein and the movable member, and facilitates a liquid ejection method and re-fill method.

Most of the former examples achieve concentration of movement of bubble toward the ejection port in conjunction with abrupt movement of the movable member by concentrating the pressure of the bubble to be generated. In contrast to this, in this example, with providing freedom for the bubble to be generated, the downstream side portion of the bubble which is the ejection port side portion of the bubble directly acting for ejection of droplet, is restricted at the free end side of the movable member.

Explaining on the construction, in FIG. 7, in comparison with the foregoing FIG. 2 (first example), a projecting portion (hatched portion in the drawing) provided on the element substrate 1 of FIGS. 1A to 1D and located downstream of the bubble generating region as a barrier, is neglected in this example. Namely, the free end region and the side edge regions do not substantially enclose the bubble generating region with respect to the ejection port region but keep it open. This construction is the example.

In this example, among the downstream side portion of the bubble which directly act for ejection of the liquid droplet, growth of the bubble in the tip end portion of the downstream side is permitted, the pressure component can be used effectively for ejection. In addition, the pressure at least directed upward acted in the downstream side portion (component forces of VB., VB., VB. of FIG. 3) is added to growth of the bubble at the down stream side by the free end side portion of the movable member to improve the ejection efficiency similarly to the foregoing example. In comparison with the former example, the example is superior in response characteristics with respect to driving of the heating body.

On the other hand, the example achieves advantage in fabrication for simple structure.

The fulcrum of the movable member 31 in this example, is fixed to the single base 34 which has small width respect to the surface portion of the movable member. Accordingly, the liquid supply for the bubble generating region 11 upon extinction of bubble is supplied through both sides of the base (see arrows in the drawing). The base may be of any configuration as long as liquid supply ability can be certainly maintained.

In this example, since inflow of the liquid to the bubble generating region from upper side in response to extinction of the bubble is controlled, the re-fill becomes superior in comparison with the bubble generating structure. By this, retraction amount of the meniscus can of course be reduced.

As a modification of the example, a construction, in which only both side edges (can be one side) with respect to the free end of the movable member 31 is substantially enclosed, can be nominated as a preferred modification. With this constriction, the pressure directed toward the side edge of the movable member can also be used by converting into the growth of the bubble at the end portion of the ejection port side as set forth above to further improve the ejection efficiency.

Figure 8:
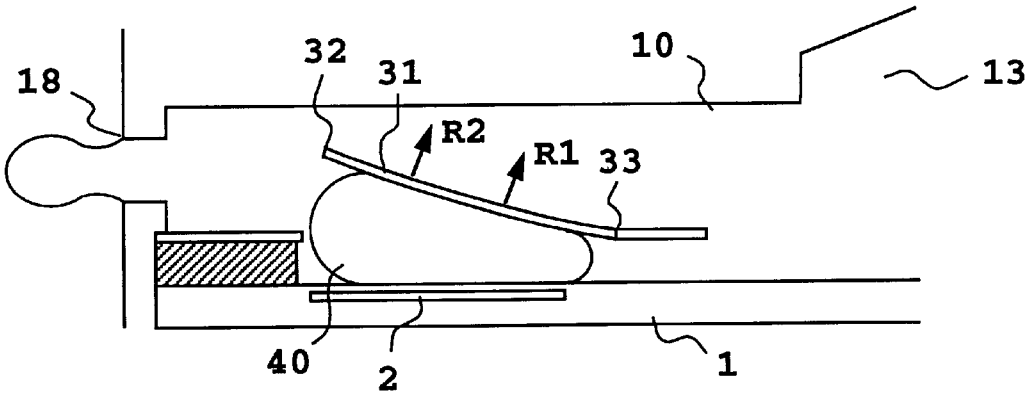
FIG. 8 is a section of the fourth example of the liquid ejection head according to the present invention.

An example further improving the ejection force of the liquid by mechanical displacement set forth above will be explained in this example. FIG. 8 is a cross section of such head structure. In FIG. 8, there is shown the example, in which the movable member is extended so that the position of the free end of the movable member 31 is located downstream of the heater. By this, displacement speed of the movable member at the free end position can be made higher to further improve generation of the ejection pressure by displacement of the movable member.

On the other hand, in comparison with the former example, the tip end of the movable member is located at a position closer to the ejection port so that growth of the bubble can be concentration to the more stable direction component to achieve superior ejection.

On the other hand, depending upon the bubble growth speed at the center portion of the pressure of the bubble, the movable member 31 displaces at a displacement speed R1. The free end 32 at the distal position farther with respect to the fulcrum 33 that the former position, displaces at higher speed R2. By this, the free end 32 is mechanically active on the liquid at high speed to cause motion of the liquid.

Furthermore, the shape of the free end may contribute for efficient ejection by the pressure of the bubble and the mechanical action of the movable plate by forming the shape of the free end which is perpendicular to the liquid flow, similarly to FIG. 7.

Figure 9A:
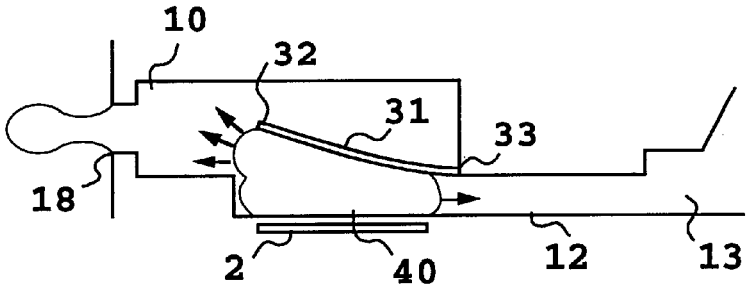
FIGS. 9A to 9C are diagrammatic sections of the fifth example of the liquid ejection head applicable to the present invention.
Figure 9B:
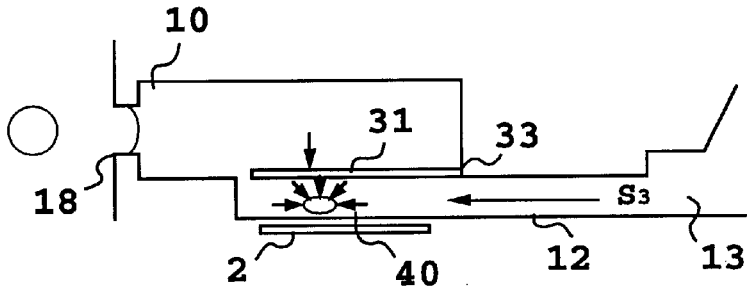
Figure 9C:
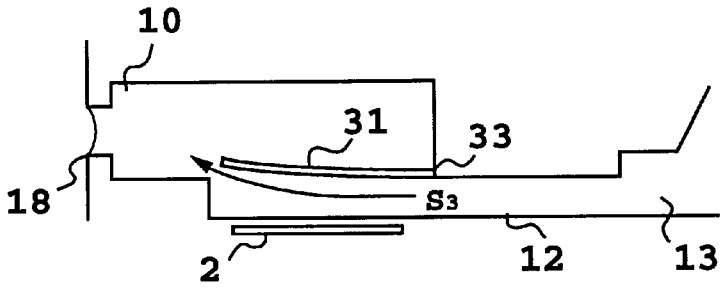

FIGS. 9A, 9B and 9C show the fifth example according to the present ejection mechanism.

The structure of the example is different from the former example, in which the region to directly communication is not in a form of the liquid passage communicated with the liquid chamber. Thus, structure can be simplified.

All of liquid supply is performed only through the liquid supply passage 12 along the surface of the bubble generating region. The positional relationship of the free end 32 of the movable member and the fulcrum 33 relative to the ejection port, and the construction opposing to the heater 2 are the same as those of the former example.

The present example realizes the foregoing effect, such as ejection efficiency, liquid supply ability and so forth. Particularly, restricting retraction of meniscus and utilizing the pressure upon extinction of bubble, almost all of the liquid supply is performed by utilizing the pressure upon extinction by forced re-fill.

FIG. 9A shows the condition where a bubble in the liquid is generated by the heater 2, and FIG. 9B shows the condition where the bubble is shrinking. At this time, returning of the movable member 31 to the initial position and liquid supply by S3 is performed.

In FIG. 9C, slight retraction of meniscus M upon returning of the movable member to the initial position is re-filled by capillary effect in the vicinity of the ejection port 18 after extinction of the bubble.

Hereinafter, the another example of the ejection mechanism will be explained with reference to the drawings.

Even in this example, primary principle of ejection of the liquid is the same as the former example. However, in this example, with a mullet-passage construction of the liquid passage, and the liquid (bubbling liquid) to be bubbled by application of the heat, and the liquid (ejection liquid) to be mainly ejected can be separated.

Figure 10:
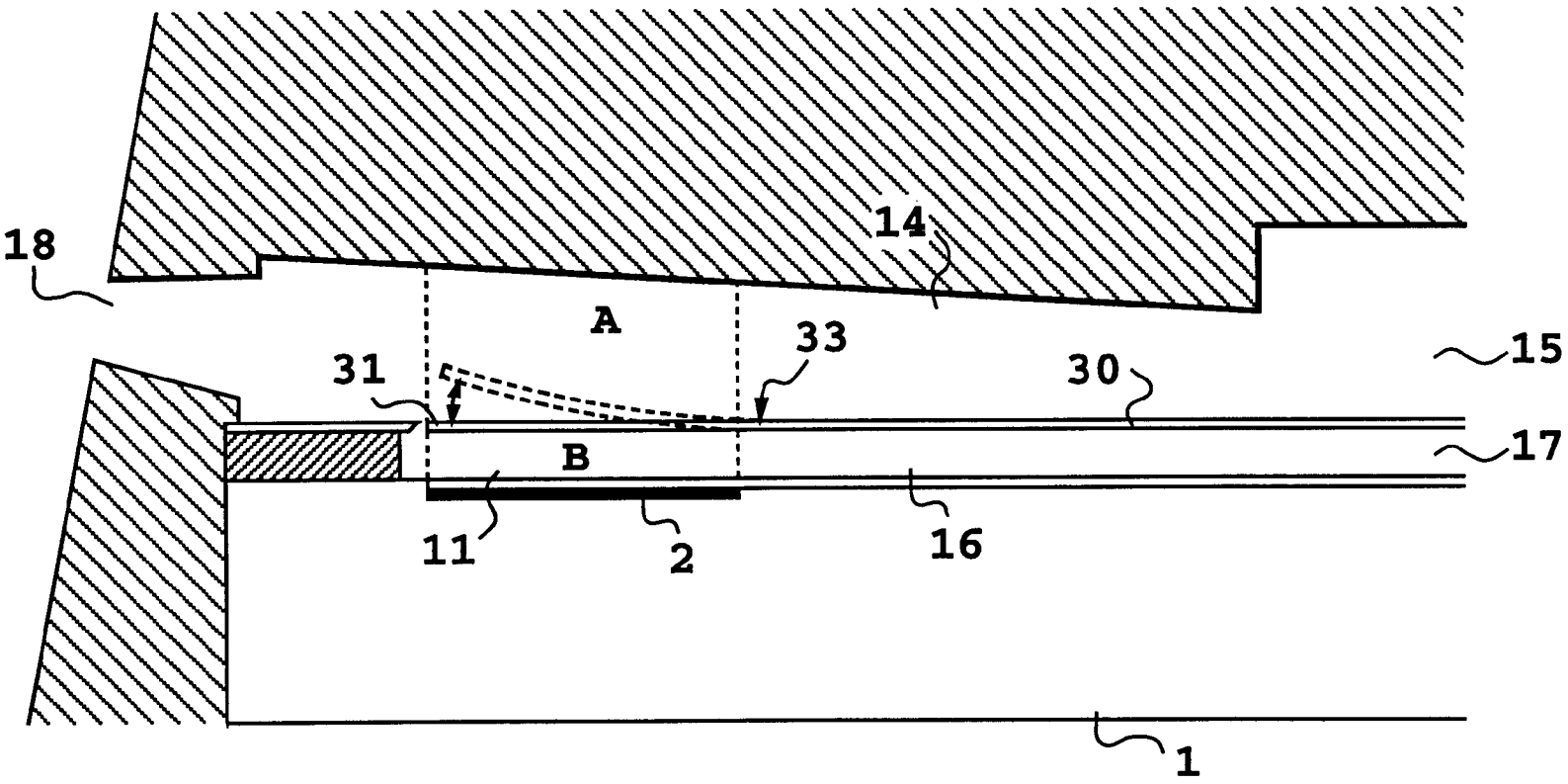
FIG. 10 is a section of the sixth example of the liquid ejection head (two liquid passages) applicable to the present invention.
Figure 11:
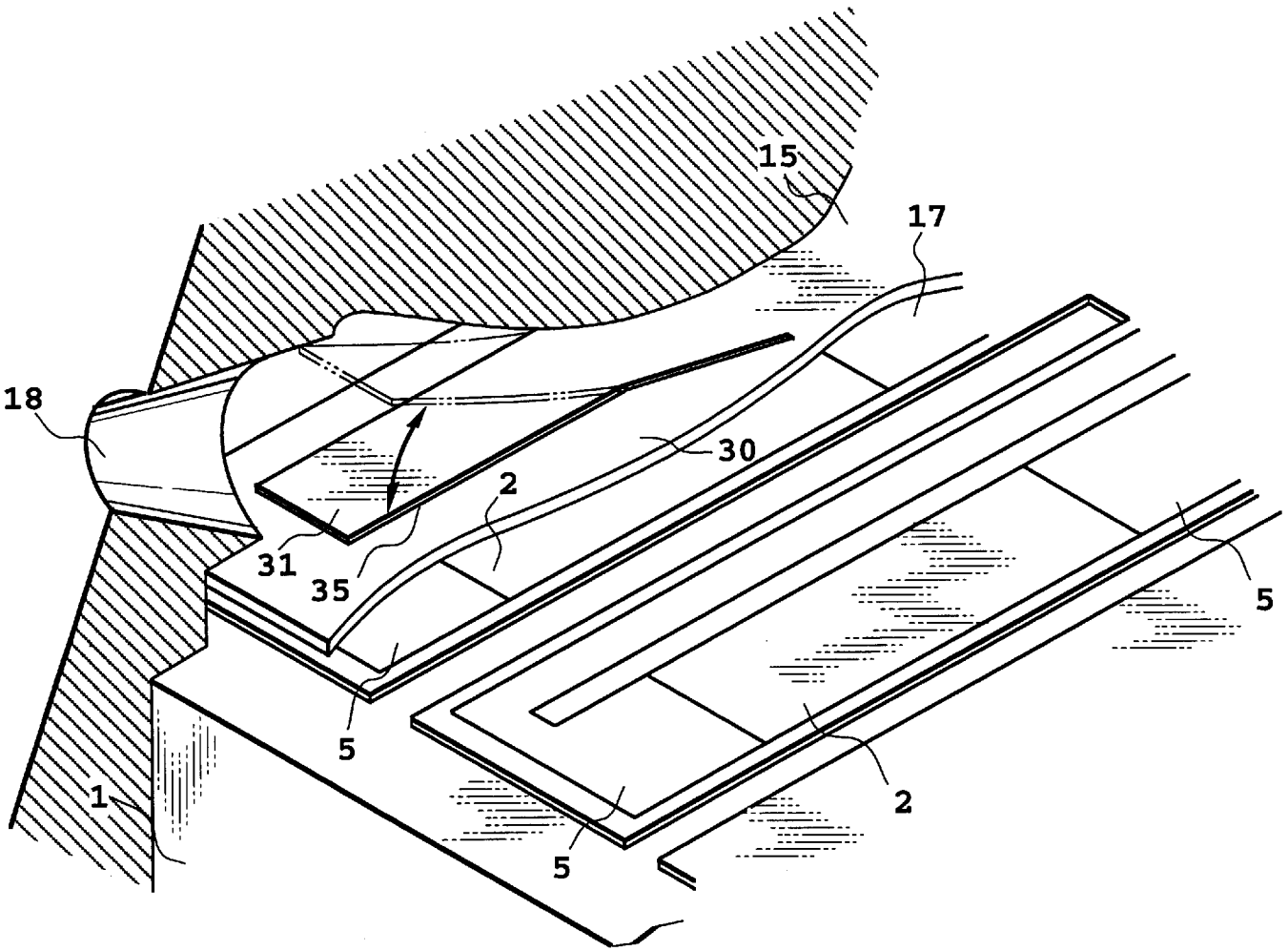
FIG. 11 is a partially cut-out perspective view of the liquid ejection head applicable to the present invention.

FIG. 10 is a sectional diagram of the liquid flow direction of the liquid ejection head of the example, and FIG. 11 is a partially cut-out perspective view of the liquid ejection head.

The example of the liquid ejection head is constructed with the second liquid passage 16 for bubbling is arranged on the element substrate 1, in which the heater 2 for providing thermal energy for generating bubble in the liquid, the first liquid passage 14 for ejection in direct communication with the ejection port 18 is arranged over the second liquid passage 16.

The upstream side of the first liquid passage 14 is communicated with the first common liquid chamber 15 for supply the ejection liquid to a plurality of the first liquid passage 14, and the side of the second liquid passage 16 at the upstream, is communicated with a second common liquid chamber 17.

It should be appreciated that when the bubbling liquid and the ejection liquid are the same, it is possible to unite the common liquid chambers to be a single common liquid chamber.

Between the first and second liquid passages 14 and 16, a separation wall 30 formed of a material having elasticity, such as metal to separate the first and second liquid passages 14 and 16. It should be noted that when the bubbling liquid and the ejection liquid are the liquids to be not admixed as much as possible, it should be better to separate the liquids in the first and second liquid flow chambers 14 and 16 as much as possible. When no problem will be arisen even if the bubbling liquid and the ejection liquid are admixed, it may not be necessary to provide a function for complete separation.

The portion of the separation wall located in a space above the heater, to which the surface of the heater may be projected (hereinafter referred to as ejection pressure generating region, the region including both region A and the bubble generating region 11 designated by symbol B in FIG. 10), is the movable member 31 in cantilever configuration, which has the free end on the ejection port side (downstream side of the flow of the liquid) and the fulcrum 33 on the common liquid chambers (15, 17) side. Since the movable member 31 is arranged in opposition to the bubble generating region 11 or B, it opens toward the ejection port side of the first liquid passage (in the direction of arrow in the drawing) in response to bubbling of the bubbling liquid. Even in FIG. 11, on the element substrate 1, on which the heating resistor portion as the heater 2 and the wiring electrode 5 for applying the electric signal to the heating resistor portion, the separation wall 30 is arranged via a space defining the second liquid passage.

The relationship between arrangement of the fulcrum 33 and the free end 32 of the movable member 31 and arrangement of the heater is the same as the former example.

On the other hand, while the relationship of the liquid supply passage 12 and the heater in construction has been explained with respect to the former example, even in this example, the relationship of constriction of the first liquid passage 16 and the heater 2 is the same.

Next, the operation of the example of the liquid ejection head will be explained with reference to FIGS. 12A and 12B.

Upon driving of the head, as the ejection liquid to be supplied to the liquid passage 12 and the bubbling liquid supplied to the second liquid passage 16, the same water base ink is employed for operation.

The heat generated by the heater 2 acts on the bubbling liquid within the bubble generating region of the second liquid passage, bubble 40 is generated in the bubbling ink through film boiling as disclosed in U.S. Pat. No. 4,723,129, similarly to that described in the former example.

In this example, bubbling pressure may never escape through three directions except for the upstream side of the bubble generating region. Therefore, the pressure associated with generation of the bubble is concentrically transmitted on the side of the movable member 31 arranged in the ejection pressure generating portion to cause displacement of the movable member 31 from the condition of FIG. 12A toward the first liquid passage 14 side as shown in FIG. 12B. By this action of the movable member 31, the first and second liquid passages 14 and 16 are communicated with wide path area so that the pressure generated by bubbling is mainly transmitted in the direction toward the ejection port (direction A) of the first liquid passage 14. By this pressure transmission and mechanical displacement of the movable member as set forth above, the liquid is ejected through the ejection port.

Figure 12A:
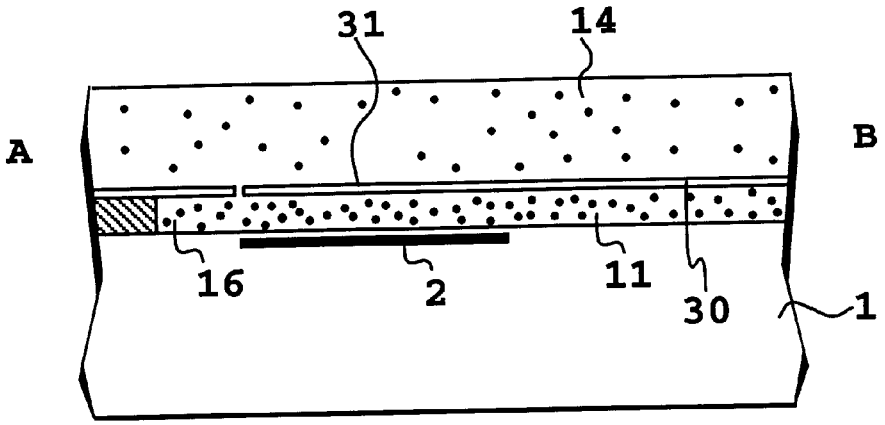
FIGS. 12A and 12B are views for explaining operation of a movable member.

Next, according to shrinking of the bubble, the movable member 31 returned to the position of FIG. 12A. In conjunction therewith, the ejection liquid in amount corresponding to the amount of the ejected liquid is supplied from the upstream side in the first liquid passage 14. Even in this example, supply of the ejection liquid is performed in the direction of closing the movable member similarly to the former example, re-fill of the ejection liquid may not be obstructed by the movable member.

While the example is the same as the first example and so on in terms of operation and effect of the major part with respect to transmission of the bubbling pressure by displacement of the movable member, growth direction of the bubble, prevention of back wave and the like, following further advantages can be achieved with the two flow passage construction as in this example.

Namely, with the construction of the foregoing example, the ejection liquid and the bubbling liquid can be mutually different liquid so that the ejection liquid may be ejected by the pressure generated by bubbling of the bubbling liquid. Therefore, even with high viscous liquid, such as polyethylene glycol or the like which is difficult to generate sufficient bubble and can generate insufficient ejection force in the prior art, it becomes possible to obtain satisfactory ejection by supplying the liquid having good bubbling characteristics (a mixture of ethanol: water=4:6 about 1 to 2 cP or the like) or a liquid having low boiling point to the second liquid passage.

On the other hand, by selecting a liquid which does not cause deposit, such as torrid or the like on the surface of the heater even in subjecting a heat, as the bubbling liquid, bubbling becomes stable to obtain satisfactory ejection.

Furthermore, in the head structure according to the present invention as set forth above, the effect explained in the former example can be achieved. Thus, the liquid such as the high viscous liquid or the like can be ejected with high ejection efficiency and high ejection force.

On the other hand, even in the case of the liquid weak in the heat, high efficiency and high ejection force of such liquid can be done by supplying such liquid to the first liquid passage as the ejection liquid, and by supplying a liquid which is difficult to cause alternation of property due to heat and can easily generate bubble, to the second liquid passage, without causing adverse effect.

<Other Examples>

The examples of the major portion of the liquid ejection head and the liquid ejection method according to the present invention, has been explained. In the description given hereinafter, both examples employing the single liquid passage and the example employing the dual liquid passages, any one of the passages may be taken in the description. However, as long as not specifically mentioned, the example is applicable for both examples.

<Ceiling Configuration of Liquid passage>

Figure 13:
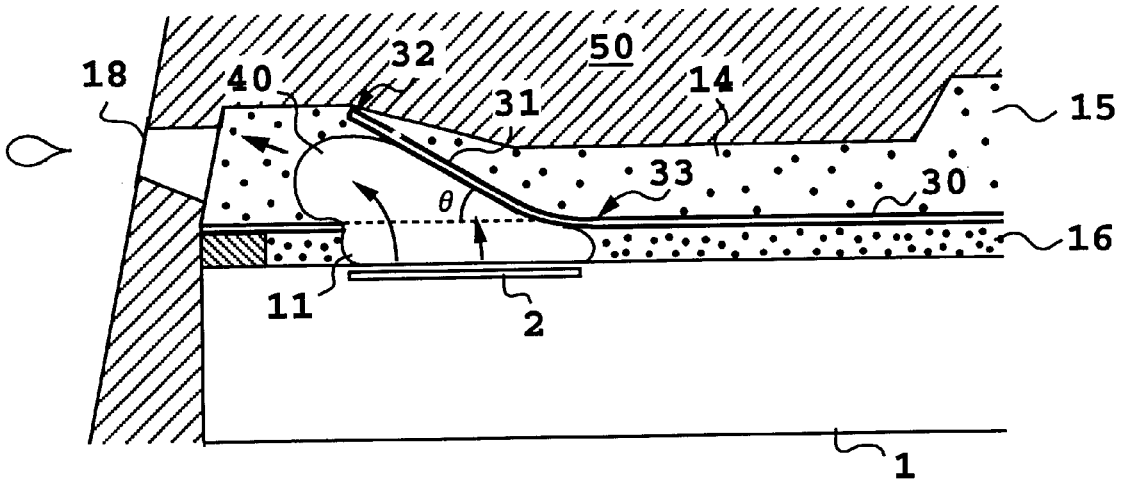
FIG. 13 is a view for explaining a structure of the movable member and a first liquid passage.

FIG. 13 is a cross-sectional view in the liquid passage direction of the liquid ejection head of this example. A grooved member 50 having a groove defining the first liquid current passage 14 (or the liquid passage 10 in FIG. 1), is arranged above the separation wall 30. In this example, the height of the ceiling or an upper plate of the liquid passage in the vicinity of the position of the free end of the movable member is high to provide greater operation angle q of the movable member. The operation range of the movable member may be determined with taking the structure of the liquid passage, durability of the movable member, bubbling force and so on. It is desirable that the operation range of the movable member permits operation up to the angle including the axial direction of the ejection port.

On the other hand, as shown in this figure, by proving greater high of the displacement of the free end of the movable member than the diameter of the ejection port, further sufficient ejection force can be transmitted. Also, as shown in this figure, since the height of the upper plate of the liquid passage at the position of the fulcrum 33 of the movable member is lower than the height of the upper plate of the liquid passage at the position of the free end of the movable member, surge of the pressure wave toward the upstream side can be further effectively prevented.

<Positional Relationship between Second Liquid passage and Movable Member>

Figure 14A:
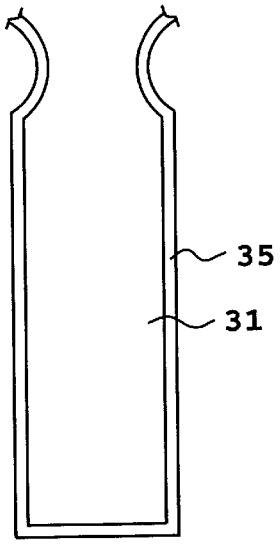
FIGS. 14A to 14C are views for explaining structures of the movable member and liquid passage.
Figure 14B:
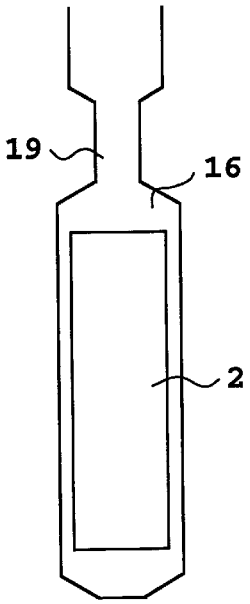
Figure 14C:
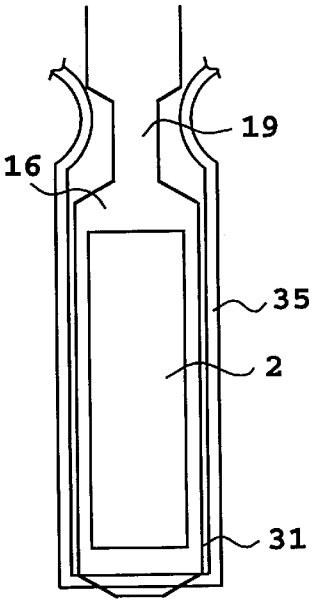

FIGS. 14A, 14B and 14C are illustration for explaining positional relationship between the movable member 31 and the second liquid passage 16. FIG. 14A is an illustration of the portion in the vicinity of the separation wall 30 and the movable member 31 as viewed from the above, FIG. 14B is an illustration showing the second liquid passage 16 with removing the separation wall 30, as viewed from the above, and FIG. 14C is an illustration showing positional relationship of the movable member 31 and the second liquid passage 16 as illustrated diagrammatically by overlapping respective elements. It should be noted that in all figures, lower sides in the drawings are the front face side where the ejection port arranged.

The second liquid passage 16 of the example has a narrowed portion 19 at the upstream side of the heater 2 (here, upstream side means the upstream side in the flow from the second common liquid chamber to the ejection port via the heater position, the movable member and the first liquid passage) to define a chamber structure (bubbling chamber) which successfully prevent the pressure generated by bubbling from easily escaping toward the upstream side of the second liquid passage 16.

In conventional case of the head where the liquid passage of bubbling and the liquid passage for ejecting the liquid are common and the narrowed portion is provided to prevent the pressure generated at the liquid chamber side of the heater from escaping, it was necessary to take a constriction, in which the liquid flow sectional area in the narrowed position is not too small in view of re-fill of the liquid.

However, in this example, large proportion of the liquid to be ejected is the ejection liquid in the first liquid passage, and the bubbling liquid in the second liquid passage where the heater is provided, is not consumed in significant amount. Therefore, re-fill amount of the bubbling liquid to the bubble generating region 11 of the second liquid passage can be small.

Accordingly, the distance in the narrow portion 19 can be quite small in the extent of several Am to several ten-odd ten $\mu$m. Therefore, the pressure generating in the second liquid passage during bubbling can be restricted from escape to the circumference to concentrically direct to the movable member. Since this pressure can be used as ejection force via the movable member 31, higher ejection efficiency and higher ejection force can be achieved. It should be appreciated that the configuration of the first liquid passage 16 is not limited to the foregoing construction, and can be of any shape, through which the pressure generated by bubbling can be effectively transmitted to the movable member side.

As shown in FIG. 14C, the side portion of the movable member 31 covers a part of the wall forming the second liquid passage. By this, dropping down of the movable member into the second liquid passage is successfully prevented. This enhances separation between the ejection liquid and the bubbling liquid to improve the ejection pressure and the ejection efficiency. Also, it becomes possible to perform re-fill from the upstream side by utilizing the negative pressure upon extinction of bubble.

Figure 12B:
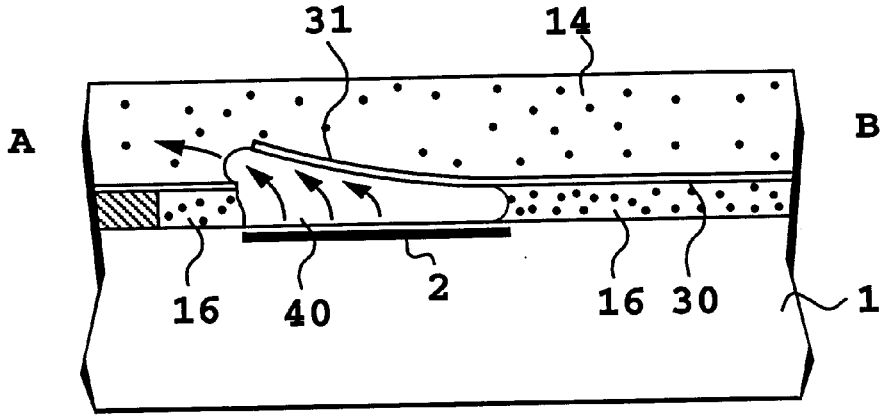

In FIGS. 12A, 12B and 13, associating with displacement of the movable member 31 toward the first liquid passage 14 side, a part of the bubble generated in the bubble generating region of the second liquid passage 16 extends into the first liquid passage 14, by selecting height of the second liquid passage so that the bubble extends into the first liquid passage 14, the ejection force can be improved in comparison with the case where the bubble may not extend into the first liquid passage. As set forth, in order to extend the bubble into the first liquid passage 14, it is desirable to set the height of the second liquid passage smaller than the maximum diameter of the bubble. Preferably, the height may be set within a range of several μm to 30 μm. It should be noted that, in this example, this height is set at 15 μm.

<Movable Member and Separation Wall>

Figures 15A, 15B, 15C:
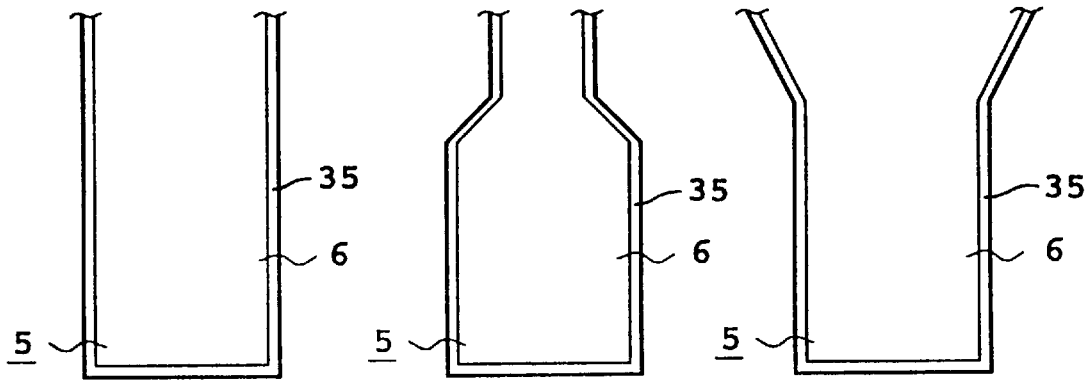
FIGS. 15A to 15C are views for explaining another shapes of the movable member.

FIGS. 15A, 15B and 15C show another configuration of the movable members, in which the reference numeral 35 denotes a slit provided in the separation wall, and by this slit, the movable member 31 is formed. In these figures, FIG. 15A shows a rectangular shaped configuration, FIG. 15B shows the configuration, in which the fulcrum side is formed narrower to facilitate operation of the movable member, and FIG. 15C shows the configuration, in which the fulcrum side is wider for improving durability of the movable member. As the configuration achieving easiness of operation and reasonable durability, the configuration having a narrowed portion with semicircular cut-outs at the fulcrum side as illustrated in FIG. 14A is desirable. However, the configuration of the movable member is only required not to enter into the second liquid passage side, easily operated and achieves high durability.

In the former example, the plate form movable member 31 and the separation wall 30 having the movable member is formed with a nickel of 5 μm thick. However, as the material of the movable member and the separation wall, any material which has sufficient resistance to solvent against the bubbling liquid and the ejection liquid, sufficient resiliency for satisfactory operation, and sufficient workability for permitting formation of fine slit.

As material usable for the movable member, it is desired to be selected from the materials having high durability, consisting of metal, such as silver, nickel, gold, iron, titanium, aluminum, platinum, tantalum, stainless steel, phosphor bronze or the like, alloy metals thereof, resin containing nitrile group, such as acrylonitrile, butadiene, styrene or the like, resin containing amide group, such as polyamide or the like, alloy metals thereof, resin containing carboxyl group, such as polycarbonate or the like, resin having aldehyde group, such as polyacetal or the like, resin containing sulfone group, such as polysulfone, other resin, such as liquid crystal polymer or the like, and compounds thereof having high ink resistance, consisting of metal, such as gold, tungsten, tantalum, nickel, stainless steel, titanium or the like, alloy thereof, one coated on the surface with respect to the ink resistance, resin having amide group, such as polyamide or the like, resin having aldehyde group, such as polyacetal or the like, resin containing ketone group, such as polyether ether ketone or the like, resin containing imide group, such as polyimide or the like, resin containing hydroxyl group, such as phenol or the like, resin containing ethyl group, such as polyethylene or the like, resin having alkyl group, such as polypropylene, resin having epoxy group, such as epoxy resin or the like, resin containing amino group, such as melamine formaldehyde resin, methylol group, such as xylene resin or the like, and their compound, and ceramic, such as silicon dioxide and compounds thereof.

As a material usable for the separation wall, resin having high heat resistance, solvent resistance, molding ability typically represented by recent engineering plastic, such as polyethylene, polypropylene, polyamide, polyethylene terephthalate, melamine resin, phenol resin, epoxy resin, polybutadiene, polyurethane, polyether ether ketone, polyether sulfone, polyarylate, polyimide, polysulfone, liquid crystal polymer (LCP) or so forth or their compound, silicon dioxide, silicon nitride, metal, such as nickel, gold, stainless steel or the like and alloy metals thereof, or one provided coating of titanium or gold.

On the other hand, the thickness of the separation wall may be determined in consideration of the material and shape or so forth in viewpoint of strength as the separation wall or good operation as the movable member, and is desirably 0.5 μm to 10 μm.

The width of the slit 35 for forming the movable member is set at 2 μm in this example. However, when the bubbling liquid and the ejection liquid are different liquids and it is desired to avoid admixing of the liquids, the width of the slit is determined in the extent that meniscus between both the two kinds of liquids to restrict communication between the liquids. For example, when a liquid having about 2 cP of bubbling liquid, and a liquid of greater than or equal to 100 cP as the ejection liquid, admixing of the liquids can be prevented even with the slit in the extent of 5 μm. However, it is preferred to have the width of slit less than or equal to 3 μm.

In the present invention, as the movable member, the thickness in the order of μm (t μm) is intended and not the thickness in the order of cm. For the movable member of the thickness in the order of μm, it is desirable to consider certain extent of fluctuation in fluctuation in the case of slit width in the order of μm is concerned.

When the free end of the movable member to form the slit and/or when the thickness of the member opposite to the side edge is comparable with the thickness of the movable member (FIGS. 12A, 12B, 13 or so on), by setting relationship of the slit width and thickness within the following range in consideration of tolerance in fabrication, admixing the bubbling liquid and the ejecting liquid can be stably restricted. While this is the limited condition, in viewpoint of design, when high viscosity ink (5 cP, 10 cP or so forth) with respect to the bubbling liquid of the viscosity of less than or equal to 3 cP, admixing of two liquids can be restricted for long period by satisfying W/t £ 1.

As the slit providing "substantially enclosed condition" in the present invention, the substantially enclosed condition can be certainly established in the order to several μm.

As set forth above, when the liquids are functionally separated for the bubbling liquid and the ejection liquid, the movable member will substantially be a partitioning member thereof. Upon moving the movable member in response to generation of bubble, the bubbling liquid may be slightly admixed with respect to the ejection liquid. In consideration of the fact that it is typical to contain 3% to 5% of coloring material to be contained in the ejection liquid to form the image, in case of the ink-jet printing, no significant variation of concentration will be caused even when the ejection liquid droplet is contained the second textile ink in the extent less than or equal to 20%. Accordingly, as such mixture, with respect to the droplet of the ejection liquid, mixture of the bubbling liquid and the ejection liquid to be less than or equal to 20% can be contained in this example.

It should be noted that, in the implementation of the foregoing example, even by varying viscosity, admixing of the bubbling liquid is 15% at most. In case of the bubbling liquid less than or equal to 5 cP, the mixture ratio is in the extent of 10%, while it is variable detecting upon the driving frequency.

Particularly, by setting the viscosity of the ejection liquid to be less than or equal to 20 cP, admixing can be reduced (to be less than or equal to 5%, for example).

Next, positional relationship between the heater and the movable member in the head will be explained with reference to the drawings. It should be noted that the shape, dimension and number of the movable member and the heater are not restricted to those specified. By optimal arrangement of the heater and the movable member, the pressure upon bubbling by the heater, can be effectively used as the ejection pressure.

Figure 16:
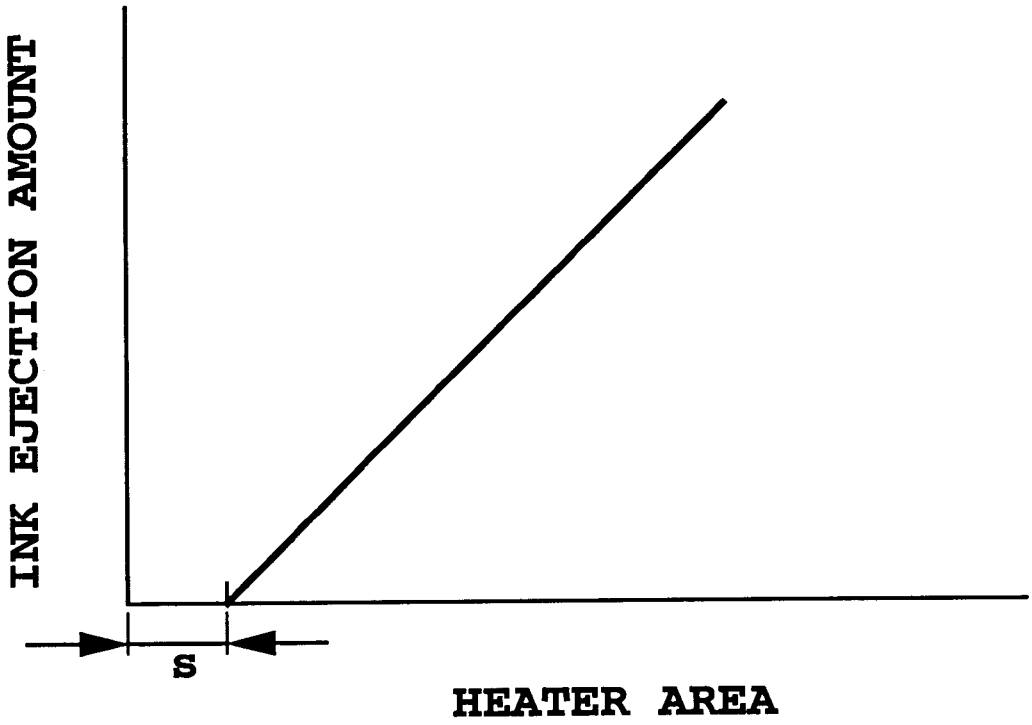
FIG. 16 is a graph illustrating a relationship between an area of a heater and an ink ejection amount.

In the conventional ink-jet printing method, so-called bubble-jet printing method, in which by applying the energy, such as heat, to the ink, abrupt state variation associating with volume variation (generation of bubble) of the ink is caused to eject the ink through the ejection port by the ejection force caused by the state variation to deposit on the printing medium to form the image, it should be appreciated that there is non-effective bubbling region S which does not contribute for ejection of the ink, is present, as shown in FIG. 16. Also, from torrid on the surface of the heater, it should be appreciated that the non-effective bubbling region S extends around the heater. From this result, about 4 $\mu$m width around the heater is considered not contributing for bubbling.

Accordingly, in order to effectively use the bubbling pressure, it can be said to be effective to arrange the movable member so that the effective bubbling region inner side distanced from the circumferential edge of the heater in the extent greater than or equal to about 4 $\mu$m can be covered with the movable region of the movable member. While the effective bubbling region is set to be inside distanced from the circumferential edge of the heater in the extent greater than or equal to about 4 $\mu$m, this region is not specific and is variable depending upon kind and fabrication method of the heater.

Figure 17A:
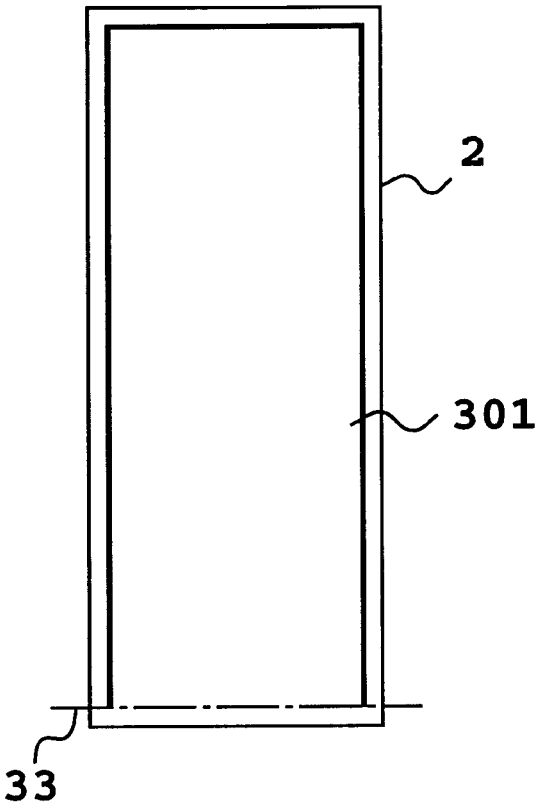
FIGS. 17A and 17B are views showing relationship of positions of the movable member and the heater.
Figure 17B:
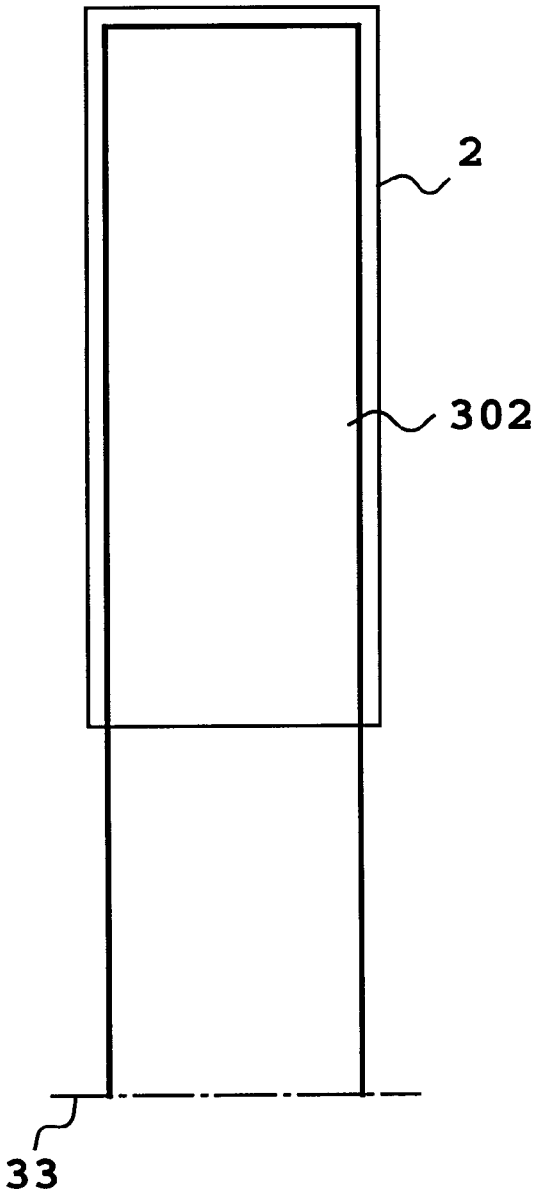

FIGS. 17A and 17B are diagrammatic views for the case where a movable member 301 (FIG. 17A) and a movable member 302 (FIG. 17B) having mutually different total area of the movable regions are arranged above the heater 2 of 58×150 $\mu$m.

The dimension of the movable member 301 is 53×145 $\mu$m which is smaller than the area of the heater 2 but is the equivalent dimension and is arranged to cover the effective bubbling region. On the other hand, the dimension of the movable member 302 is 53×220 $\mu$m which is greater than the area of the heater 2 (when the width is made equal, the distance between the fulcrum and the movable tip end is longer than that of the heater) and covers the effective bubbling region similarly to the movable member 301. With respect to these two kinds of the movable members 301 and 302, durability of ejection efficiency were measured. The measurement conditions are as follows:

| | |
|---|---|
| Bubbling liquid | ethanol 40% aqueous solution |
| Ejection ink | dye ink |
| Voltage | 20.2 V |
| Frequency | 3 kHz |

As a result performing experiments under the foregoing measurement condition, with respect to durability of the movable member, the movable member 301 of FIG. 17A caused damage at the support portion after $1\times10^7$ pulses are applied. On the other hand, the movable member 302 of FIG. 17B did not cause damage even after application of $1\times10^8$ pulses. Also, it has been confirmed kinetic energy derived from the ejection amount and the ejection speed with respect to the applied energy has been improved in the extent of about 1.5 to 2.5 times.

From the result set forth above, in view of both of the durability and ejection efficiency, it has been appreciated that it is superior to provide the movable member to cover the right above the effective bubbling region, and the area of the movable member is greater than the area of the heater.

Figure 18:
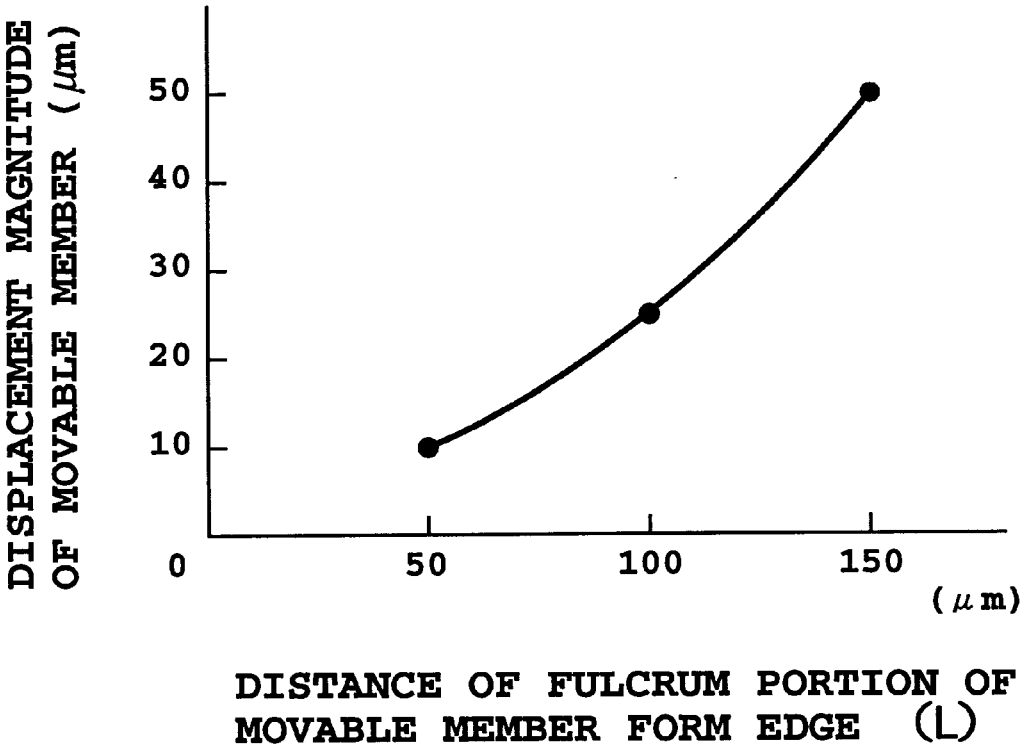
FIG. 18 is a graph illustrating a relationship between a distance between the edge of the heater to a fulcrum and a displacement magnitude of the movable member.
Figure 19:
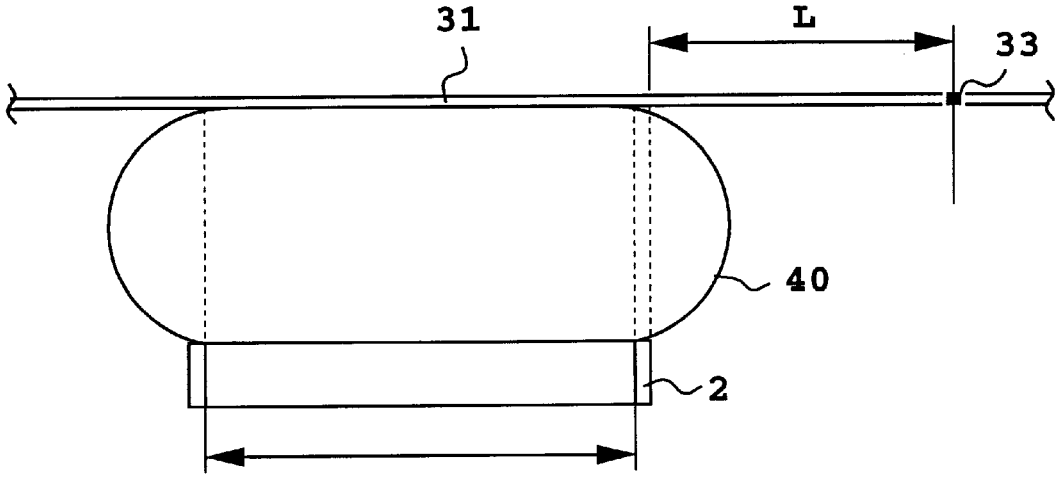
FIG. 19 is a view for explaining relationship of position between the heater and the movable member.

FIG. 18 shows a relationship between the distance from the edge of the heater to the fulcrum of the movable member, and the displacement amount of the movable member. On the other hand, in FIG. 19 sectional illustration of the positional relationship between the heater 2 and the movable member 31 as viewed from the side surface direction. The heater 2 of 40×105 $\mu$m was employed. It should be appreciated that the magnitude of displacement becomes greater at greater distance 1 from the edge of the heater 2 to the fulcrum 33 of the movable member 31. Accordingly, depending upon the demanded ink ejection amount, liquid passage structure for the first textile ink and configuration of the heater, an optimal magnitude of displacement is derived to determine the position of the fulcrum of the movable member based thereon.

On the other hand, when the fulcrum of the movable member is located right above the effective bubbling region of the heater, a bubbling stress may be directly exerted on the fulcrum in addition to the stress due to displacement of the movable member to lower durability of the movable member. According to the experiments performed by the inventor, when the fulcrum is provided right above the effective bubbling region, damage was caused in the movable member in the extent of $1\times10^6$ pulses. This confirms lowering of the durability. Accordingly, by arranging the fulcrum of the movable member out of the region right above the effective bubbling region, the durability of the movable member can be improved in the extent adapted to the practical use even when the configuration and material of the movable member do not achieve high durability. It should be appreciated that even when the fulcrum is present right above the effective bubbling region, the movable member may be used satisfactorily by selecting the configuration and material appropriately. In such construction, the liquid ejection head achieving high ejection efficiency and superior durability can be obtained.

<Element Substrate>

Hereinafter, the construction of the element substrate, on which the heater is provided for applying heat to the liquid will be explained.

Figure 20A:
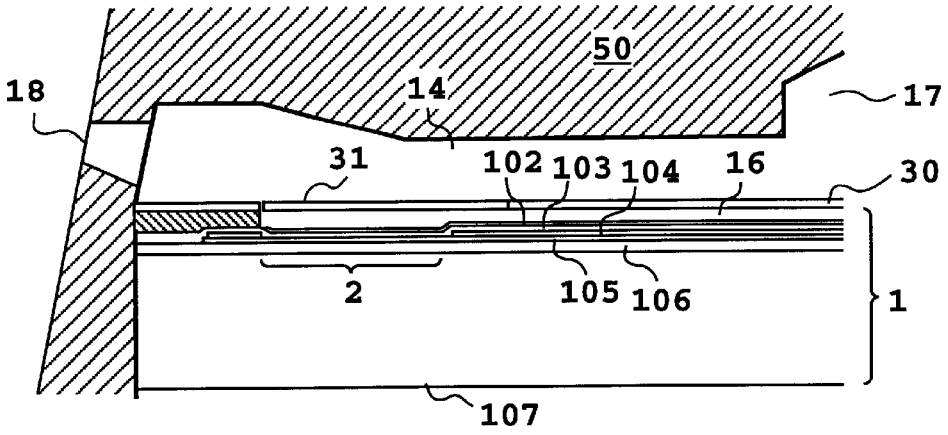
FIGS. 20A and 20B are longitudinal sections of the liquid ejection head applicable to the present invention.
Figure 20B:
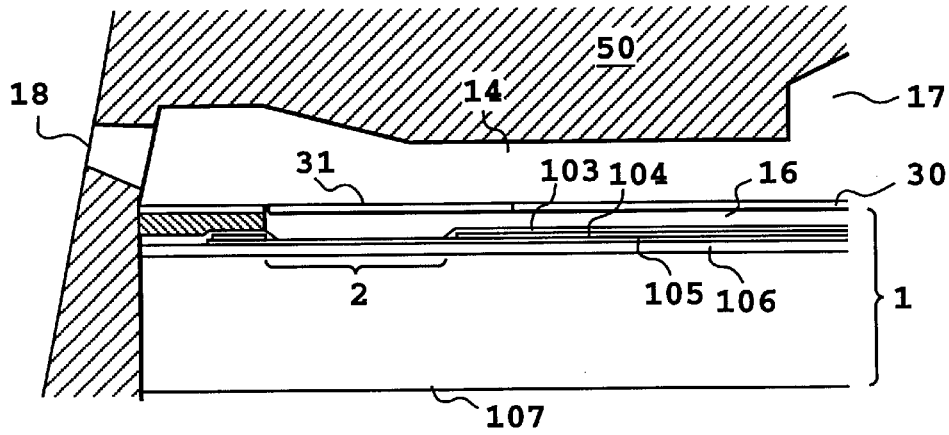

FIGS. 20A and 20B are longitudinal cross-sections of the liquid ejection head, wherein FIG. 20A shows the head with a protective layer set out later, and FIG. 20B is the head having no protective layer.

On the element substrate 1, the second liquid passage 16, the separation wall 30, the first liquid passage 14 and the grooved member 50 formed with the groove for defining the first liquid passage are arranged.

In the element substrate 1, silicon oxide layer or silicon nitride layer 106 for insulation and heat accumulation is deposited on a substrate 107 of silicon or the like. On the silicon oxide layer or silicon nitride layer 106, an electric resistor layer 105 (0.01 to 0.2 $\mu$m thick), such as hafnium diboride ($HfB_2$), tantalum nitride (TaN), tantalum aluminum (TaAl) or the like, and a wiring electrodes 104 (0.2 to 1.0 $\mu$m thick) of aluminum or the like are patterned as shown in FIG. 11. Applying a voltage from the two wiring electrodes to the resistor layer 105 to flow a current to generate a heat. On the resistor layer between the wiring electrodes, a protective layer of 0.1 to 2.0 μm thick is formed with silicon oxide or silicon nitride. Furthermore, over the protective layer, an anti-cavitation layer (0.1 to 0.6 μm thick) of tantalum or the like is deposited for protecting the resistor later 105 from various liquids, such as an ink.

Particularly, the pressure to be generated upon extinction of bubble or impulsive wave is quite strong to significantly lower durability of stiff and brittle oxide layer. Therefore, the metal, such as tantalum (Ta) or the like is used as the anti-cavitation layer.

On the other hand, by combining the liquid, the liquid passage construction, resistor material, it can be established a structure which does not require the protective layer, as shown in FIG. 20B. As a material for the resistor layer which does not require the protective layer, iridium-tantalum-aluminum alloy or the like may be employed.

As set forth above, as the construction of the heater in the foregoing respective examples, it may be only the resistor layer (heating portion), or in the alternative, the protective layer may be formed for protecting the resistor layer.

In this example, the heating portion constructed with the resistor layer which generates a heat in response to the electric signal, is employed as the heater. However, the heater is not specified to the shown construction but can be of any construction as long as sufficient bubble can be generated in the so as to eject. For example, an optical-thermal transducer heated by receiving a light, such as a laser beam or the like or a heating body to be heated in response to a high frequency, may be employed as the heater.

It should be noted that on the foregoing element substrate 1, in addition to the resistor layer 105 forming the heating portion and the electrothermal transducer constructed with the wiring electrodes 104 for supplying the electric signal to the resistor layer, functional device, such as transistors, diodes, latch, shift register and so on are integrally formed through a semiconductor fabrication process.

Figure 21:
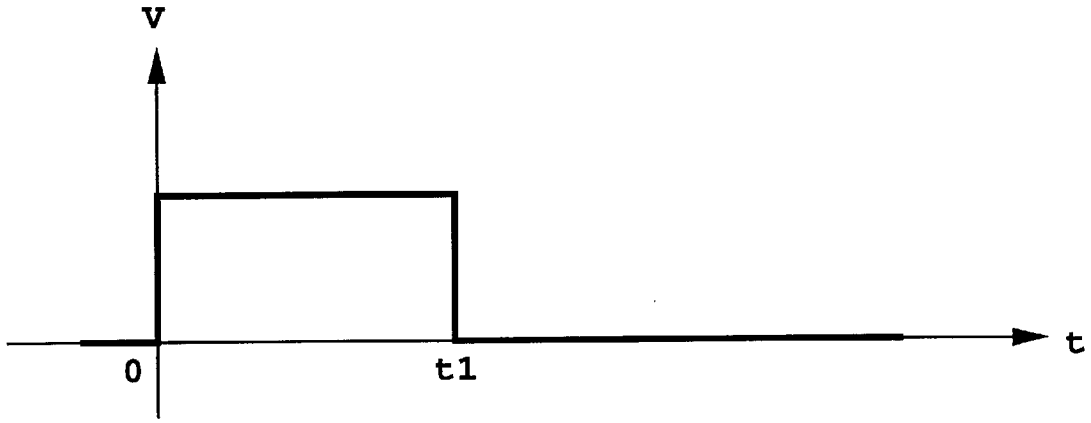
FIG. 21 is a diagrammatic view showing shape of a driving pulse.

On the other hand, in order to drive the heating portion of the electrothermal transducer provided on the element substrate for ejecting the liquid, a rectangular pulse as shown in FIG. 21 is applied to the resistor layer 105 via the wiring electrodes 104 to abruptly heat the resistor layer between the wiring electrodes. In the head of respective of the foregoing head, a voltage 24V, a pulse width 7 msec, a current 150 mA are applied as the electric signal at a frequency of 6 kHz to drive the heater. By the foregoing operation, the liquid is ejection from the ejection ports. However, the condition of the driving signal is not limited to the above, but can be of any driving signal which can appropriately cause bubbling of the bubbling liquid.

<Head Structure with Dual Liquid passage Construction>

Hereinafter, an example of the liquid ejection head which can satisfactorily introduce mutually different liquid in the first and second common liquid chamber to contribute for reduction of number of parts and thus to enable lowering of the cost.

Figure 22:
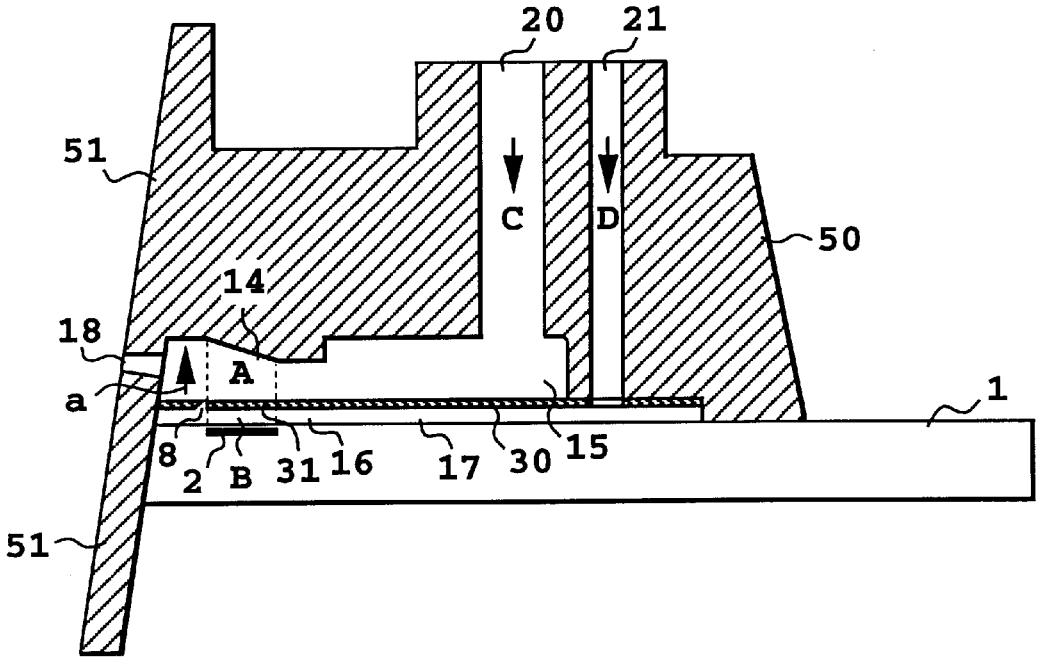
FIG. 22 is a section for explaining a supply passage of the liquid ejection head applicable to the present invention.

FIG. 22 is a diagrammatic view showing a structure of the liquid ejection head. It should be noted that like elements to the former examples will be identified by the same reference numeral and detailed description therefor keep the disclosure simple enough to facilitate clear understanding of the invention.

In this example, the grooved member 50 is generally comprises an orifice plate 51 having the ejection ports, a plurality of grooves 50 forming a plurality of first liquid passages 14, and a cavity forming the first common liquid chamber 15 for supplying the liquid (ejection liquid) to each of the first liquid passage 14.

On the lower portion of the grooved member 50, the separation wall 30 is coupled to define a plurality of the first liquid passage 14 can be formed. Such grooved member 50 has a first liquid supply passage 20 reaching into the first common liquid chamber 15 from the above. Also, the grooved member 50 has the second liquid supply passage 21 extending through the separation wall 30 to reach the second common liquid chamber 17 from the above.

The first liquid (ejection liquid) is supplied to the first common liquid chamber 15 via the first liquid supply passage 20, and then supplied to the first liquid passage 14, as shown by arrow C in FIG. 22. On the other hand, the second liquid (bubbling liquid) is supplied to the second common liquid chamber 17 via the second liquid supply passage 21, and then supplied to the second liquid passage 16 as shown by arrow D in FIG. 22.

In this example, the second liquid supply passage 21 is arranged in parallel to the first liquid supply passage 20. However, the layout of the first and second liquid supply passages 20 and 21 is not specified to the shown arrangement, but any arrangement may be employed as long as communication with the second common liquid chamber 17 extends through the separation wall 30 arranged at the outer side of the first common liquid chamber 15.

On the other hand, the thickness (diameter) of the second liquid supply passage 21 is determined in view of the supply amount of the liquid therethrough. The cross section of the second liquid supply passage 21 is not necessarily circular but can be of any appropriate configuration, such as rectangular or the like.

On the other hand, the second common liquid chamber 17 may be defined by separating the grooved member 50 with the separation wall. As a method of forming, as shown by exploded perspective view shown in FIG. 23, it can be formed by forming the common liquid chamber frame and the second liquid passage wall by a dry film, on the element substrate, and an assembly of the grooved member 50 with the separation wall 30 coupled to the former are bonded to the element substrate 1 to form the second common liquid chamber 17 and the second liquid passage 16.

In this example, on the support body formed with a metal, such as aluminum or the like, the element substrate 1 which is provided with a plurality of electrothermal transducer element as the heater for generating heat for generating the bubble by film boiling in the bubbling liquid.

On the element substrate 1, a plurality of grooves forming the liquid passages 16 defined by the second liquid passage wall, a cavity forming the second common liquid chamber (common bubbling liquid chamber) for supplying bubbling liquid into each bubbling liquid passage, and the above mentioned separation wall provided with the movable member 31 are arranged.

The reference numeral 50 denoted the grooved member. The grooved member includes the groove forming the ejection liquid passage by coupling to separation wall 30, the cavity for forming the first common liquid chamber (common ejection liquid chamber) 15 for supplying the ejection liquid to the ejection liquid passage, the first supply passage (ejection liquid supply passage) 20 for supplying the liquid to the first common liquid chamber, and the second supply passage (bubbling liquid supply passage for supplying the bubbling liquid to the second common liquid chamber 17. The second supply passage 21 is connected to a communication path which is, in turn, communicated with the second common liquid passage 17 through the separation wall 30 located outside of the first common liquid chamber 17. By this communication passage, the ejection liquid can be supplied to the second common liquid chamber 17 without causing admixing with the ejection liquid.

It should be noted that the positional relationship between the element substrate 1, the separation wall 30 and the grooved upper plate 50 is that the movable member 31 is arranged opposing to the to the heater of the element substrate 1. Corresponding to the movable member 31, the ejection liquid passage 14 is arranged. On the other hand, in this example, there is illustrated the example, in which a second supply passage is arranged in one of the grooved member. However, it is possible to provide a plurality of the second liquid supply passage depending upon supply amount of the textile ink. Furthermore, the cross sectional areas of the ejection liquid supply passage 20 and the bubbling liquid supply passage 21 may be determined depending upon supply amount of the ejection liquid and the bubbling liquid.

Thus, by optimization of the cross section area, the parts forming the grooved member 50 and so on can be made more compact.

With the example set forth above, the second supply passage supplying the second liquid to the second liquid passage and the first supply passage supplying the first liquid to the first liquid passage are formed on the common grooved member serving as grooved upper plate. Thus, number of parts becomes smaller to permit shortening of the process to result is lowering of the cost.

On the other hand, the supply of the second liquid to the second common liquid chamber communicated with the second liquid passage is performed by the second liquid passage in a direction extending through the separation wall separating the first and second liquid. This requires bonding process of the separation wall, the grooved member and the substrate formed with the heaters can be done at one time to improve easiness of fabrication and improve bonding accuracy to results in good ejection.

On the other hand, since the second liquid is supplied to the second common liquid chamber through the separation wall, supply of the second liquid to the second liquid passage can be assured to certainly reserve sufficient amount to permit stable ejection.

<Ejecting Liquid and Bubbling Liquid>

As explained with respect to the former example, the present invention is able to perform ejection with higher ejection pressure, higher ejection efficiency and higher speed than the conventional liquid ejection head, with the construction where the movable member is provided. Among the examples, when the same liquid used for the bubbling liquid and the ejecting liquid, various liquids may be employed as long as the liquid may not be degraded by the head applied from the heater, is difficult to cause deposition on the heater by heating, is capable of reversible state variation between vaporized state and the condensed state, and may not cause fatigue the liquid passage, the movable member separation wall or the like.

Amongst such liquid, as the liquid for performing printing (printing liquid), an ink having composition used in the conventionally ink employed in the conventional bubble-jet apparatus.

On the other hand, when the dual flow passage is employed, and the ejection liquid and when the ejection liquid and the bubbling liquid are mutually distinct, any liquid which can satisfy the foregoing condition may be used. In practice, methanol, ethanol, n-propanol, isopropanol, n-hexane, n-heptan, n-octan, toluene, xylene, methylene dichloride, tricrene, freon TF, freon BF, ethyl ether, dioxane, cyclohexane, methyl acetate, ethyl acetate, acetone, methyl ethyl ketone, water and the like, and their mixture can be the material for the bubbling liquid.

As the ejection liquid, various liquids may be employed irrespective of bubbling ability and thermal property. Also, the liquid having low bubbling ability, the liquid which is easily caused alternation or degradation by heat, or high viscous liquid, which have been considered difficult to use, can be used.

However, it is desired that the liquid may not obstruct ejection, bubbling, operation of the movable member or provide any adverse effect for the heat operation, by in nature of the ejection liquid or by reaction with the bubbling liquid.

As the ejection liquid for printing, high viscous ink and the like can be used. As other ejection liquid, a liquid of pharmaceutical preparations, perfume and the like may also be used.

In the present invention, printing was performed employing the ink having the following composition as a printing liquid which can be used both for the ejection liquid and the bubbling liquid. As a result, it has been found that owing to improvement of ejection force, the ink ejection speed became higher to results in improvement of accuracy of hitting of the liquid droplet to quite good printing image could be obtained.

| | |
|---|---|
| (C.I. food black 2) dye | 3 Wt % |
| diethylene glycol | 10 Wt % |
| thiodigylcol | 5 Wt % |
| ethanol | 3 Wt % |
| water | 77 Wt % |

Also, printing was performed by ejection with combining a liquid having the following composition with the bubbling liquid and the ejection liquid. As a result, ejection could be performed for the liquid having viscosity of several ten cp. which has been difficult to eject in the conventional head, and even for the liquid having quite high viscosity of 150 cp. to achieve high quality printing product.

| | | |
|---|---|---|
| Bubbling liquid 1 | ethanol | 40 Wt % |
| | water | 60 Wt % |
| Bubbling liquid 2 | water | 100 Wt % |
| Bubbling liquid 3 | isopropanol alcohol | 10 Wt % |
| | water | 90 Wt % |
| Ejection liquid 1(pigment ink: viscosity about 15 cP) | | |
| carbon black | | 5 Wt % |
| Styrene-acrylic acid-acrylic acid ethyl copolymer 1 Wt % (Acid value: 150, Weight-average molecular weight: 8000) | | |
| monoethanol amine | | 0.25 Wt % |
| glycerin | | 69 Wt % |
| thioglycol | | 5 Wt % |
| ethanol | | 3 Wt % |
| water | | 16.75 Wt % |
| ejection liquid 2(viscosity 55 cP) | | |
| polyethylene glycol 200 | | 100 Wt % |
| ejection liquid 3(viscosity 55 cP) | | |
| polyethylene glycol 600 | | 100 Wt % |

In case of the liquid which has been considered difficult to eject in the prior art, difficulty in obtaining high quality image has been encountered for low ejection speed which promotes fluctuation of the ejecting direction to lower accuracy of the hitting position of the liquid droplet on the printing medium, or for fluctuation of ejection amount due to instability of ejection. However, in the foregoing example, satisfactory bubbling can be obtained by using the bubbling liquid with high stability. This results in improvement of accuracy of the hitting position of the liquid drop and stabilization of ink ejection amount to enable significant improvement of the printing image quality.

<Fabrication of Liquid Ejection Head>

In case of the liquid ejection head shown in FIG. 2, the head is formed by patterning the base 34 for providing the movable members 31 on the element substrate 1 with a dry film or the like, bonding or welding the movable members 31 on the base 34, and subsequently, fitting the grooved member having a plurality of grooves forming respective liquid passages 10, the ejecting ports 18, and cavities forming the ejection ports and common liquid chamber 15, on the element substrate with aligning respective grooves and movable members.

Figure 23:
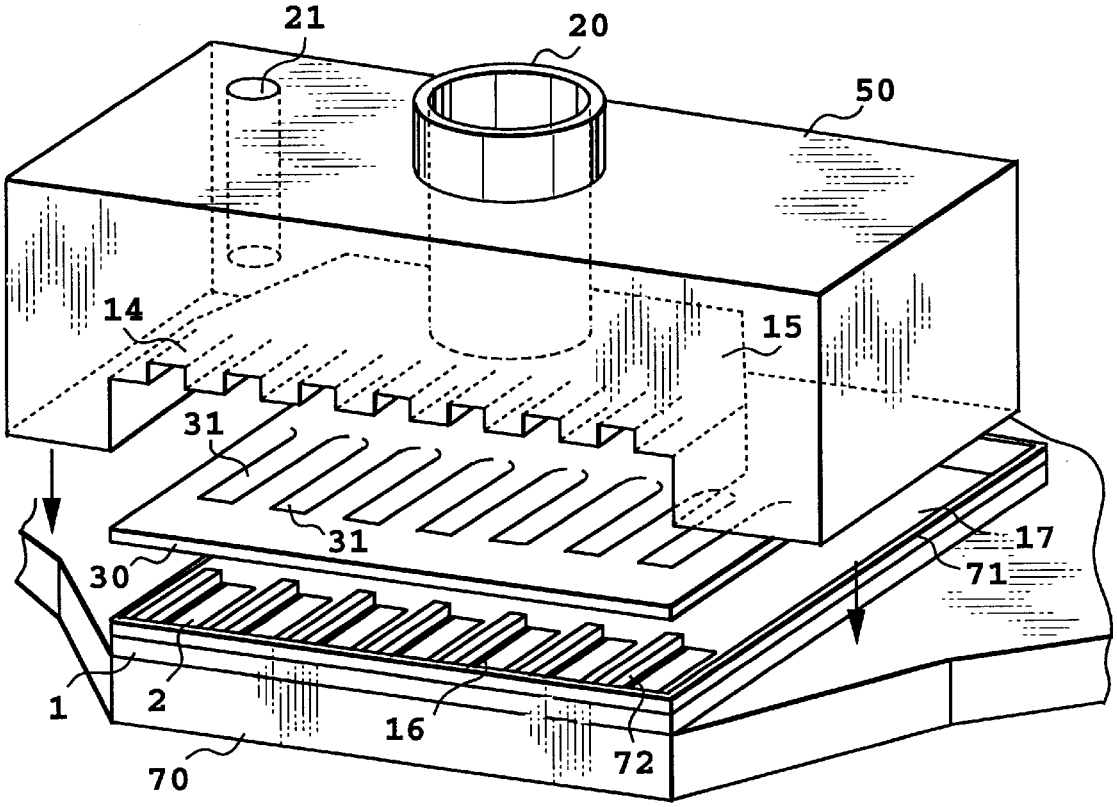
FIG. 23 is an exploded perspective view of the head applicable to the present invention.

Next, fabrication process of the liquid ejection head having dual liquid passage structure as shown in FIGS. 10 and 23 will be described.

In general, the wall for the second liquid passage 16 is formed on the element substrate 1. The separation wall 30 is mounted thereon. The grooved member 50 having the grooves for defining the first liquid passages 14 is mounted thereon. In the alternative, after forming the wall of the second liquid passage 16, the grooved member 50 mounted thereon the separation wall 30, is mated to fabricate the head.

The fabrication process of the second liquid passage will be explained in greater detail.

FIGS. 24A to 24E are general sectional views for explaining the first example of the liquid ejection head fabrication process according to the present invention.

Figure 24A:
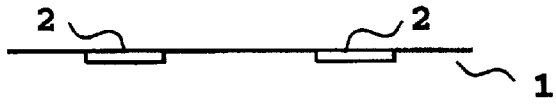
FIGS. 24A to 24E are sections of process steps for explaining a fabrication process of the liquid ejection head applicable to the present invention.

In this example, as shown in FIG. 24A, on the element substrate (silicon wafer), electrothermal transducer element having the heater 2 was formed with hafnium diboride or tantalum nitride and so on employing a fabrication apparatus similar to that employed in a semiconductor fabrication process. Thereafter, in the next step, for the purpose of improvement adhesion ability with a photosensitive resin, the surface of the element substrate 1 was washed. For further higher adhesion ability can be attained by performing property modification of the surface by ultraviolet-ozone treatment for the surface of the element substrate, and by spin coating a solution, in which a silane coupling agent (Nihon Unica Co.: Al89), for example, is diluted by ethyl alcohol into 1 Wt %, on the surface of modified property.

Figure 24B:
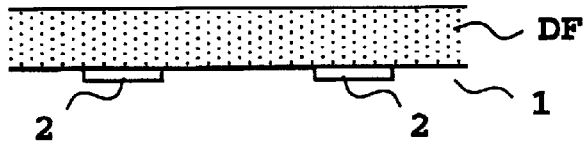

Next, on the surface of the substrate 1, which was washed for improving adhesion ability, an ultraviolet sensitive resin film (Tokyo Ohka Co., LTD.: dry film Ordyl SY-318) DF was laminated as shown in FIG. 24B.

Figure 24C:
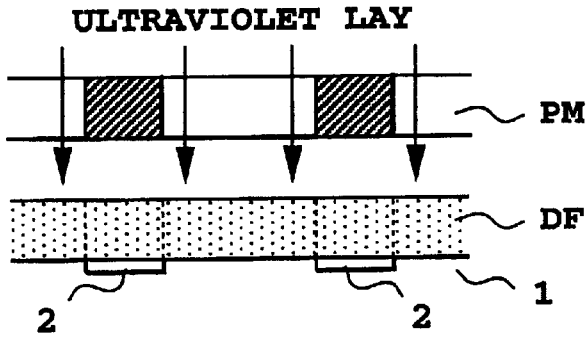

Next, as shown in FIG. 24C, arranging a photo-mask PM on the dry film DF, an ultraviolet ray was irradiated for the portion of the dry film DF to be maintained at the wall for the second liquid passage through the photo-mask PM. This exposure step was performed employing Canon Inc.: MPA-600 with an exposure amount about 600 mJ/cm$^2$.

Figure 24D:
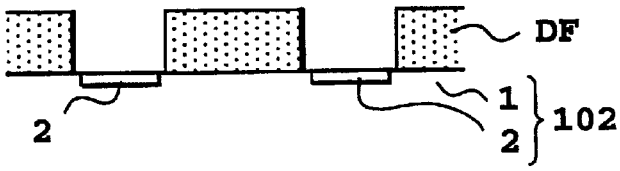
Figure 24E:
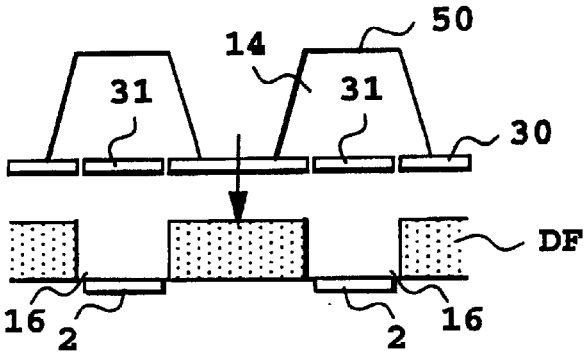

Next, as shown in FIG. 24D, the dry film DF was developed by a developing solution (Tokyo Ohka Co.: BMRC-3) consisted of a mixture of xylene, butyl cellosolve acetate for dissolving the non-exposed portion with leaving the portion hardened by exposure to form the wall portion of the second liquid passage. Also, a slag left on the surface of the element substrate was removed by treatment for about 90 seconds by an oxygen plasma ashing apparatus (Alkantec Co.: MA-800). Subsequently, further irradiation of ultraviolet way at 100 mJ/cm$^2$ was performed under 150° C. for 2 hours to completely harden the exposed portion.

Through the foregoing process, for a plurality of heater board (element substrate) divided and fabrication from the silicon substrate, the second liquid passage can be formed uniformly with high precision. The silicon substrate is cut into each individual heater board 1 by means of a dicing machine (Tokyo Seimitsu Co.: AWD-4000) mounted thereon a 0.05 mm thick diamond blade. The divided heater board 1 is fixed on an aluminum base plate 70 by a bond (Toray Industries, Inc.: SE4400) (see FIG. 27). Then, the heater board 1 is connected with a printed circuit board preliminarily fitted on the aluminum base plate 70, via an aluminum wire of 0.05 mm diameter.

On the heater board 1 thus obtained, as shown a sub-assembly of the grooved member 50 and the separation wall 30 is positioned and fixed in the manner set forth above. Namely, with positioning the grooved member 50 having the separation wall 30 and the heater board 1 relative to each other, the assembly is fixed by engagement of a set spring 78. Then, ink and bubbling liquid supply member 80 is mated and fixed on the aluminum base plate 70. Thereafter, gap defined between the aluminum wires, gaps defined between the grooved member 50, the heater board 1 and the ink/bubbling liquid supply member 80 were sealed by a silicon sealant (Toshiba Silicon Co. Ltd.: TSE399).

By forming the second liquid passage through the process set forth above, high precision liquid passage can be obtained without any position error relative to the heater of each heater board. Particularly, by preliminary mating the grooved member 50 and the separated wall 30 in the preceding step, the high precision of position of the first liquid passages 14 and the movable member 31 can be achieved.

With these high precision fabrication technologies, ejection can be stabilized to improve printing quality. Furthermore, since all elements can be formed on the wafer, the head can be mass-produced at low cost.

It should be noted that while the ultraviolet curing type dry film is employed for forming the second liquid passage in this example, it is also possible to employ a resin having an absorption band in an ultraviolet band, particularly in a range close to 248 nm, to cure the same after lamination and then to remove resin at the portion to be the second liquid passage by an excimer laser.

Figure 25A:
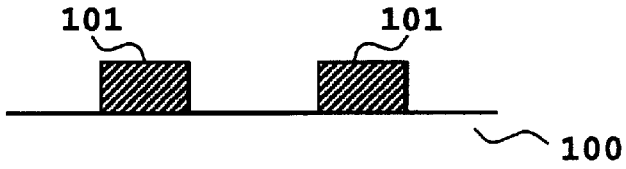
FIGS. 25A to 25D are sections of process steps for explaining a fabrication process of the liquid ejection head applicable to the present invention.

FIGS. 25A to 25D are general sections for explaining the second example of the liquid ejection head according to the ejection mechanism, In this example, as shown in FIG. 25A, on a SUS substrate 100, a resist 101 of a thickness of 15 $\mu$m is patterned in the shape of the second liquid passage.

Figure 25B:
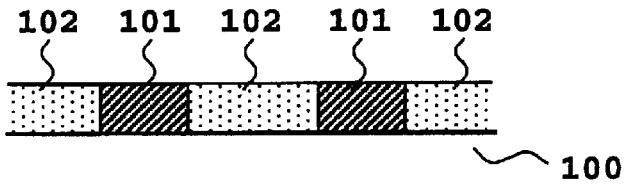

Next, as shown in FIG. 25B, electroplating is performed for the SUS substrate to form a nickel layer 102 of the thickness of 15 $\mu$m thereon. As a plating liquid, a liquid added a stress reduction agent (World Metal Co.: Zero All), boric acid, a pit preventing agent (World Metal Co.: NP-ASP) and nickel chloride to nickel sulfamate may be used. As a manner of application of electric field upon electrode position, an electrode is connected at an anode side and already patterned SUS substrate 100 is connected at cathode side, an electric current having current density of 5 A/cm$^2$ is applied at a temperature of plating liquid of 50° C.

Figure 25C:
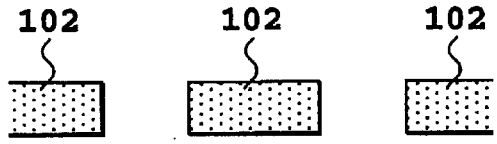

Next, as shown in FIG. 25C, ultrasonic vibration is applied to the SUS substrate 100 completed the plating process as set forth above to peel off a part of the nickel layer 102 from the SUS substrate 100 to obtain the designed configuration of second liquid passage.

Figure 25D:
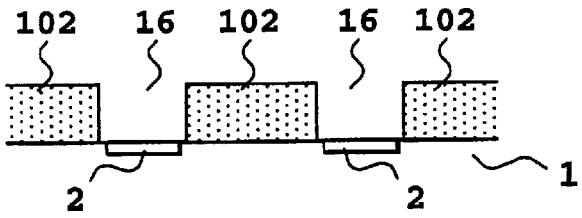

On the other hand, the heater board arranged the electrothermal transducer is formed on the silicon wafer using the fabrication device similar to that for the semiconductor fabrication apparatus. This wafer is cut into each individual heater board by the dicing machine as mentioned example. The heater board 1 is then fitted on the aluminum base plate 70, on which the printing circuit board 104 is preliminarily mounted. Then, electric wiring is formed by connecting the printed circuit board and the aluminum wire (not shown). On the heater board in this condition, as shown in FIG. 25D, the second liquid passage obtained in the former process is positioned and fixed. At this time, "fixing" is merely required to prevent position error upon fitting of the upper plate for engaging and tightly fitting the upper plate fixed therewith the separation wall by the set spring similarly to the first example.

In this example, for fixing, an ultraviolet curing type bond (Grace Japan CO.: Amicon UV-300) is applied. Then, employing an ultraviolet ray irradiation device, ultraviolet ray is irradiated in exposure amount of 100 mJ/cm$^2$ for about 3 seconds for fixing.

With the example of the fabrication process set forth above, in addition to capability of obtaining high precision second liquid passage with no position error relative to the heater, since the liquid passage is formed by nickel, the liquid ejection head achieving high reliability with high resistance against alkaline can be provided.

FIGS. 26A to 26D are sectional views for generally explaining the third example of the liquid ejection head fabrication process according to the liquid ejection principal.

Figure 26A:
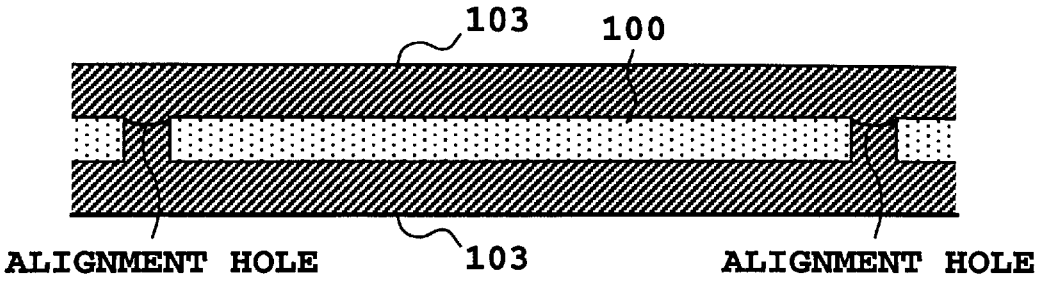
FIGS. 26A to 26D are sections of process steps for explaining a fabrication process of the liquid ejection head applicable to the present invention.

In this example, as shown in FIG. 26A, on both surfaces of the SUS substrate 100 of 15 $\mu$m thick having alignment holes or marking 100*a*, a resist 31 is applied. Here, as the resist, PWERR-AR900 available from Tokyo Ohka Co. is used.

Figure 26B:
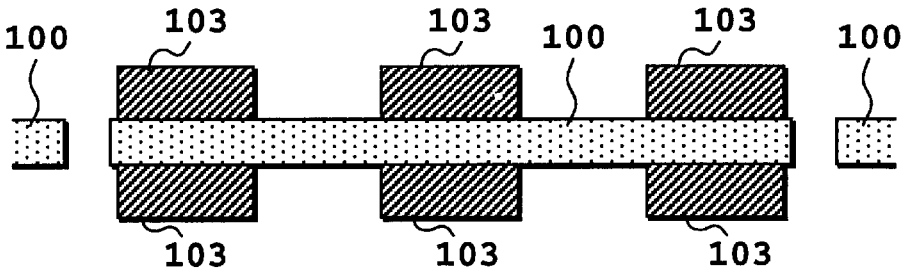

Thereafter, as shown in FIG. 26B, aligning with alignment hole 100*a* of the element substrate 100, exposure was effected by the exposure device (Canon Inc.: MPA-600), then, the resist 103 at the position to form the second liquid passage is removed. The exposure was performed at the exposure amount of 800 mJ/cm$^2$.

Figure 26C:
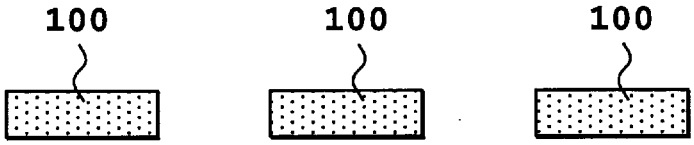

As shown in FIG. 26C, the SUS substrate patterned the resist 103 on both surfaces was dipped in an etching liquid (aqueous solution of ferric chloride or cupric chloride) to etch out the portion exposed through the resist 103. Then, the resist is removed.

Figure 26D:
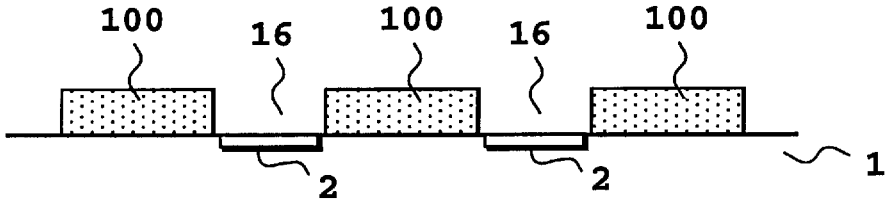

Next, as shown in FIG. 26D, similarly to the former example of the fabrication process, etched SUS substrate was positioned and fixed on the heater board 1 to form the liquid ejection head having the second liquid passage can be assembled.

With the fabrication process of the example, in addition to the fact that the second liquid passage having high precision with no position error relative to the heater can be obtained, since the liquid passage is formed with SUS, the liquid ejection head holding high reliability with high resistance against alkali and acid.

As set forth above, with the example of the fabrication process, by preliminarily arranging the wall of the second liquid passage on the element substrate, it becomes possible to position the electrothermal transducer and the second liquid passage at high precision. Also, for a large number of element substrate before cutting and separating, the second liquid passages can be formed simultaneously large amount of the liquid ejection heads can be provided at low cost.

On the other hand, in the liquid ejection head obtained by implementation of the shown example of the fabrication process of the liquid ejection head, since the heater and the second liquid passage are position at high precision, to efficiently receive the pressure of bubbling by heating of the electrothermal transducer to attain superior ejection efficiency.

<Liquid ejection head Cartage>

Next, a liquid ejection head cartridge mounting the present examples of the liquid ejection head will be explained generally.

Figure 27:
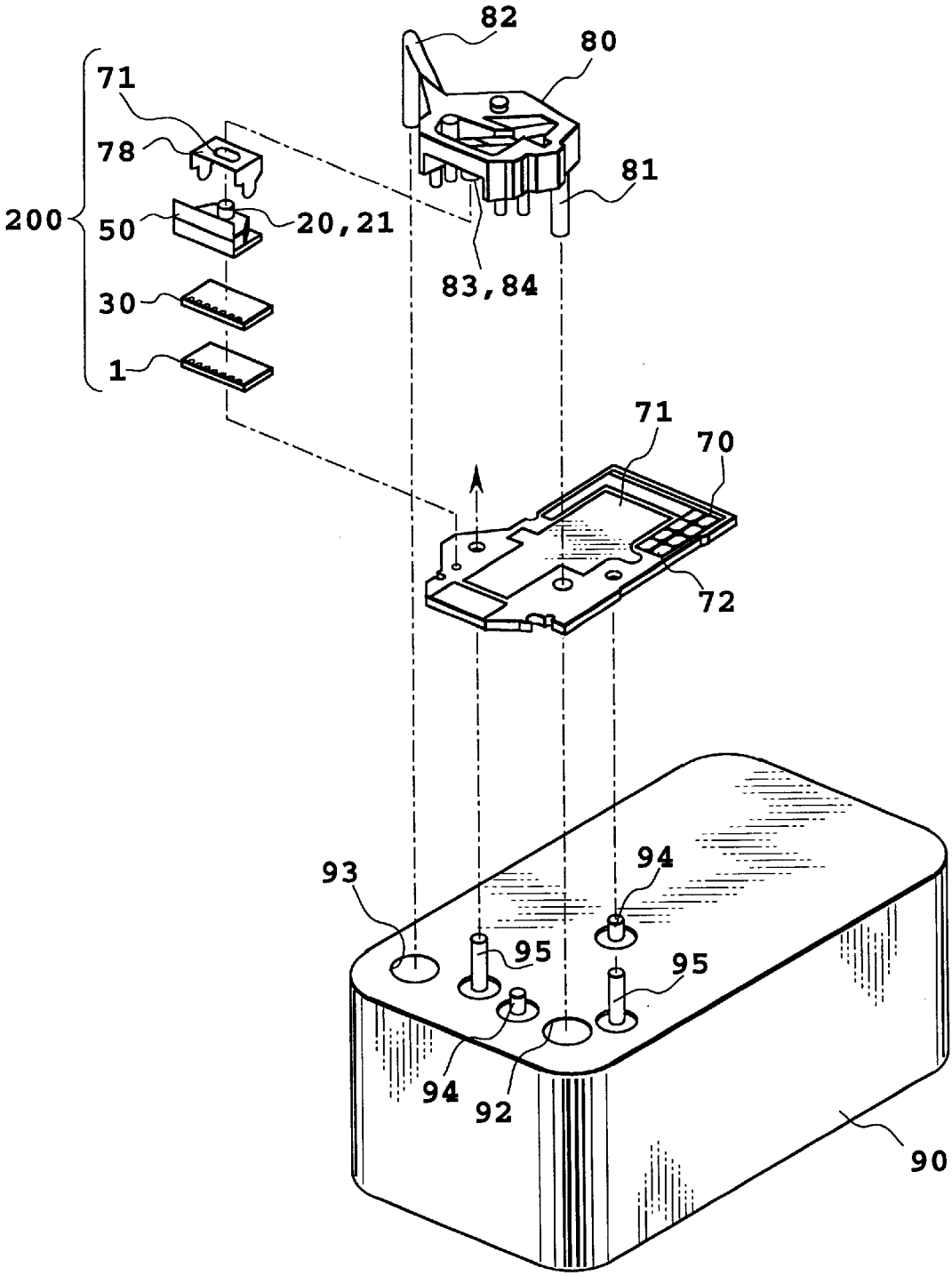
FIG. 27 is an exploded perspective view of a liquid ejection head cartridge.

FIG. 27 is a diagrammatic exploded perspective view of the liquid ejection head cartridge including the liquid ejection head. The liquid ejection head cartridge is generated constructed with a liquid ejection head portion 200 and a liquid container 80.

The liquid ejection head portion 200 is constructed with the element substrate 1, the separation wall 30, the grooved member 50, the holding spring 78, the liquid supply member 90, a support body 70 and so on. On the element substrate 1, a plurality of heating resistors for applying a heat on the bubbling liquid as set forth above are provided in a form of array. Also, a plurality of functional element for selectively driving the heating resistors are provided. Between the element substrate 1 and the separation wall having the movable wall, the bubbling liquid passage is formed for flow of the bubbling liquid. By mating the separation wall 30 with the grooved upper plate 50, the ejection liquid passage (not shown) for flowing the ejection liquid can be formed.

The holding spring 78 is a member for applying an actuation force in the direction toward the element substrate. By this biasing force, the element substrate 1, the separation wall 30 and the groove member 50 can be integrated with the support body 70 discussed later.

The support body 70 is adapted to support the element substrate 1 or so on. On the support body 70, the printing circuit board 71 connected to the element substrate 1 and supplying the electric circuit to the former, and a contact pad 72 for performing exchange the electric signal with the apparatus.

The liquid container 90 separately stores the in the ejection liquid, such as the ink or the like, and the bubbling liquid for generating bubble for generating bubble. On the outside of the liquid container 90, a positioning portion 94 for arranging the connecting member for connection between the liquid ejection head and the liquid container and a fixing shaft for fixing the connecting portion are provided. Supply of the ejection liquid is performed from a liquid supply passage 92 of the liquid container to the ejection liquid supply passage 81 of the liquid supply member 80 via the supply passage 84 of the connecting member, and then supplied to the first common liquid chamber via the ejection liquid supply passages 83, 71 and 21 of respective members. Similarly, the bubbling liquid is supplied from the supply passage 93 of the liquid container to the bubbling liquid supply passage 82 of the liquid supply member 80 via the supply passage of the connecting member, and then supplied to the second liquid chamber via the bubbling liquid supply passages 84, 71 and 22.

The liquid ejection head cartridge as set forth above, is described in terms of the supply type and liquid contained to be able to perform supply even when the bubbling liquid and the ejecting liquid are mutually different liquid. However, when the bubbling liquid and the ejection liquid are the same, it becomes unnecessary to separate the supply passages for the bubbling liquid and the ejection liquid and the container.

It should be noted that the liquid container may be used by re-filling the liquids after consuming out respective liquids. Therefore, it is desirable to provide a liquid inlet for the liquid container. On the other hand, the liquid ejection head and the liquid container may be integral, or in the alternative, separable.

<Liquid Ejecting Apparatus>

Figure 28:
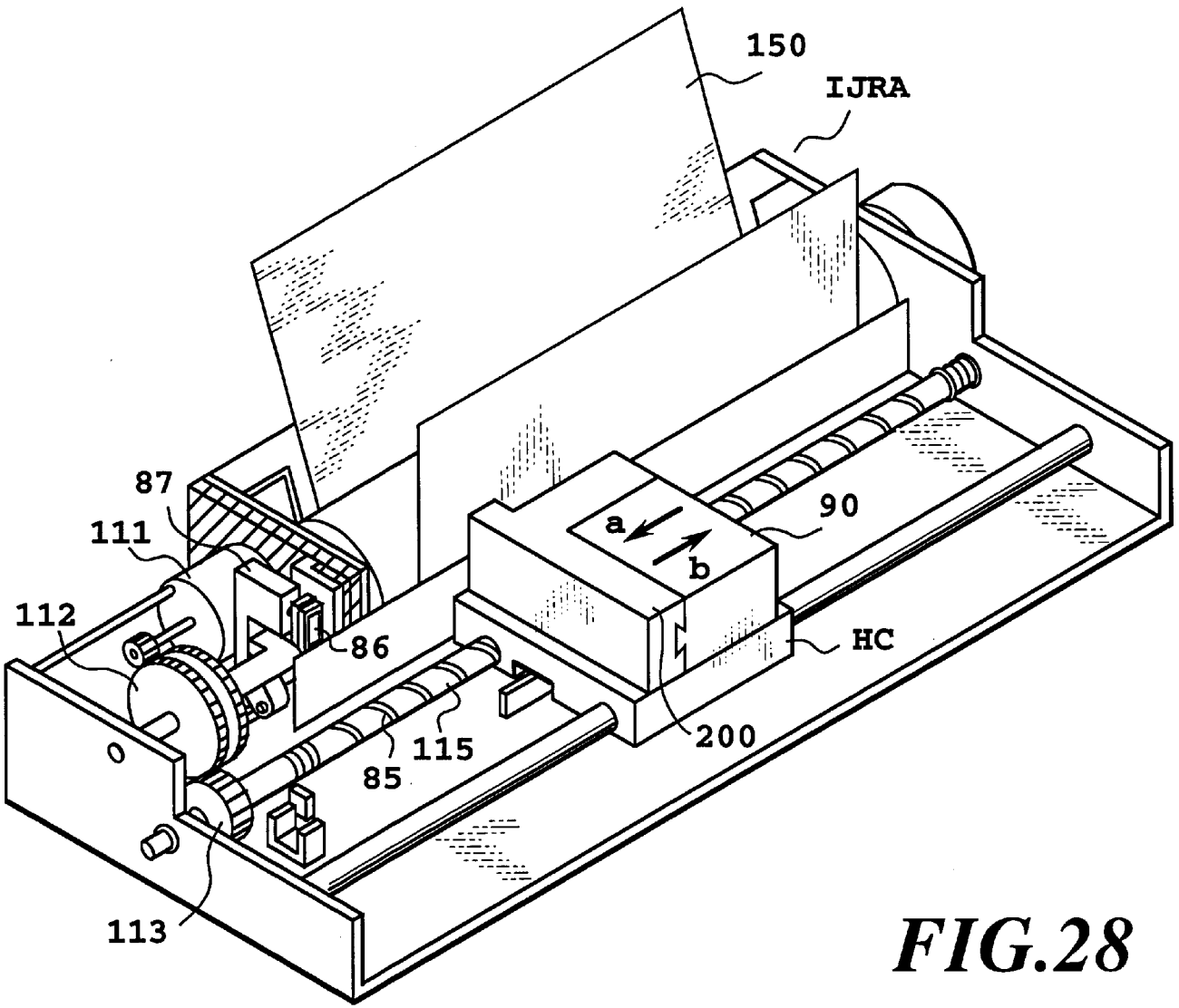
FIG. 28 is a perspective view generally showing construction of a liquid ejection apparatus.

FIG. 28 generally shows a liquid ejecting apparatus mounting the foregoing liquid ejection head. In this example, explanation will be given particularly for an ink ejecting printing apparatus employing the ink as the ejection liquid. A carriage HC of the liquid ejecting apparatus mounts a head cartridge, in which are detachably mounted a liquid ink tank 90 storing the ink, and the liquid ejection head portion 200.

When a drive signal is supplied from a not shown drive signal supply means to the liquid ejecting means on the carriage, the printing liquid is ejected from the liquid ejection head toward the printing medium depending upon the drive signal. In FIG. 28, a numeral 86 denotes a capping member for capping a front face of the liquid ejection head, and a numeral 87 denotes a suction means for sucking the internal of the capping member. The liquid ejection head can be subjected to the recovery of suction to prevent it from ejection failure.

On the other hand, in this example of the liquid ejecting apparatus, there are provided a motor as a driving source for driving the printing medium feeding means and the carriage, gears 112 and 113 for transmitting the driving force of the driving source to the carriage, a carriage shaft and so on. By this printing apparatus and the liquid ejecting method to be implemented by the printing apparatus, good image printing product can be obtained by ejecting the liquid toward various printing mediums. When the liquid ejection method is performed at a long period, or it is not performed at a long period, the ejection ports of the liquid ejection head may be clogged up by virtue of high viscous liquid and dust. Before clogging up, the recovery of suction is performed at a predetermined timing. This recovery of suction serves to prevent two liquids from admixing or to instantly remove the admixing of the two liquids when the liquid ejection head utilizes as liquids such an ejection liquid and a bubbling liquid, even if the liquid ejection method is not performed at a long period.

The recovery of suction is performed by the steps of moving the liquid ejection head mounted on the carriage HC in the direction of arrow a shown in FIG. 28 toward a home position H, and capping a face including ejection ports of the liquid ejection head with a cap 84 of a recovery suction apparatus.

DETAILED DESCRIPTION OF PREFERRED EMBODIMENTS

First Embodiment

<Liquid Ejecting Apparatus>

FIG. 28 generally shows a liquid ejecting apparatus mounting the foregoing liquid ejection head. In the present embodiment, explanation will be given particularly for an ink ejecting printing apparatus employing the ink as the ejection liquid. A carriage HC of the liquid ejecting apparatus mounts a head cartridge, in which are detachably mounted a liquid ink tank 90 storing the ink, and the liquid ejection head portion 200.

When a drive signal is supplied from a not shown drive signal supply means to the liquid ejecting means on the carriage, the printing liquid is ejected from the liquid ejection head toward the printing medium depending upon the drive signal. In FIG. 28, a numeral 86 denotes a capping member for capping a front face of the liquid ejection head, and a numeral 87 denotes a suction means for sucking the internal of the capping member. The liquid ejection head can be subjected to the recovery of suction to prevent it from ejection failure.

On the other hand, in the present embodiment of the liquid ejecting apparatus, there are provided a motor as a driving source for driving the printing medium feeding means and the carriage, gears 112 and 113 for transmitting the driving force of the driving source to the carriage, a carriage shaft and so on. By this printing apparatus and the liquid ejecting method to be implemented by the printing apparatus, good image printing product can be obtained by ejecting the liquid toward various printing mediums. When the liquid ejection method is performed at a long period, or it is not performed at a long period, the ejection ports of the liquid ejection head may be clogged up by virtue of high viscous liquid and dust. Before clogging up, the recovery of suction is performed at a predetermined timing. This recovery of suction serves to prevent two liquids from admixing or to instantly remove the admixing of the two liquids when the liquid ejection head utilizes as liquids such an ejection liquid and a bubbling liquid, even if the liquid ejection method is not performed at a long period.

The recovery of suction is performed by the steps of moving the liquid ejection head mounted on the carriage HC in the direction of arrow a shown in FIG. 28 toward a home position H, and capping a face including ejection ports of the liquid ejection head with a cap 84 of a recovery suction apparatus.

Second Embodiment

Figure 29:
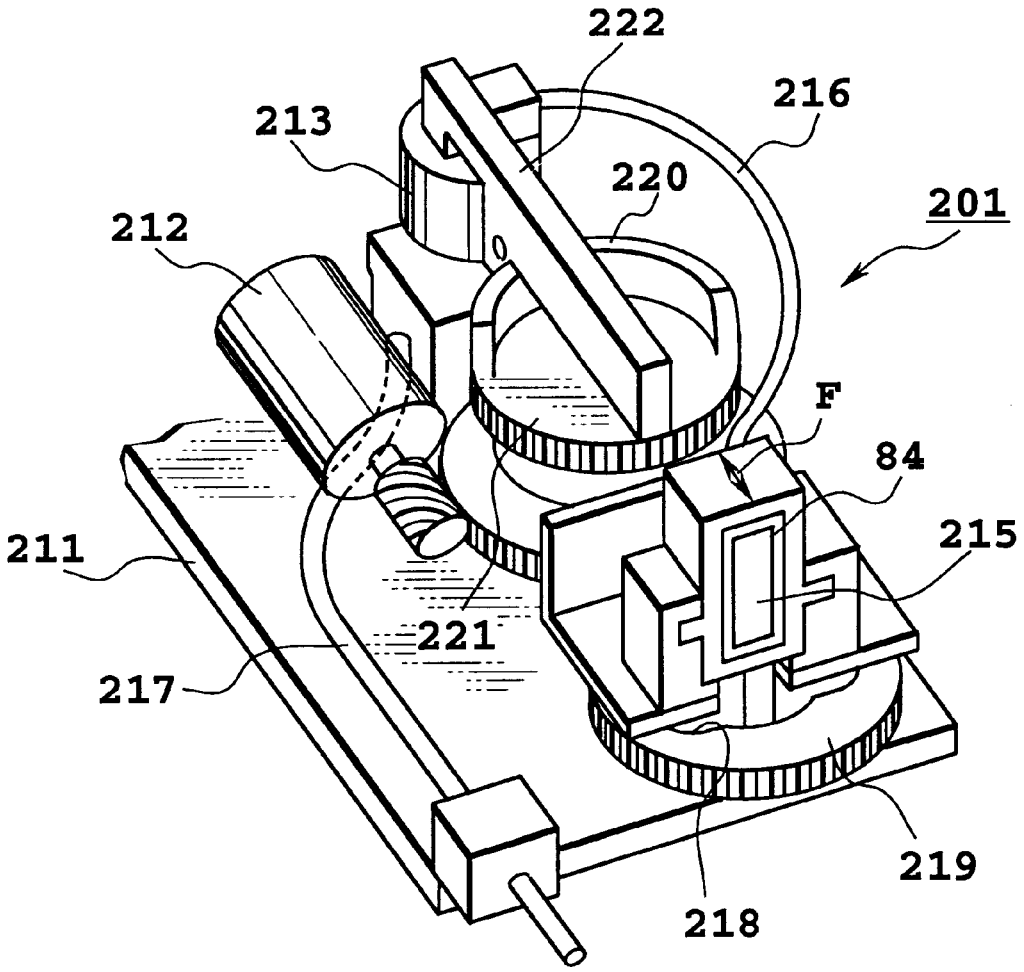
FIG. 29 is a perspective view generally showing one example of a suction recovery apparatus which can be installed on the liquid ejection apparatus shown in FIG. 28.

FIG. 29 is a perspective view generally showing one example of a suction recovery apparatus which can be installed on the liquid ejection apparatus shown in FIG. 28.

In FIG. 29, a numeral 201 denotes a suction recovery apparatus. A suction pump 213 generating a suction force and a motor 212 as driving power source for the suction pump 213 are mounted on a frame 211. On the frame 211, a cap 84 is supported and guided for forward and backward movement (direction of arrow F in FIG. 29). When the cap 84 is forwarded, it is pressed or tightly contacted onto the liquid ejection head in air-tight condition. On the front face of the cap 84 tightly contacting with the head, a porous body 215 for absorbing ink is arranged.

The interior of the cap 84 is connected with the suction pump 213 through a suction tube 216. A discharge side of the suction pump has a waste ink tube 217 for discharging the sucked ink. A cap driving gear 219 having an internal cam 218 for driving the cap 84 in the forward and backward direction (direction of arrow F of FIG. 29) and a pump driving gear 221 having an end cam 220 for driving the suction pump 213 are rotatably supported on the frame 211. These gears 219 and 221 are driven by a motor 212 via a gear train. Between the pump driving gear 221 and the suction pump 213, a lever 222 is pivotally disposed. When the pump driving gear 221 is rotated, the end cam 220 pivotally drives the lever. By the action of the lever 222, the suction pump 213 is driven.

The overall suction recovery apparatus constructed as set forth above may also be moved toward and away from the liquid ejection head.

Thus, the recovery operation by suction of ink is performed while the cap 84 is tightly contacted with the liquid ejection head returned to a home position predetermined in the liquid ejection apparatus, by driving the suction pump 213 to suck the ink through the ejection port 18 from the ink supply system by the suction force of the suction pump 213.

In the foregoing liquid ejection head, as shown in FIG. 10, the liquid passage 14 for the ejection liquid and the liquid passage 16 for the bubbling liquid are separated by the separation wall 30. By displacing the movable member 31 formed at the separation wall 30 toward the first liquid passage 14, the bubbling liquid is introduced into the first liquid passage 14 and the ejection liquid is mainly discharged through the ejection port 18 which is communicated with the first liquid passage 14.

Recovery of the ejection force of the head by discharging of the liquid from the liquid ejection head according to the present invention has following two functions, in general. The first effect is that when the first and second liquid passages are recovered by suction and/or pressurizing for discharging the liquid from the respective liquid passages, the pressurizing force and/or suction force for the liquid passage having higher flow resistance is to be set greater than the pressurizing force and/or the suction force of the other liquid passage, the liquid to be discharged for recovery can be certainly and sufficiently removed from respective liquid passage. The second effect is that, in the head using the ejection liquid and the bubbling liquid, even after a substantially long period, admixing of two liquids can be effectively prevented or instantly eliminated by discharging the liquids.

The following third to eleventh embodiments are embodiments of the ejection force recovery method and the ejection head suitable for the method. In the embodiments, the effects of the present invention are equally obtained as described above. Therefore, in each individual embodiment, these effects will not be repeatedly mentioned.

The ejection force recovery method according to the present invention is to externally discharge the liquid in respective liquid passages. One of examples of the recovery method is performed by discharging only through the ejection ports. The other example of the recovery method is performed by using the head having a recovery route and a recovery port on the front side of the second liquid passage accommodating a bubbling liquid, discharging the ejection liquid through the ejection port and discharging the bubbling liquid through the recovery port. In the following embodiments, the cases where the liquid is discharged only from the ejection port are the third to seventh embodiments, and the cases where the ejection liquid is discharged from the ejection port and the bubbling liquid is discharge from the recovery port are the eighth to eleventh embodiments.

The feature of the ejection force recovery method according to the present invention is that when the first and second liquid passages are recovered by sucking and/or pressurizing the internal of the respective liquid passages, the suction force and/or pressurizing force of the liquid passage having higher flow resistance is set to be greater than the suction force and/or pressurizing force for the other liquid passage having lower flow resistance. A measuring method of the flow resistance of the respective liquid passages of the head having only the ejection port will be explained before the explanation of the following embodiments.

Figure 30:
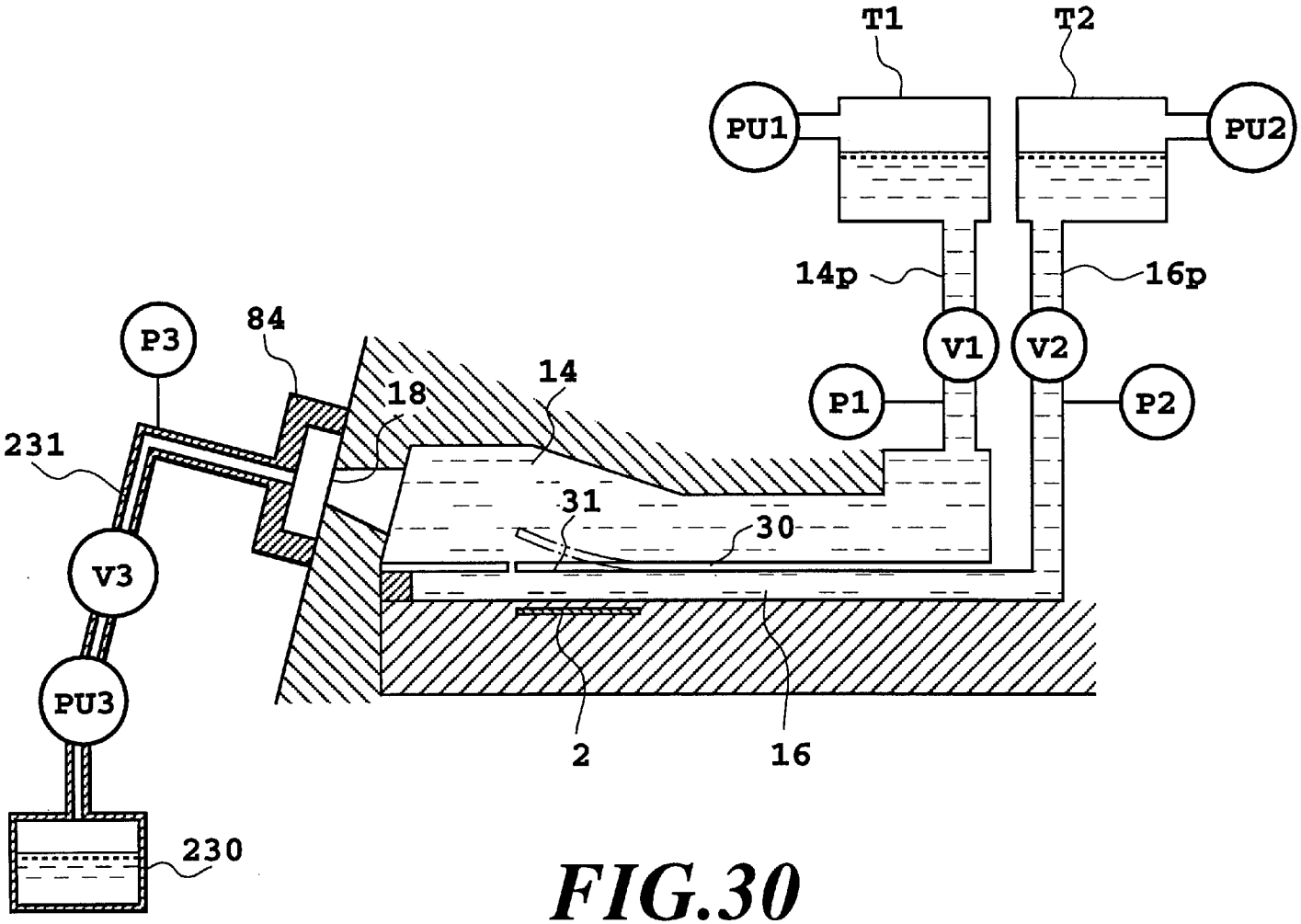
FIG. 30 is a diagrammatic view showing one example of the liquid ejection head applicable to the recovery method using only ejection port.

FIG. 30 is a diagrammatic view showing one example of the liquid ejection head applicable to the recovery method using only ejection port. In FIG. 30, the like elements to those in the foregoing head will be identified by like reference numerals for simplification of disclosure.

In FIG. 30, $T_1$ denotes a first tank supplying the ejection liquid to the first liquid passage 14, $T_2$ denotes a second tank for supplying the bubbling liquid to the second liquid passage 16. The first tank $T_1$ has a pump $PU_1$ for pressurizing the ejection liquid, and the second tank $T_2$ has a pump $PU_2$ for pressurizing the bubbling liquid. Supply passage 14*p* supplying liquid from the tank $T_1$ to the first liquid passage 14 has a first valve $V_1$. Supply passage 16*p* supplying liquid from the tank $T_2$ to the second liquid passage 14 has a second valve $V_2$. A pressure gauges P1 and P2 for measuring pressure of respective of the liquid passages 14 and 16 are mounted on respective of the downstream sides of the supply passages 14*p* and 16*p*.

In FIG. 30, a numeral 230 denotes a waste liquid tank, which is connected to a terminal end of a discharge pipe 231 connected to the cap 84. At the intermediate position of the discharge pipe 231, a third valve $V_3$ is mounted, and on the upstream, a pressure gauge P3 is provided. On the downstream of the third valve $V_3$, a suction pump $PU_3$ is mounted.

In the head having the construction as set forth above, definition and measurement method the flow resistance of the respective liquid passages 14 and 16 will be explained hereinafter.

(Method of Measurement of Resistance in Liquid Passage)

(1) Open the valve $V_1$ and close the valve $V_2$;

(2) Suction or pressurization by the pump $PU_3$ or the pump $PU_1$ in the first liquid passage 14;

(3) At this time, measured values of the pressure gauge P1 and the pressure gauge P3 (for convenience, measured values are indicated by the same signs $P_1$ and $P_3$) are obtained and then, a difference (pressure loss) $\Delta p$ ($=P_1-P_3$) is measured; and (4) The pressure loss symbol $\Delta p$ corresponds to the flow resistance of the first liquid passage 14.

Next, in order to measure the resistance of the second liquid passage 16, (1) Open the valve $V_2$ and close the valve $V_1$;

(2) Suction or pressurization by the pump $PU_3$ or the pump PU2 in the second liquid passage 16;

(3) The measured value $P_2$ of the pressure gauge P2 and the measured value $P_3$ of the pressure gauge P3 at this time is derived and a difference (pressure loss) $\Delta p=$ (P2−P3) is calculated; and (4) This pressure loss $\Delta P$ corresponds to the flow resistance of the second liquid passage 16.

Third Embodiment

Figure 31:
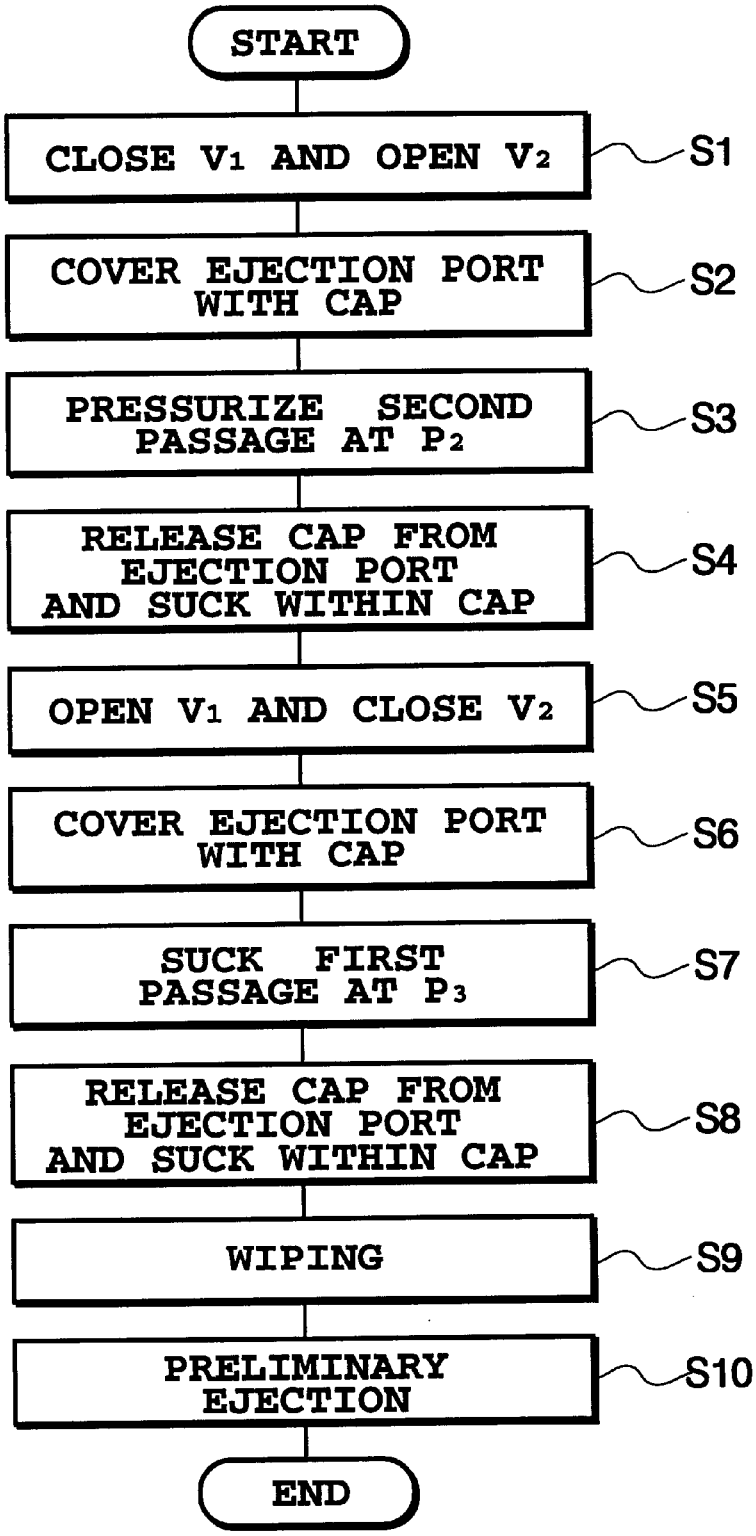
FIG. 31 is a flowchart showing one example of an ejection force recovery method implemented by the ejection head of the construction shown in FIG. 30.

FIG. 31 is a flowchart showing one example of an ejection force recovery method implemented by the ejection head of the construction shown in FIG. 30.

The valve V1 is closed and the valve V2 is opened (step S1). Next, the ejection port 18 is covered with the suction cap 84 (step S2). In such condition, the liquid in the second liquid passage 16 is pressurized at a pressurization force P2 by the pump PU2 to displace the movable member 31 toward the first liquid passage 14 to eject the liquid through the ejection port 18 via the front end portion of the first liquid passage 14 (step S3). At this time, the suction pump PU3 is not operated. Next, the cap 84 is released from the ejection port 18 to open the valve V3. The liquid discharged from the second liquid passage 16 in the cap 84 is sucked by the suction pump PU3 to take into the waste liquid tank 230 (step S4). Next, the valve V1 is opened and the valve V2 is closed (step S5). The ejection port 18 is covered with the cap 84 (step S6) again. In such condition, the suction pump PU3 is actuated to perform suction with a suction force P3 to discharge the liquid in the first liquid passage 14 through the ejection port 18 (step S7). Then, similarly to the foregoing step S4, the cap 84 is released from the ejection port 18 to take the liquid residing in the cap 84 into the waste liquid tank 230 (step S8). Subsequently, wiping for the outer side surface of the ejection port 18 is performed (step S9). Covering the ejection port 18 by the cap 84, by displacement of the movable member 31 utilizing the pressure of the bubble generated by driving the heater 2, a preliminary ejection is performed for ejecting the liquid in the first liquid passage 14 irrespective of the printing operation (step S10). Then a sequence of recovery operation is completed.

Such recovery operation is performed by pressurization for the second liquid passage 16 having greater flow resistance. On the other hand, suction is performed for the first liquid passage 14 having low flow resistance. By this, recovery and maintaining of the ejection force is performed.

In the flowchart of recovery, it is important to establish a relationship of P3<P2 of the suction pressure P3 for recovering the first liquid passage 14 to be performed at step S7 at later timing and the pressurizing force P2 for recovering the second liquid passage 16 to be performed at step S3 at earlier timing. Recovery of the first liquid passage 14 having lower resistance is performed by suction, and recovery of the second liquid passage 16 having higher resistance is performed by pressurization. This is because the recovering ability is higher in pressurization rather than the suction. Removal of the ink from the cap 84 is efficiently removed by using the suction pump PU3.

Fourth Embodiment

Figure 32:
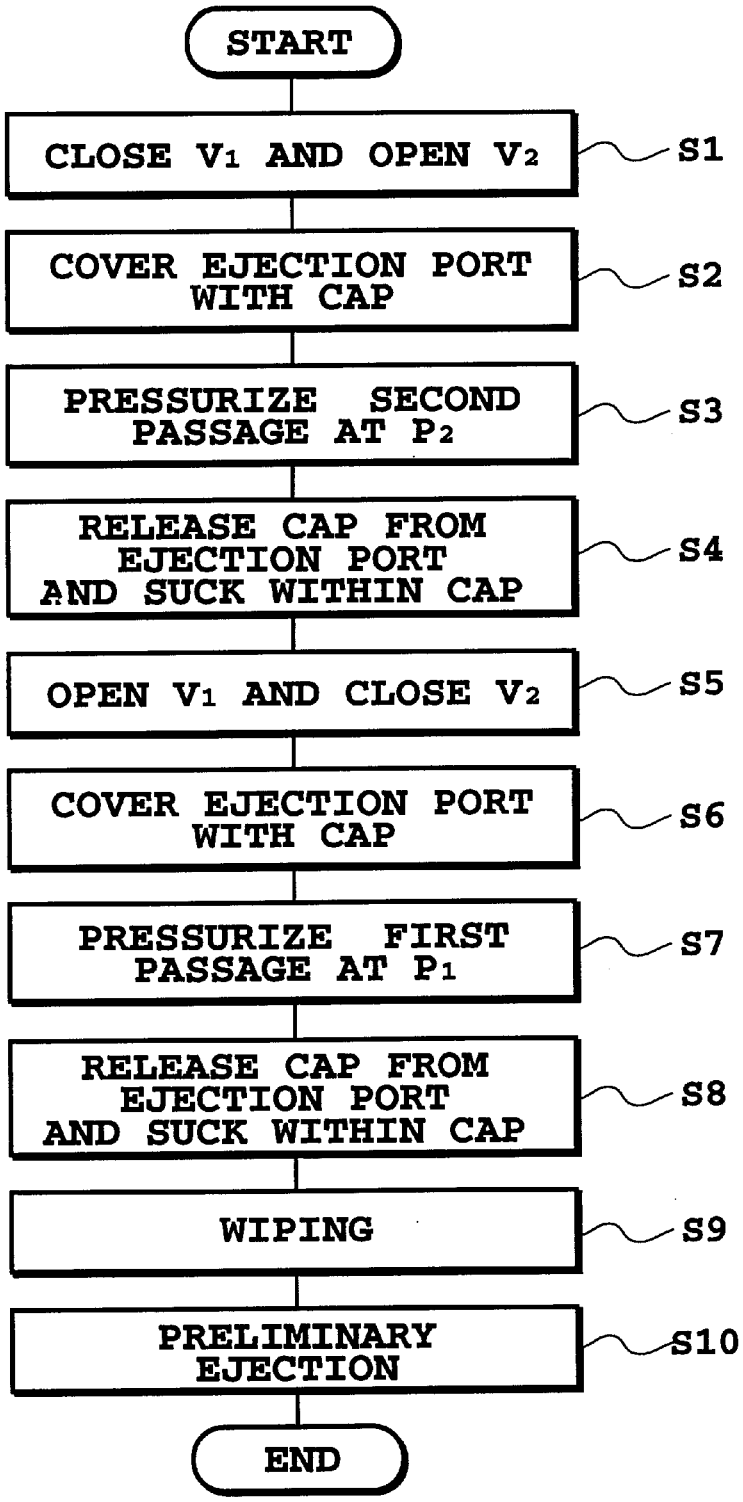
FIG. 32 is a flowchart showing one example of the ejection recovery method to be implemented in the ejection head having the structure of FIG. 30.

FIG. 32 is a flowchart showing one example of the ejection recovery method to be implemented in the ejection head having the structure of FIG. 30. The recovery operation shown in FIG. 31 and the recovery operation shown in FIG. 32 are basically common. In the present embodiment, it is characterized in that the liquid in the second liquid passage 16 is pressurized for discharging (step S3), and next, the liquid in the first liquid passage 14 is also pressurized for discharging (step S7). The second liquid passage 16 having high flow resistance is recovered by relatively high pressurizing force. The first liquid passage 14 having low flow resistance is recovered by relatively low pressurizing force.

In the flowchart of recovery, it is important to establish a relationship of P1<P2 of the suction pressure P1 for recovering the first liquid passage 14 to be performed at step S3 at earlier timing and the pressurizing force P2 for recovering the second liquid passage 16 to be performed at step S7 at later timing. It is important to apply higher pressure for the liquid passage having higher flow resistance.

At first, the valve V1 is closed, and the valve V2 is opened. Then, by pressurizing with the pump PU2, re-fill of the second liquid passage 16 is performed.

Next, the valve V2 is closed and the valve V1 is opened. Then, by pressurizing with the pump PU1, re-fill of the first liquid passage 14 is performed.

The recovery method of the present embodiment is basically common to that of the former third embodiment. By making the pressurization in place of suction, recovering ability can be improved. For removal of the liquid from the cap 84, gravity force or capillary force and the like can be used.

Fifth Embodiment

Figure 33:
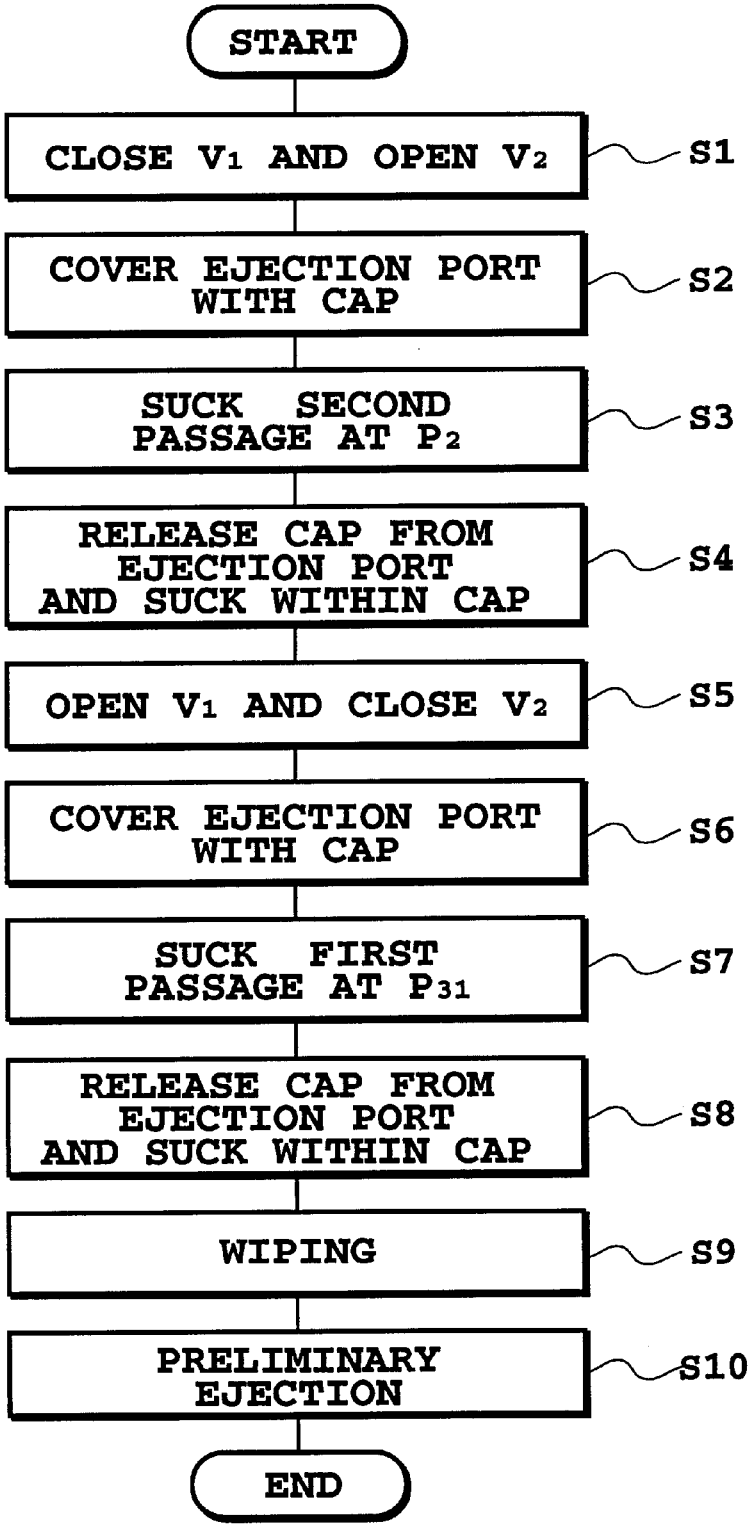
FIG. 33 is a flowchart showing one example of the ejection force recovery method to be implemented in the ejection head of the construction shown in FIG. 30.

FIG. 33 is a flowchart showing one example of the ejection force recovery method to be implemented in the ejection head of the construction shown in FIG. 30. The construction for recovering or maintaining the ejection force in that the liquid in the second liquid passage 16 is discharged by relatively strong suction. Next, the liquid in the first liquid passage 14 is discharged by relative weak suction. The second liquid passage 16 having high flow resistance is recovered by applying strong suction force, and the first liquid passage having low flow resistance is recovered by relatively weak suction force.

In this flowchart of recovery, it is important to establish a relationship of P31<P32 of the suction pressure P31 for recovering the first liquid passage 14 to be performed at step S7 at later timing and the pressurizing force P32 for recovering the second liquid passage 16 to be performed at step S3 at earlier timing. It is important to make the suction force to be applied to the liquid passage having higher flow resistance stronger. After suction in the cap 84, wiping (step S9) is performed for removing the residual ink on the head face, and the ink pushed into the ejection port is removed the preliminary ejection (step S10).

Upon performing recovery, recovery operation is performed by closing the valve provided in the liquid passage on the opposite side to the liquid passage to be recovered. Since the second liquid passage 16 side having higher resistance in the liquid passage is close the condition where the valve is closed, it may be possible to provide the valve only on the first liquid passage 14 side having lower resistance in the liquid passage.

Sixth Embodiment

Figure 34:
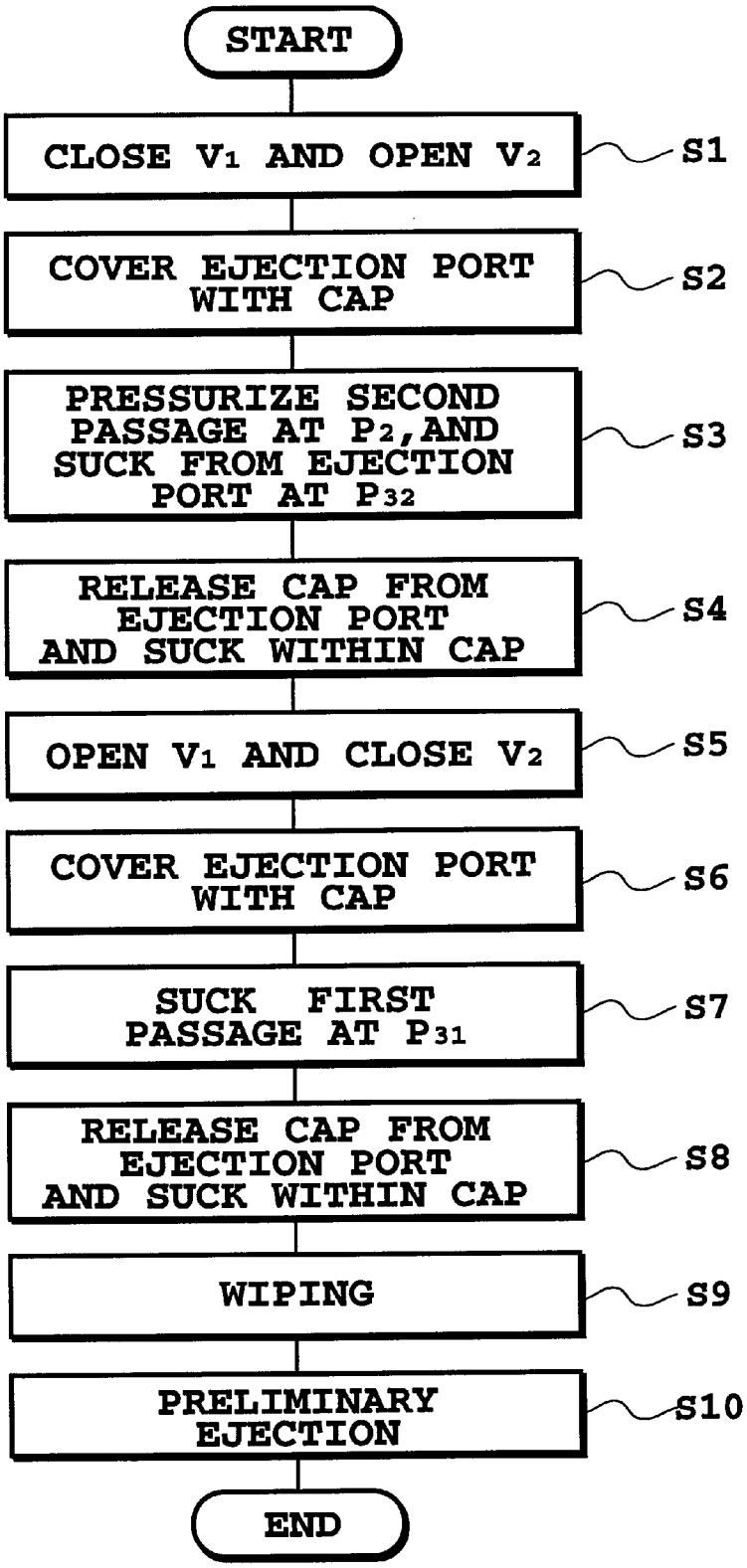
FIG. 34 is a flowchart showing one example of an ejection force recovery method to be implemented by the ejection head of the structure shown in FIG. 30.

FIG. 34 is a flowchart showing one example of an ejection force recovery method to be implemented by the ejection head of the structure shown in FIG. 30. There is shown a construction to recover or maintain the ejection force, in which, as shown in step S3, the liquid in the second liquid passage 16 is discharged with a large force by applying both of the pressurizing force and the suction force simultaneously. As shown in step S7, the liquid in the first liquid passage is discharged only by suction. The second liquid passage having high flow resistance is recovered by simultaneously applying the pressurizing force and the suction force, and the first liquid passage having low flow resistance is recovered only by the suction force.

In this flowchart of recovery, it is important to establish a relationship of $|P_{31}|<|P_{32}|+|P_2|$ between the suction force P31 for recovering the first liquid passage 14 to be performed at step S7 at later timing, and the suction force P32 and the pressurizing force P2 for recovering the second liquid passage 16 to be performed at step S3 at earlier timing. It is thus important to make the force (value of sum of absolute values of the pressurizing force and the suction force) greater for the liquid passage having higher resistance of the liquid passage. In the shown embodiment, by applying the pressurizing force and the suction force simultaneously, forcing energy for discharging of the liquid becomes large.

Seventh Embodiment

Figure 35:
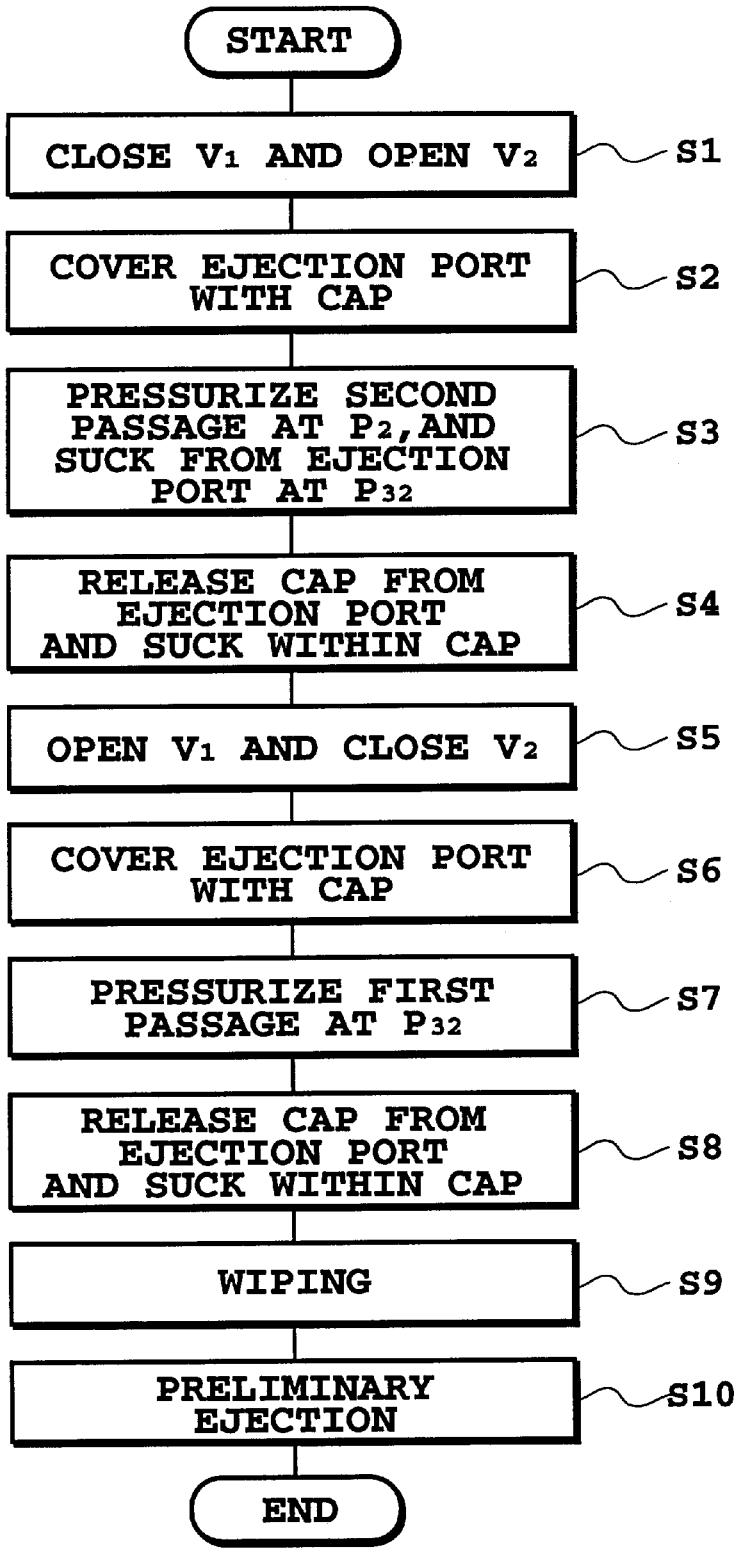
FIG. 35 is a flowchart showing one example of an ejection force recovery method to be implemented by the ejection head of the structure shown in FIG. 30.

FIG. 35 is a flowchart showing one example of an ejection force recovery method to be implemented by the ejection head of the structure shown in FIG. 30. There is shown a construction to recover or maintain the ejection force, in which, as shown in step S3, the liquid in the second liquid passage 16 is discharged with a large force by applying both of the pressurizing force and the suction force simultaneously. On the other hand, the liquid in the first liquid passage is discharged only by pressurization. The second liquid passage having high flow resistance is recovered by simultaneously applying the pressurizing force and the suction force, and the first liquid passage having small flow resistance is recovered only by the pressurizing force.

In this flowchart of recovery, it is important to establish a relationship of |P1|<|P32|+|P2| between the pressurizing force P1 for recovering the first liquid passage 14 to be performed at step S7 at later timing, and the suction force P32 and the pressurizing force P2 for recovering the second liquid passage 16 to be performed at step S3 at earlier timing. It is thus important to make the force (value of sum of absolute values of the pressurizing force and the suction force) greater for the liquid passage having higher resistance of the liquid passage. In the shown embodiment, by applying the pressurizing force and the suction force simultaneously, forcing energy for discharging of the liquid becomes large.

Eighth Embodiment

Figure 36:
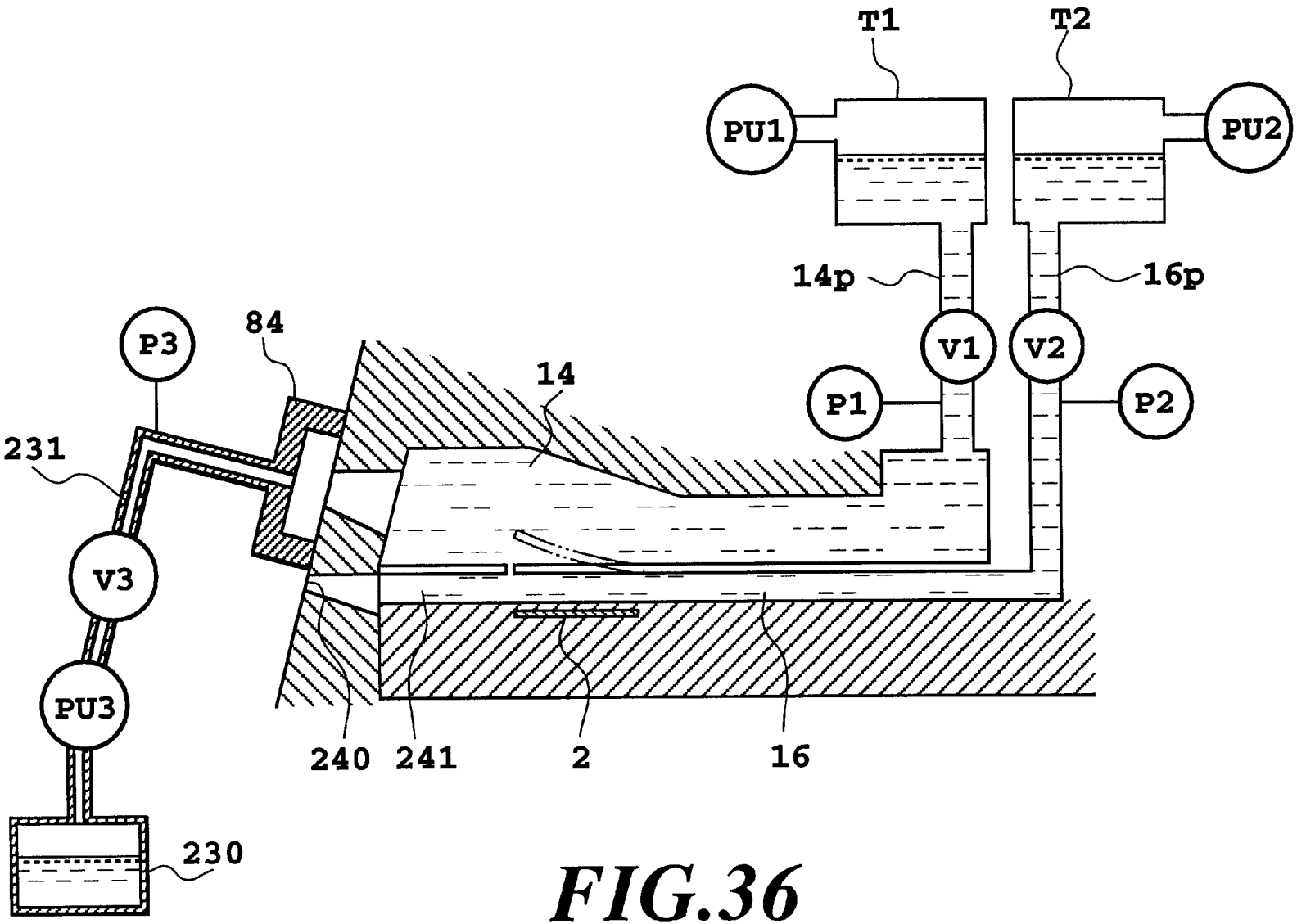
FIG. 36 is a diagrammatic view showing one example of the liquid ejection head having the ejection port and the recovery port corresponding to the recovery method shown in the eighth to eleventh embodiments.

FIG. 36 is a diagrammatic view showing one example of the liquid ejection head having the ejection port and the recovery port corresponding to the recovery method shown in the eighth to eleventh embodiments. In FIG. 36, like elements the same as those in the head shown in the former drawings are identified by like reference numerals and description thereof will be omitted for simplicity of disclosure.

In FIG. 36, the reference numeral 240 is a recovery port for discharging the bubbling liquid in the second liquid passage 16 by pressurization or suction, which recovery port is opened to the front face of the head. The recovery port 240 is communicated with the second liquid passage 16 via a recovery route 241.

Figure 37:
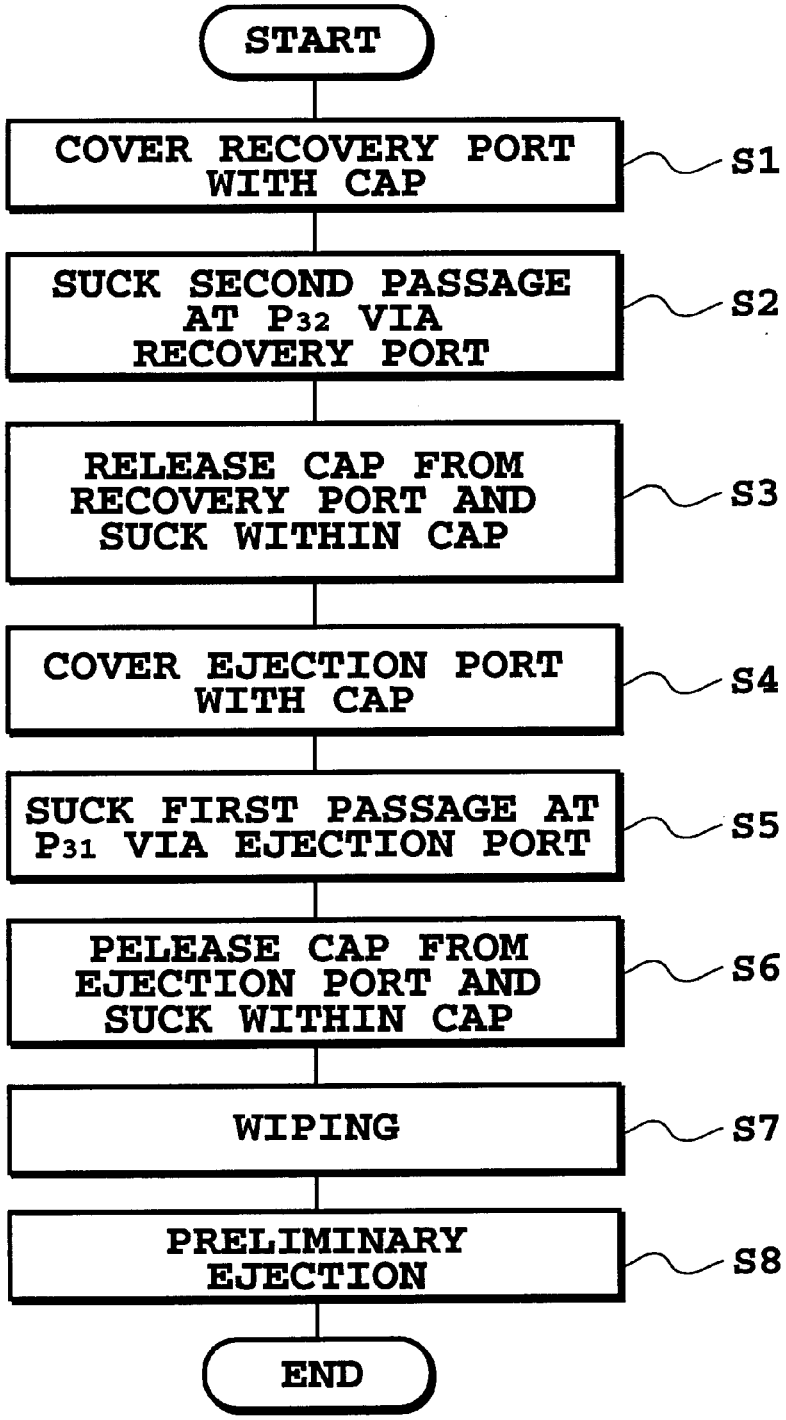
FIG. 37 is a flowchart showing one example of the ejection force recovery method to be implemented in the ejection head having a construction shown in FIG. 36.

FIG. 37 is a flowchart showing one example of the ejection force recovery method to be implemented in the ejection head having a construction shown in FIG. 36. There is show a construction for recovering or maintaining ejection force, in which the liquid in the second liquid passage 16 is discharged by suction as shown in step S2, and the liquid in the first liquid passage 14 is also discharged by suction as shown in step S5. The second liquid passage 16 having high flow resistance is recovered by relatively strong suction, and the first liquid passage having low flow resistance is recovered by relatively weak suction.

In the flowchart of recovery, it is important to establish a relationship of P31<P32 between the suction force P31 for recovering the first liquid passage 14 and the suction force P32 for recovering the second liquid passage 16. It is important to recover the liquid passage having higher resistance in the liquid passage by applying stronger suction force.

In the eighth embodiment, by providing the recovery port 240, recovering ability of the second liquid passage 16 having higher resistance in the liquid passage can be improved. Also, since the liquid in respective liquid passages can be discharged through different ports, recovery becomes possible without providing the valve. When recovery is performed for the first liquid passage 14, suction recovery is performed through the ejection port 18. When recovery is performed for the second liquid passage, suction recovery is performed through the recovery port 240.

Ninth Embodiment

Figure 38A:
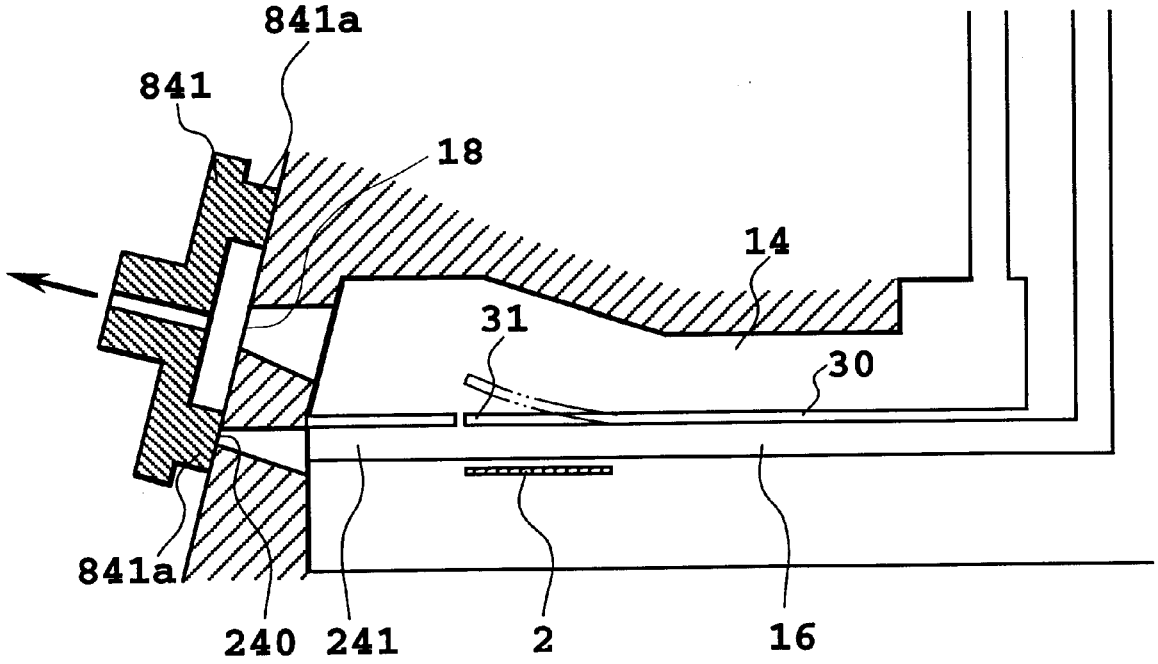
FIGS. 38A and 38B are sections showing one embodiment of the ejection force recovery method to be implemented in the ejection head of the construction as shown in FIG. 36.
Figure 38B:
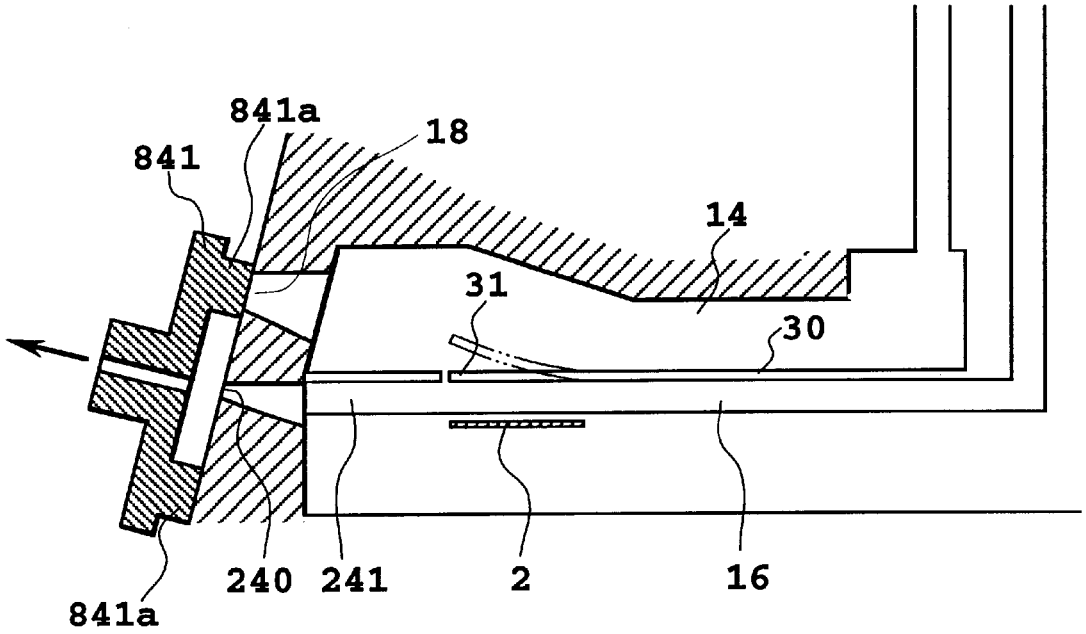

FIGS. 38A and 38B are sections showing one embodiment of the ejection force recovery method to be implemented in the ejection head of the construction as shown in FIG. 36. The ejection force recovery is performed by employing a cap 841 which has a thick flange portion 841*a* as shown in FIGS. 38A and 38B. This cap 841 has greater thickness in the flange portion 841*a*, as shown in FIGS. 38A and 38B. When the ejection port 18 is blocked by the thick flange portion 841*a*, the recovery port 240 becomes possible to suck. On the contrary, when the recovery port 240 is blocked by the thick flange portion 841*a*, the ejection port 18 is communicated to the interior of the cap 84.

As shown in FIG. 38A, by covering the cap 841 to the ejection port 18 to block the recovery port 240 with the thick flange portion 841*a* of the cap 841, the liquid in the first liquid passage 14 is discharged by suction. There is shown a construction for recover or maintain the ejection force, in which, as shown in FIG. 38B, by covering the cap 841 over the recovery port 240 to block the ejection port 18 by the thick flange portion 841*a* of the cap 841, the liquid in the second liquid passage 16 is discharged by applying both of the pressurizing force and the suction force simultaneously. The second liquid passage 16 having greater flow resistance is recovered by applying the pressurizing force and the suction force simultaneously, and the first liquid passage 14 having low flow resistance is recovered by applying only suction force. In short, the flowchart shown in FIG. 35 can be implemented.

Tenth Embodiment

Figure 39:
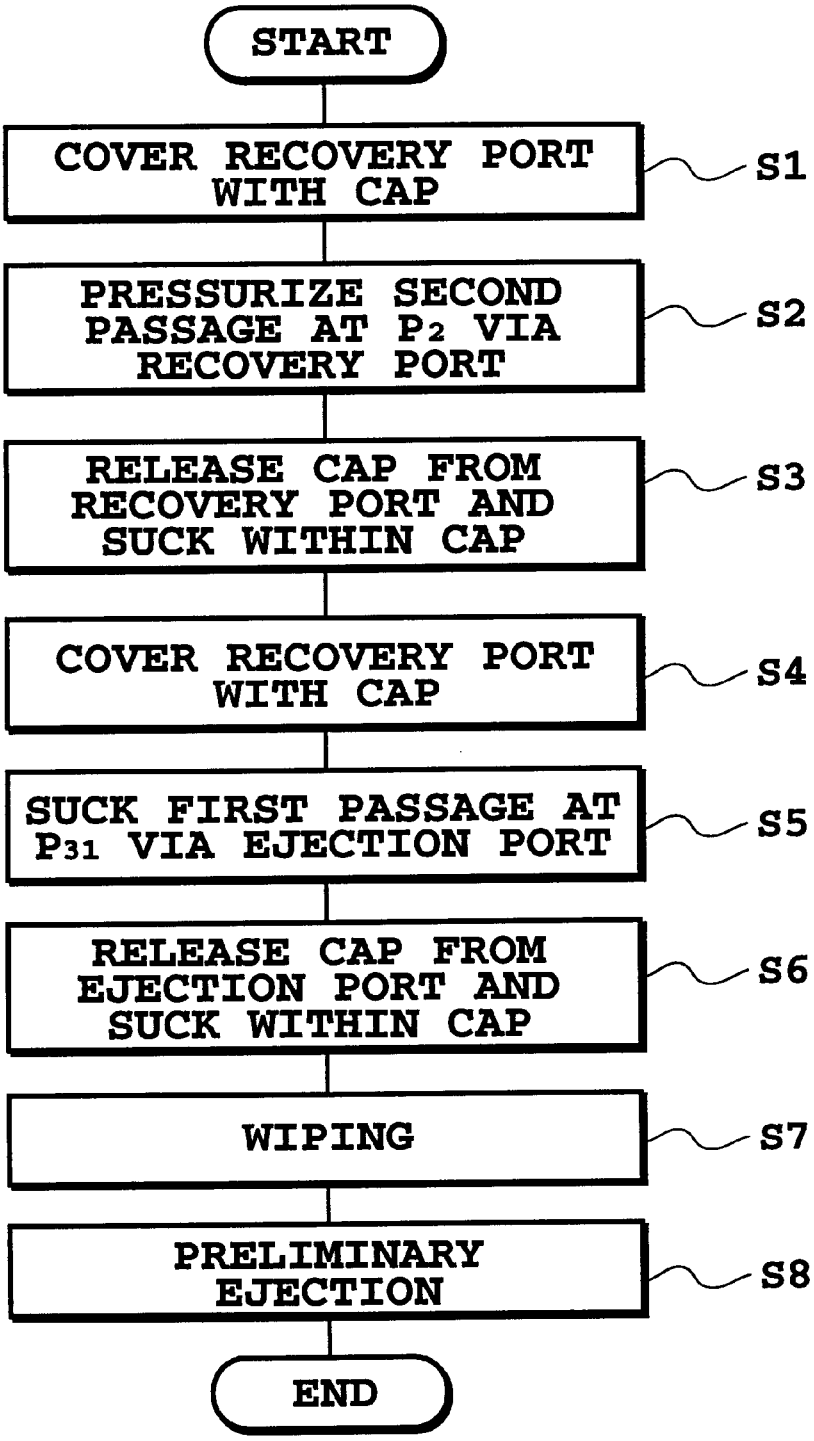
FIG. 39 is a flowchart showing one example of the ejection force recovery method to be implemented in the ejection head having a construction shown in FIG. 36.

FIG. 39 is a flowchart showing one example of the ejection force recovery method to be implemented in the ejection head having a construction shown in FIG. 36. There is shown a construction for recovering or maintaining ejection force, in which the liquid in the second liquid passage 16 is discharged by pressurization as shown in step S2, and the liquid in the first liquid passage 14 is also discharged by suction as shown in step S5. The second liquid passage 16 having high flow resistance is recovered by pressurization, and the first liquid passage having low flow resistance is recovered by relatively weak suction.

In the flowchart of recovery, it is important to establish a relationship of P31<P2 between the suction force P31 for recovering the first liquid passage 14 and the pressurizing force P2 for recovering the second liquid passage 16. It is important to recover the liquid passage having higher resistance in the liquid passage by applying stronger pressurization force.

In the tenth embodiment, by providing the recovery port 240, recovering ability of the second liquid passage 16 having higher resistance in the liquid passage can be improved. Also, since the liquid in respective liquid passages can be discharged through different ports, recovery becomes possible without providing the valve.

In the tenth embodiment, it is possible to perform suction recovery for the ejection port 18 and the recovery port 240 using a cap for covering the ejection port 18 and the other cap for covering the recovery port 240. In this case, a single pump may be employed and application of the suction force to the respective caps may be switched by a valve of the single pump.

Eleventh Embodiment

Figure 40:
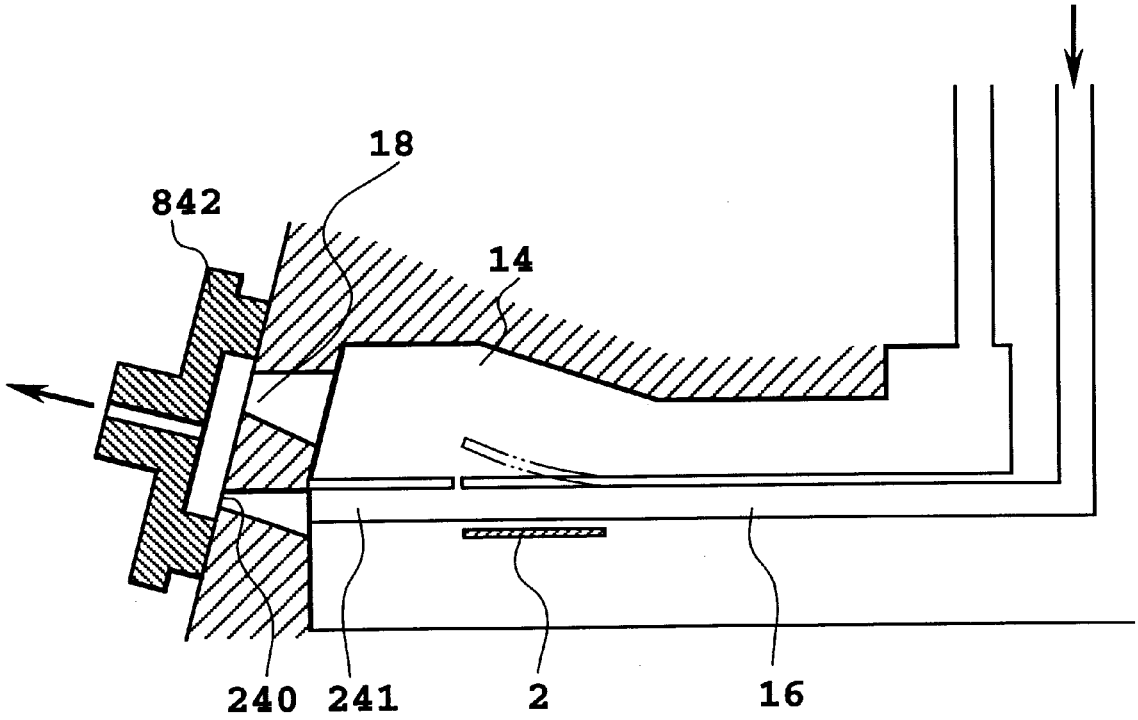
FIG. 40 is a cross-sectional view showing one example of the ejection force recovery method.

FIG. 40 is a cross-sectional view showing one example of the ejection force recovery method, which is implemented by employing a cap 842 having a size to simultaneously cover the ejection port 18 and the recovery port 240 of the ejection head of the construction shown in FIG. 36.

As shown in FIG. 40, the recovery port 240 and the ejection port 18 are covered simultaneously with the cap 842. By driving the suction pump P3, suction is simultaneously effected for the first and second liquid passages 14 and 16. At the same time of suction, the second liquid passage 16 is pressurized by the pump PU2.

In the flowchart of recovery, it is important to establish a relationship of |P31|<|P32|+|P2| between the suction force P31 for recovering the first liquid passage 14 and the suction force P32 and the pressurizing force P2 for recovering the second liquid passage 16. It is important to recover the liquid passage having higher resistance in the liquid passage by applying stronger force (value of a sum of absolute values of the pressurizing force and the suction force). In the shown embodiment, by applying the pressurizing force and the suction force simultaneously to the second liquid passage having higher flow resistance, forcing energy for discharging the liquid becomes large.

In respective of the foregoing embodiments, when the liquid of increased viscosity or bubble in the first liquid passage 14 is discharged through the ejection port 18 by operating the pressurizing pump PU1, the cap 84 connected to the suction pump PU3 is pressed onto the head. Then, the suction pump PU3 is operated to collect the ejection liquid discharge through the ejection port to accumulate in the waste ink tank 230.

At this time, when a space defined between the cap 84 and the head is completely closed condition, it is desirable that among the pressure P1 generated by the pressurizing pump PU1 and the pressure P3 generated by the suction pump PU3, the pressure P1 is greater than the pressure P3. When P1 is smaller than P3, it is possible that the movable member 31 is opened to permit the bubbling liquid in the second liquid passage 16 flows into the first liquid passage. When the pressure P1 of the pressurizing pump PU1 is greater than P3, it is facilitated to flow only ejection liquid with maintaining the movable member 31 in the head at closed position.

Figure 41:
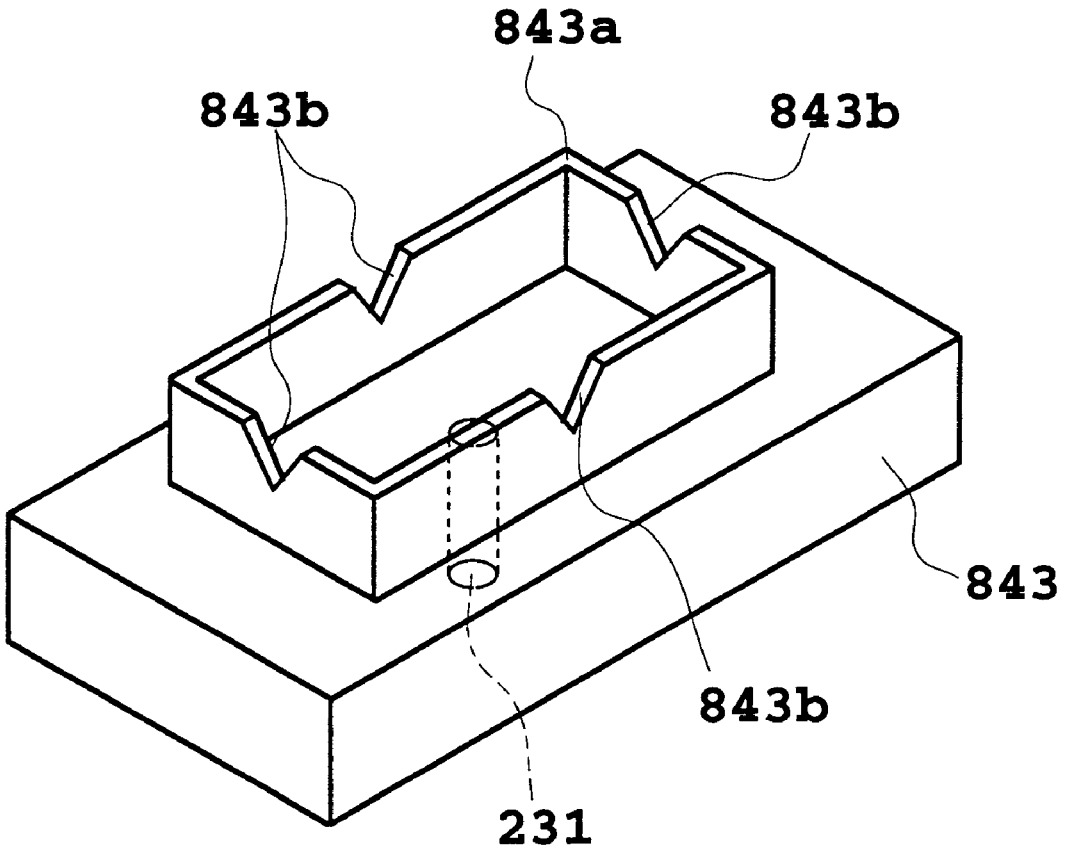
FIG. 41 is a perspective view showing an alternative example of a suction cap using in performing the liquid recovery method in the liquid ejection apparatus according to the present invention.
Figure 42:
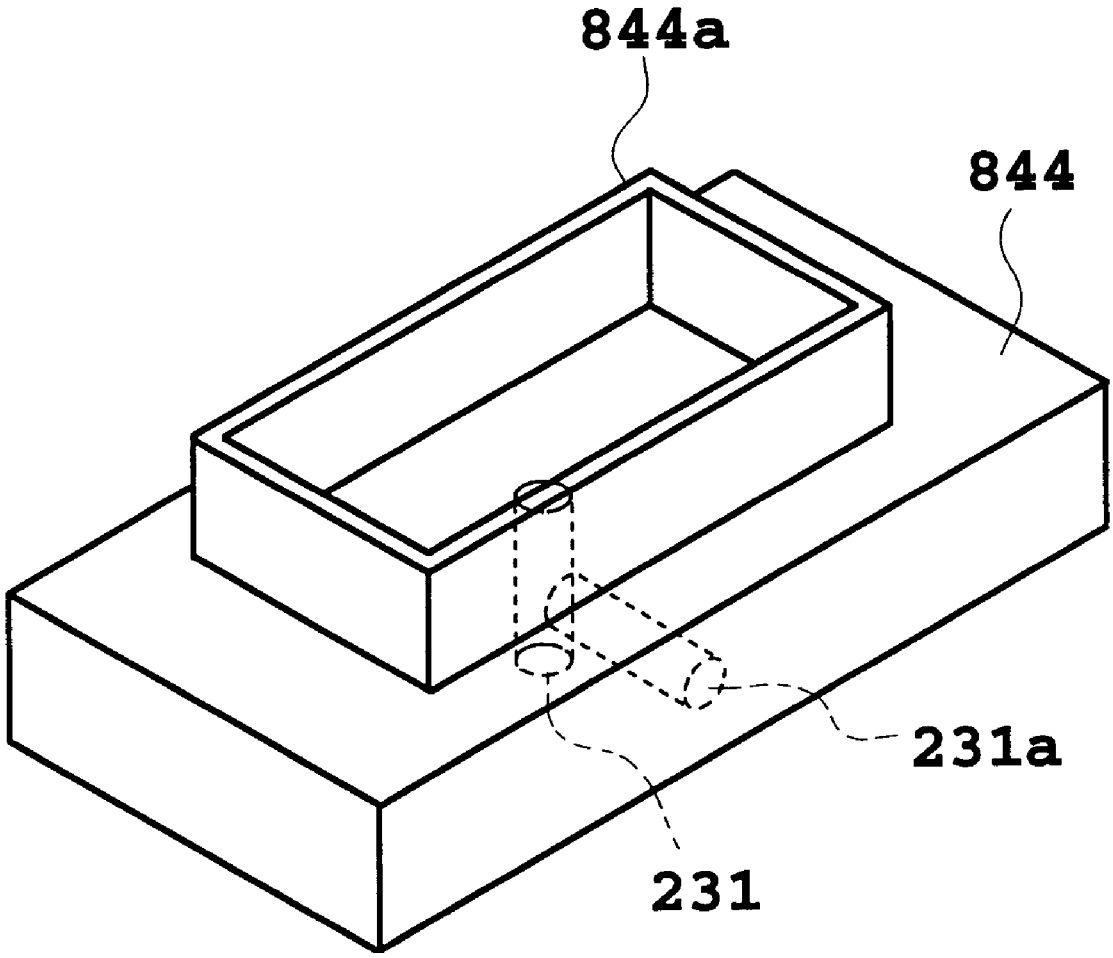
FIG. 42 is a perspective view showing a further alternative example of a suction cap using in performing the liquid recovery method in the liquid ejection apparatus according to the present invention.
Figure 43:
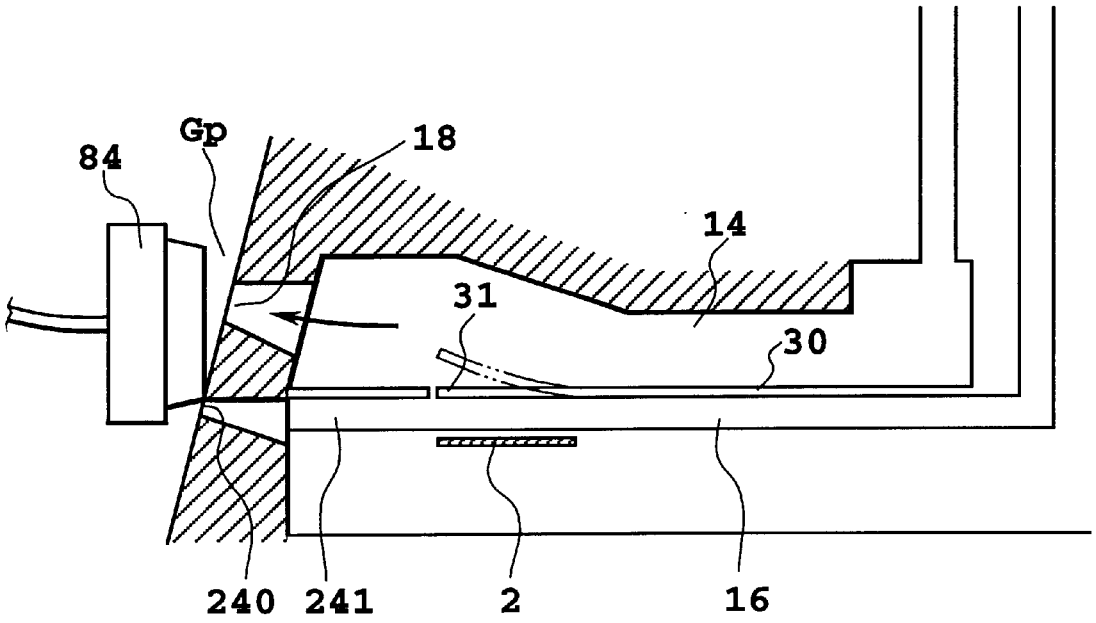
FIG. 43 is a cross-sectional view showing an alternative example of operating a suction cap using in performing the liquid recovery method in the liquid ejection apparatus according to the present invention.

When the space defined between the cap 84 and the head is not completely closed, for example, is realized by forming a cut-out 843*b* in the flange portion 843*a* of the cap 843, as shown in FIG. 41, providing an atmosphere communication hole 231*a* branched from the suction pipe 231 as in the cap 844 as shown in FIG. 42, a fine gap GP with an inclination with respect to the head of the cap 84 as shown in FIG. 43. In such embodiment, in a difference between the pressure P1 of the pressurizing pump PU1 and a pressure P3 of the suction pump PU3, either one of pressures may be greater than the other. Even if P3 is greater, the ejection liquid discharged under the pressurizing force P1 is drawn together with air by the cap, therefore, it is not happened to act the suction force in the first liquid passage 14 to the movable member 31 to open the latter, and the bubbling liquid in the second liquid passage 16 does not easily flow into the first liquid passage 14.

Figure 44:
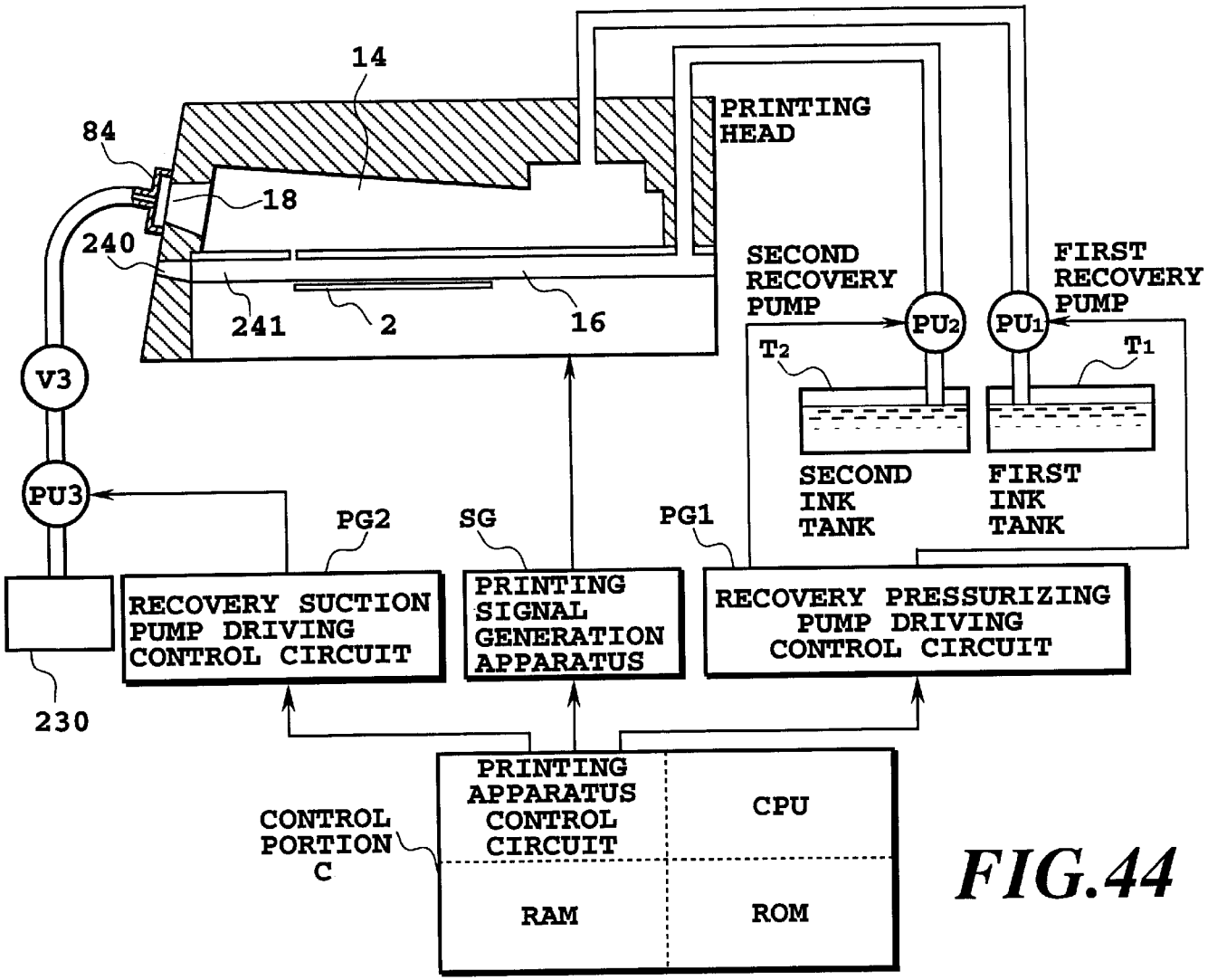
FIG. 44 is a block diagram showing the total control of the apparatus according to the present invention.

In the ejection force recovery method and the ejection head as shown in various embodiments, as shown in FIG. 44, a control portion C performing control for the overall apparatus is utilized as a work area of CPU such as a microprocessor, that of a ROM storing the control program for the CPU and various data, and includes a RAM performing temporary storage of various data, and the like. By a control signal generated from the control portion C, the printing head, the recovery pumps PU1 and PU2 for recovery of the first and second liquid passages are controlled driving. Then, via a third pump (suction pump) PU3 is controlled driving via the recovery suction pump driving control circuit PG2.

Twelfth Embodiment

Figure 45:
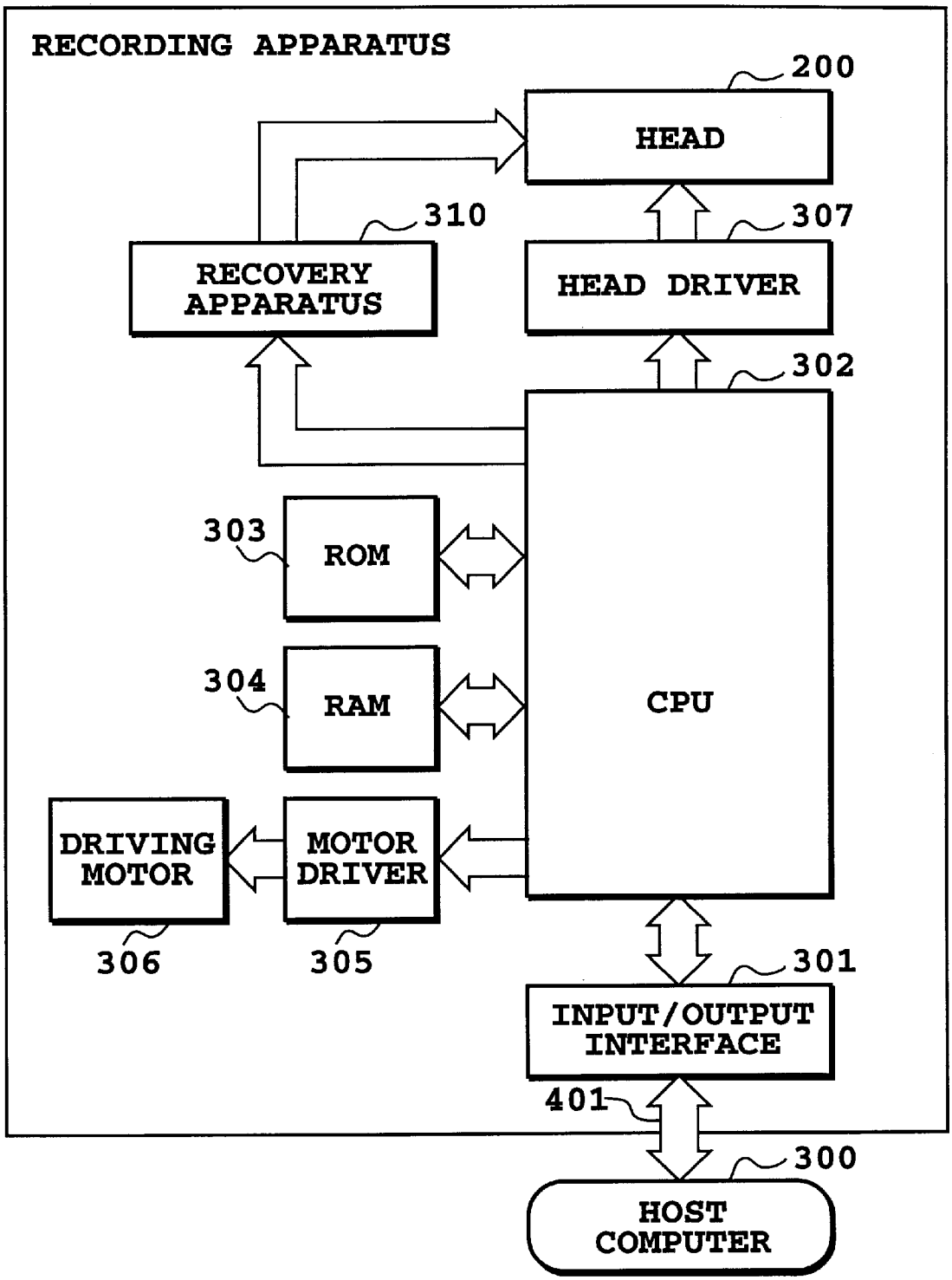
FIG. 45 is a block diagram of the apparatus.

FIG. 45 is a block diagram of the overall apparatus for operating the ink-jet printing, to which the liquid ejection method and the liquid ejection head according to the present invention is applied.

The printing apparatus receives a printing information from a host computer 300 as a control signal. The printing information is temporarily stored in an input interface 301 in the printing apparatus, and in conjunction therewith, converted into data to be process in the printing apparatus and then input to a CPU 302 which, in turn, serves as head driving signal supply means. The CPU processes the input data using RAM 304 and other peripheral units on the basis of the control program stored in a ROM 303 to convert into the printing data (image data).

On the other hand, the CPU 302 generates a drive data for driving the driving motor for shifting the printing medium and the printing head in synchronism with the image data so that the image data may be printed at appropriate position on the printing medium. The driving data and the motor driving data are transmitted to respective of head 200 and the driving motor 306 via a head driver 307 and a motor driver 305 for driving them at respective controlled timing to form the image. The CPU 302 feeds a recovery operation command to the recovery apparatus 310, typically the suction recovery apparatus 200, when the ejection force recovery operation, such as resting of the head or the like is necessary. The recovery apparatus 310 received the ejection force recovery command performs a sequence of operation for recovering the ejection force on the basis of set suction or pressurizing recovery sequence.

As the printing medium applicable for the printing apparatus set forth above and to deposit the liquid, such as the ink, various paper, OHP sheet, plastic material to be employed for a compact disk, decorative panel or the like, cloth, metal materials, such as aluminum, copper or the like, leathers, such as cattle hide, lyophilized porcine skin, simulated synthetic leather substitute, lumber, such as wood, plywood, bamboo, ceramic material, such as tile, three-dimensional structural body, such as sponge or the like, may be used.

Also, as the ejection liquid to be used in these liquid ejecting apparatuses, the liquid adapted to respective printing medium or printing condition may be used.

Thirteenth Embodiment

<Printing System>

Next, one embodiment of an ink-jet printing system to perform printing for the printing medium with employing the liquid ejecting head described above, as the printing head.

Figure 46:
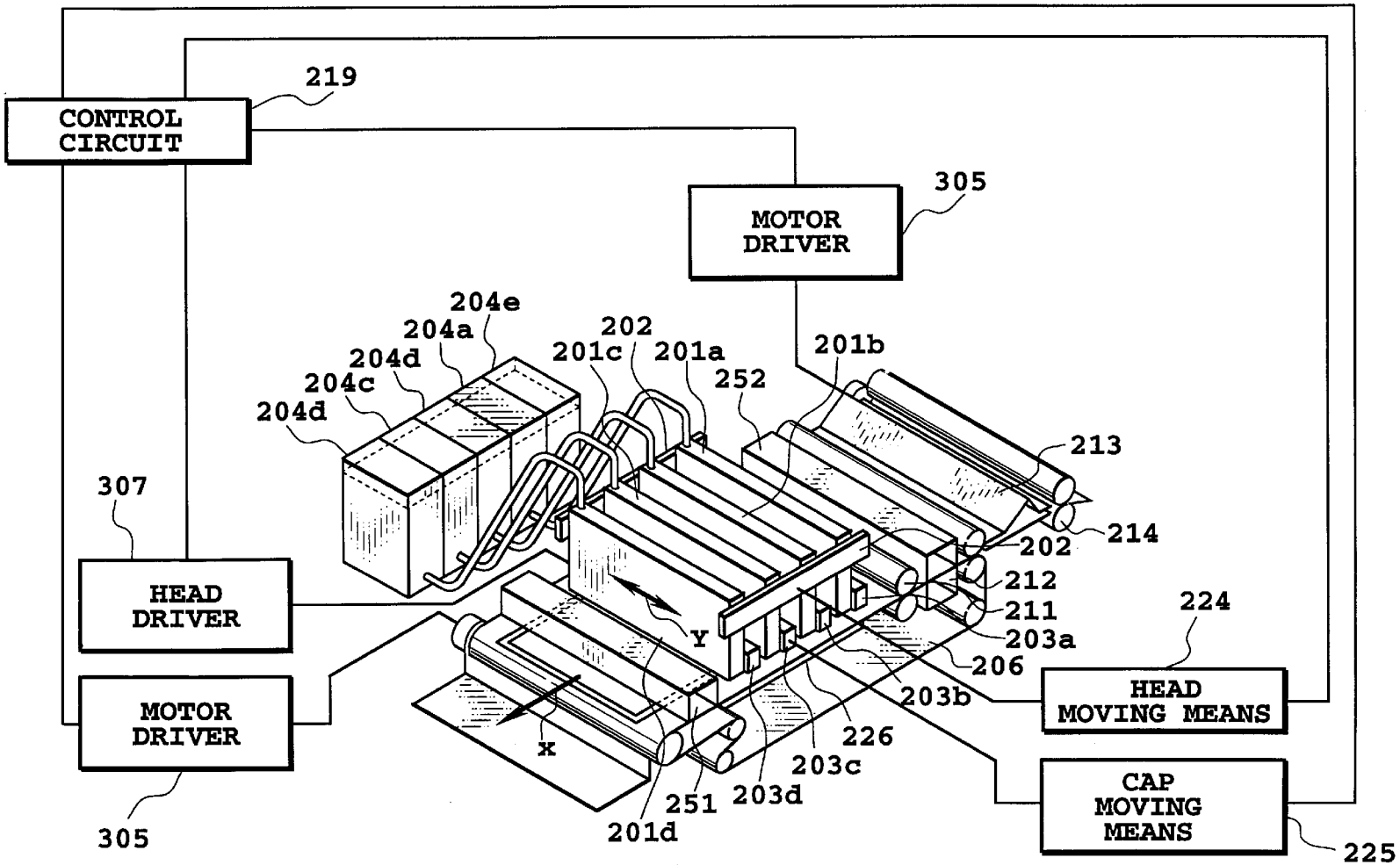
FIG. 46 is a view showing a liquid ejection printing system.

FIG. 46 is a diagrammatic view showing the construction of the ink-jet printing system employing the foregoing liquid ejection head 200 according to the present invention. In the present embodiment, the liquid ejecting head is a full-line type head, in which a plurality of ejection ports at the interval of 360 dpi in a length corresponding to a printable width of the printing medium 150, in which four heads respectively corresponding to four colors of yellow (Y), magenta (M), cyan (C) and black (Bk) are fixedly supported in parallel relationship with a given interval in X direction by means of a head holder 202.

With respect to these heads, signal is supplied from the head driver 307 forming respective driving signal supply means. On the basis of this signal, respective head is driven.

For the respective heads, four colors of inks of Y, M. C and Bk as ejection liquid are supplied from ink containers 204*a* to 204*d*. The reference numeral 204*e* denotes a bubbling liquid container storing the bubbling liquid. From this container, bubbling liquid is supplied to each head.

At lower side of each head, head caps 203*a* to 203*d*, in which ink absorbing member, such as sponge or so forth is arranged are provided for maintenance of the head by covering the ejection ports of respective heads during non-printing.

The reference numeral 206 denotes a transporting belt forming the transporting means for transporting the various printing mediums. The transporting belt 206 runs across a predetermined path defined by various rollers, and is driven by the driving motor connected to the motor driver 305.

In the present embodiment of the ink-jet printing system, before and after printing, a pre-treatment apparatus 251 and a post-treatment apparatus 252 for performing various processes for the printing medium are provided upstream and downstream of the printing medium transporting path.

Content of the pre-treatment and the post-treatment are differentiated depending upon kind of the printing medium and kind of the ink. For example, ultraviolet and ozone are as a pre-treatment irradiated onto the printing medium of metal, plastic, ceramic and the like to improve adhesion ability of the ink by activating the surface. Also, in the printing medium easily cause static electricity, such as plastic, dust can easily deposit on the surface of the printing medium by static electricity to obstruct high quality printing. As pre-treatment, static electricity of the printing medium is removed by ionizer apparatus and whereby dust is removed from the printing medium. Also, when cloth is used as the printing medium, in view point of prevention of bleeding, improvement of fixing rate, a material selected from alkaline material, water soluble material, synthetic high polymer, water soluble metal salt, urea and thiourea may be applied to the cloth for pre-treatment. The pre-treatment is not limited to these treatments but can be the treatment for adjusting the temperature of the printing medium to the appropriate temperature.

On the other hand, the post-treatment may be a heat-treatment for the printing medium, for which the ink is applied, a fixing treatment for promoting fixing of the ink by irradiation of ultraviolet ray or the like, treatment for washing the treatment liquid applied in the pre-treatment and left non-reacted.

It should be noted that the full-line head is employed as the head in the present embodiment. However, the printing head to be employed is not limited to the full-line head but can be in a form where a small size head is shifted in the width direction of the printing medium.

<Head Kit>

Figure 47:
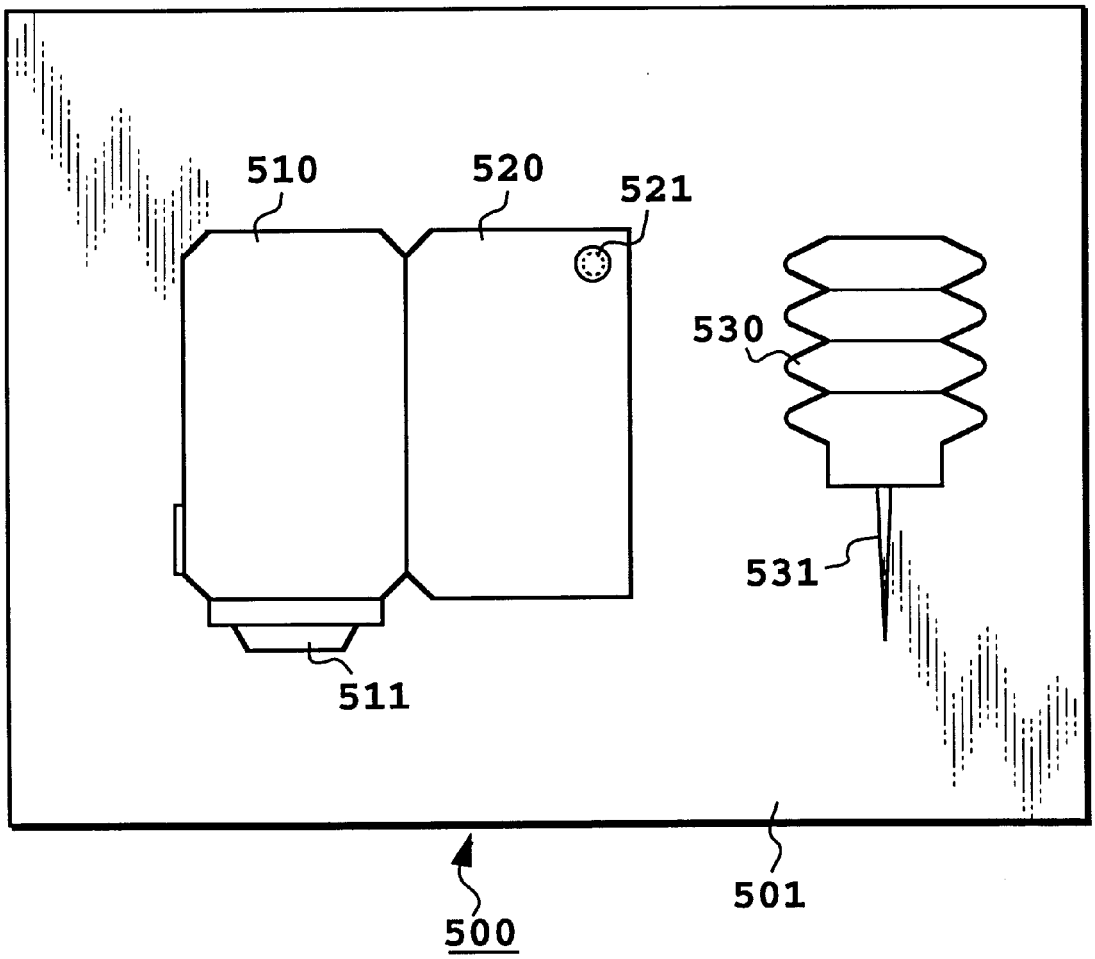
FIG. 47 is a diagrammatic view of a head kit.
Figure 48A:
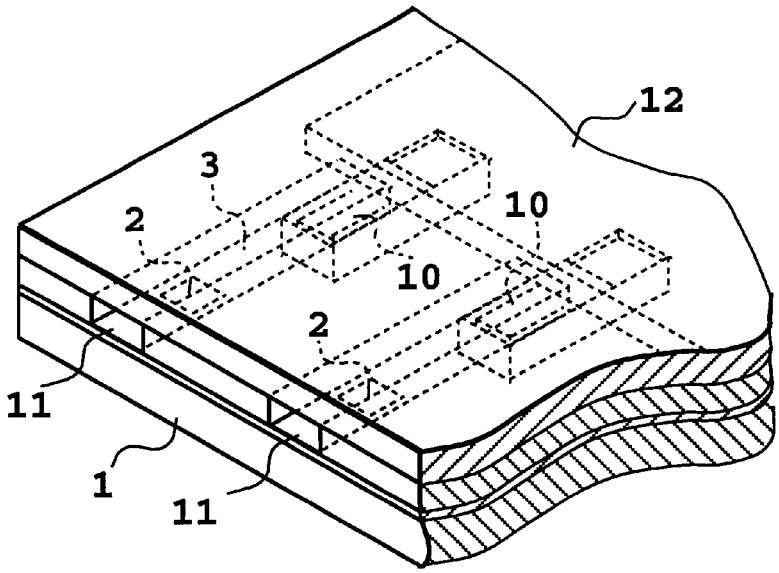
FIGS. 48A and 48B are views for explaining a structure of a liquid passage of the conventional liquid ejection head.
Figure 48B:
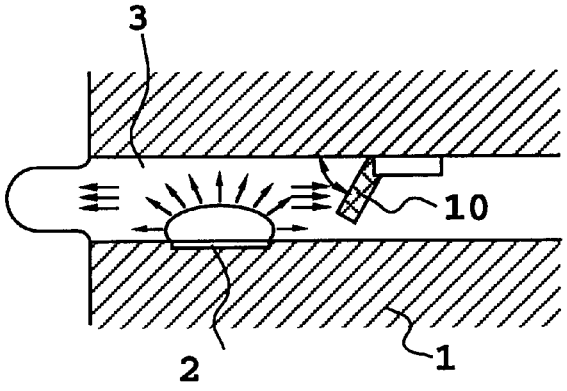

Hereinafter, a head kit having the liquid ejecting head as described above, will be described. FIG. 47 is a diagrammatic view showing such head kit. The head kit is constructed by housing a head 510 of the present invention having ink ejection portion 511 for ejecting the ink, an ink container 520 as a liquid container inseparable or separable relative to the head, an ink filling means storing the ink to be filled in the ink container, within a kit casing 501.

When the ink is consumed out, a part (injection needle or the like) of the ink filling means is inserted through an atmosphere communication opening 521 of the ink container, connecting portion of the head or a hole formed through the wall of the ink container, to fill the ink in the ink filling means through the inserting portion.

Thus, by forming the kit by housing the liquid ejecting head of the present invention, the ink container, the ink filling means and so on within the kit casing, even when the ink is consumed out, the ink can be filled within the ink container to quickly start printing.

On the other hand, in the present embodiment of the head kit, explanation has been given for the kit, in which the ink filling means is included. However, the head kit may be the type in which the detachable ink container filled with the ink and the head are housed within the kit casing, without including the ink filling means.

On the other hand, in FIG. 47, only ink filling means filling the ink to the ink container is shown. However, it can be the type which additionally house a bubbling liquid filling means for filling the bubbling liquid in the bubbling container, in addition to the ink container.

With the construction set forth above, when the recovery of the first and second liquid passages is performed by discharging the liquids in respective liquid passage by suction and/or pressurization of the liquid passages, the pressurizing force and/or the suction force for the liquid passage having higher flow passage resistance is set to be greater than those of the other liquid passage to certainly and sufficiently discharge the liquid required to be discharged to remove for recovery. With the major construction of the present invention, removal of the ink of increase viscosity, dust and the like which can be caused at the ejection port portion in the liquid ejection head after leaving for a long period, and removable of precipitated bubble to be accumulated in the first liquid passage can be performed efficiently, sufficiently and certainly.

With the construction of the present invention, in the case where two liquids, i.e. the ejection liquid and the bubbling liquid, admixing of two liquids can be effectively prevented or instantly resolved even after leaving for long period.

When the an externally opened passage way is provided in the liquid passage of the bubble generating portion side, the liquids presenting in two liquid passages separated by the movable member can be efficiently discharged by the suction means or the pressurizing means to recover the ejection force of the head. In this construction, number of times, amount, sequential order, timing for discharging of the liquid in both liquid passages, may be set freely.

By increasing the flow amount by opening the flow rate adjusting means upon suction process the ejection port, removable of the viscous ink or the like can be performed further efficiently.

It is also effective to adjust the suction amount of respective liquid by utilizing the water head difference between both liquids or to suck with making the flow resistance of respective liquid equal to each other, for gaining further higher efficiency in removal of the viscous ink or the like. Also, it is quite effective to suction is effective while the movable member is displaced toward the first liquid passage.

By the liquid ejection method, head and so on of the according to the present invention on the basis of novel ejection principle employing the movable member, multiplier effect of generation of the bubble and the movable member displaced by generation of the bubble can be attained to efficiently eject the liquid in the vicinity of the ejection port. Therefore, in comparison with the conventional ejection method and head and so on in bubble-jet printing system, ejection efficiency can be improved.

With particular construction of the present invention, even by leaving for a long period under low temperature or low humidity, ejection failure can be prevented. Also, even if ejection failure is caused, by slightly performing the recovery process, such as the preliminary ejection, suction recovery, normal condition can be instantly recovered. Associating with this, shortening of the recovery period and reduction of loss of liquid by recovery to lower the running cost significantly.

Particularly, with the construction improving the re-fill characteristics according to the present invention, response characteristics upon sequential ejection, stable growth of bubble, stabilization of the liquid droplet can be achieved to enable high speed printing or high quality printing by high speed liquid ejection.

In the head of dual liquid passage construction, by employing a liquid which is easy to cause bubble and the liquid which may not cause deposition (scorched or the like) on the heater, freedom in selection of the ejection liquid can be significantly improved to enable selection of high viscous liquid which is difficult to generate bubble, the liquid which is easily cause deposition on the header, which cannot be used in the conventional bubble-jet ejection method, can be used with satisfactory results of printing.

Also, the liquid which is weak against the heat can also be ejected without being subject to adverse effect of the heat on the liquid.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid ejection apparatus, employing a liquid ejection head having a first liquid passage communicating with an ejection port for ejecting a liquid, and a second liquid passage communicating with a recovery port for discharging liquid in said second liquid passage, said second liquid passage having a bubble generating region for generating a bubble in the liquid by applying heat to the liquid, said liquid ejection head further having a movable member disposed between said first liquid passage and said bubble generating region of said second liquid passage, said movable member having a free end on a side of said movable member nearest said ejection port, said free end being displaced toward said first liquid passage in response to a pressure of bubble generation within said bubble generating region so as to direct said pressure to an ejection port side of said first liquid passage, said apparatus comprising:

first valve means disposed in a first flow passageway, the first flow passageway communicating a first liquid storage portion for storing liquid stored for supply to said ejection port through said first liquid passage;

second valve means disposed in a second flow passageway, the second flow passageway communicating a second liquid storage portion for storing liquid stored for supply to said recovery port through said second liquid passage;

an ejection port suction means for sucking liquid from said ejection port of said liquid ejection head; and a recovery port suction means for sucking liquid from said recovery port of said liquid ejection head.

2. A liquid ejection apparatus as claimed in claim 1, wherein said movable member forms a part of a separation wall arranged between said first liquid passage and said second liquid passage.

3. A liquid ejection apparatus as claimed in claim 2, wherein said separation wall is disposed between a grooved member integrally including a plurality of grooves for forming a plurality of said first liquid passages directly communicated with corresponding ejection ports and a recessed portion for defining a first common liquid chamber for supplying liquid to a plurality of said first liquid passages, the liquid ejection head further comprising an element substrate having arranged thereon a plurality of heaters for generating bubbles in the liquid by applying a heat to said liquid, wherein said moveable member is displaced toward said first liquid passage in response to a pressure of bubbles at positions opposing said heaters.

4. A liquid ejection apparatus as claimed in claim 1, wherein said recovery port suction means is used in common as said ejection port suction means, and a suction pressure of said recovery port suction means is variably controllable.

5. A liquid ejection apparatus as claimed in claim 1, further comprising capping means for capping at least one of said ejection port and said recovery port.

6. A liquid ejection apparatus as claimed in claim 1, further comprising a drive signal supply means for supplying a drive signal for effecting bubble generation in said bubble generating region and liquid ejection from said liquid ejection head.

7. A liquid ejection apparatus as claimed in claim 1, further comprising printing medium transporting means for transporting a printing medium which receives the liquid ejected from said liquid ejection head.

8. A liquid ejection apparatus as claimed in claim 7, wherein said printing medium is selected from a group consisting of printing paper, cloth, plastic, metal, wood and leather.

9. A liquid ejection apparatus as claimed in claim 1, wherein said liquid ejection head includes plural liquid ejection ports, and wherein said apparatus ejects a plurality of color liquids from said plural liquid ejection ports to deposit said plurality of color liquids on a printing medium for color printing.

10. A liquid ejection apparatus as claimed in claim 1, wherein said plural liquid ejection ports of said liquid ejection head are arranged over an entire width of a region to be printed of a printing medium.

11. A liquid ejection apparatus as claimed in claim 1, wherein said first liquid storage portion for storing the liquid to be supplied to said first liquid passage and said second liquid storage portion for storing the liquid to be supplied to said second liquid passage are independent of each other.

12. A liquid ejection apparatus as claimed in claim 11, wherein said apparatus further comprises first pressurizing means connected to said first liquid storage portion to pressurize an interior thereof, and second pressurizing means connected to said second liquid storage portion to pressurize an interior thereof.

13. A liquid ejection apparatus as claimed in claim 12, wherein respective pressures of said first and second pressurizing means and said ejection port suction means are variably controllable.

14. A liquid ejection apparatus as claimed in claim 12, further comprising a pump which is included in at least one of said first and said second pressurizing means and said ejection port suction means.

15. A recovery method of a liquid ejection apparatus, in which said liquid ejection apparatus employs a liquid ejection head having a first liquid passage communicating with an ejection port, a second liquid passage having a bubble generating region for generating a bubble in liquid by applying heat to the liquid, and a movable member disposed between said first liquid passage and said bubble generating region of said second liquid passage, said movable member having a free end on a side of said movable member nearest said ejection port, said free end being displaced toward said first liquid passage in response to a pressure of bubble generation within said bubble generating region so as to direct said pressure to an ejection port side of said first liquid passage, said method comprising:

a first step for discharging liquid substantially from said second liquid passage; and a second step following said first step, said second step for discharging liquid substantially from said first liquid passage.

16. A recovery method as claimed in claim 15, wherein said movable member forms a part of a separation wall disposed between said first liquid passage and said second liquid passage.

17. A recovery method as claimed in claim 16, wherein said separation wall is disposed between a grooved member integrally including a plurality of grooves for forming a plurality of said first liquid passages directly communicated with corresponding ejection ports and a recessed portion for defining a first common liquid chamber for supplying liquid to a plurality of said first liquid passages, the liquid ejection head further comprising an element substrate having arranged thereon a plurality of heaters for generating bubbles in the liquid by applying a heat to said liquid, wherein said movable member is displaced toward said first liquid passage in response to a pressure by generation of bubbles at positions opposing said heaters.

18. A recovery method as claimed in claim 15, wherein the liquid is discharged by sucking the liquid from said ejection port using a suction means via a cap capping said ejection port.

19. A recovery method as claimed in claim 15, wherein the liquid is discharged by a pressurizing means pressurizing the liquid in said head.

20. A recovery method as claimed in claim 19, wherein said pressurizing means includes a pump.

21. A recovery method of a liquid ejection apparatus as claimed in claim 15, wherein said liquid ejection apparatus includes a first passageway connected with a first liquid storage portion for storing liquid stored for supply to said first liquid passage of said liquid ejection head, and a second passageway connected with a second liquid storage portion for storing liquid stored for supply to said second liquid passage, and furthermore, said apparatus comprises first valve means for restricting communication/non-communication of liquid through said first passageway, and second valve means for restricting communication/non-communication of liquid through said second passageway.

22. A recovery method of a liquid ejection apparatus as claimed in claim 21, wherein said liquid ejection apparatus further comprises pressurizing means for pressurizing an interior of said first and second liquid storage portions, and suction means for sucking the liquid from the ejection port of said liquid ejection head, wherein said first discharging step of said method comprises closing said first valve means, opening said second valve means, and operating said pressurizing means or suction means, and thereafter, said second discharging step of said method comprises opening said first valve means, closing said second valve means, and operating said pressurizing means or suction means.

23. A recovery method of a liquid ejection apparatus as claimed in claim 22, wherein said first liquid storage portion stores a first liquid stored for supply to said first liquid passage, and said second liquid storage portion stores a second liquid stored for supply to said second liquid passage, wherein said first liquid is better in recording characteristics relative to said second liquid and wherein said second liquid is better in forming characteristics relative to said first liquid.

24. A recovery method as claimed in claim 15, wherein said second liquid passage of said liquid ejection head is communicated with a recovery port for discharging liquid in said second liquid passage, and further comprising the step of discharging liquid from said recovery port.

25. A recovery method as claimed in claim 24, wherein upon recovery of an ejection force of the ejection head by discharging said liquid from at least one of said ejection port and said recovery port, a pressure for application to a liquid passage having high flow resistance is larger than the ejection force.

26. A recovery method as claimed in claim 25, wherein the liquid is discharged by sucking the liquid from said ejection port and said recovery port using a suction means and a cap capping said ejection port and said recovery port.

27. A recovery method as claimed in claim 26, wherein said suction means includes a pump.

28. A recovery method of a liquid ejection apparatus as claimed in claim 15, wherein a flow resistance of said second liquid passage is greater than that of said first liquid passage.

29. A recovery method as claimed in claim 28, wherein one of said first and second liquid passages having a greater flow resistance is pressurized and the other liquid passage, having a lower flow resistance, is sucked.

30. A recovery method as claimed in claim 28, wherein a suction force applied to one of said first and second liquid passages having a greater flow resistance is greater than that applied to the other liquid passage, having a lower flow resistance.

31. A recovery method as claimed in claim 28, wherein a pressurizing force applied to one of said first and second liquid passages having a greater flow resistance is higher than that applied to the other liquid passage, having a lower flow resistance.

32. A recovery method as claimed in claim 28, wherein one of said first and second liquid passages having a greater flow resistance is recovered by pressurizing and suction, and the liquid passage having a lower flow resistance is recovered by suction.

33. A recovery method as claimed in claim 28, wherein one of said first and second liquid passages having a greater flow resistance is recovered by pressurizing and suction, and the liquid passage having a lower flow resistance is recovered by pressurization.

34. A recovery method as claimed in claim 28, wherein termination of a recovery operation of a liquid passage having a lower flow resistance is later than termination of a recovery operation of a liquid passage having a greater flow resistance.

* * * * *

UNITED STATES PATENT AND TRADEMARK OFFICE

CERTIFICATE OF CORRECTION

PATENT NO. : 6,062,671
DATED : May 16, 2000
INVENTOR(S) : Hidehiko Kanda, et al.

It is certified that error appears in the above-identified patent and that said Letters Patent is hereby corrected as shown below:

Column 2,
Line 21, "work" should read -- worked --;
Line 47, "is" should be deleted;
Line 58, "to be easily degraded the quality by heat" should read -- in which the quality is easily degraded by heat --;
Line 60, "causing change" should read -- causing a change --; and
Line 62, "such" should read -- such a --.

Column 3,
Line 8, "prevention" should read -- preventing --; and
Line 34, "can not" should read -- cannont --

Column 4,
Line 4, "re-fill" should read -- refill --.

Column 7,
Line 22, "re-fill" should read -- refill --.

Column 9,
Line 42, "using" should read -- used --;
Line 46, "using" should read -- used --;
Line 50, "using" should read -- used --.

Column 10,
Line 59, "to" should be deleted.

Column 11,
Line 17, "Vs." should read -- VB. --;
Line 29, "is" should read -- is an --;
Line 32, "act" should read -- acts --;
Line 41, "since"should be deleted.

Column 13,
Line 29, "forcedly" should read -- forced --;
Line 31, "passage," should read -- passage, and a --.

Column 15,
Line 32, "be" should be deleted.

UNITED STATES PATENT AND TRADEMARK OFFICE

CERTIFICATE OF CORRECTION

PATENT NO. : 6,062,671
DATED : May 16, 2000
INVENTOR(S) : Hidehiko Kanda, et al.

It is certified that error appears in the above-identified patent and that said Letters Patent is hereby corrected as shown below:

Column 16,
Line 21, "down stream" should read -- downstream --.

Column 17,
Line 3, "that" should read -- than --; and
Line 59, "supply" should read -- supplying --.

Column 19,
Line 17, "liquid" (first occurrence) should read -- liquids --; and
Line 53, "passage>" should read -- Passage> --.

Column 20,
Line 2, "greater high" should read -- greater height --;
Line 11, "between" should read -- Between --, and "passage" should read -- Passage --;
Line 25, insert -- is -- after "part"; and
Line 50, "Am" should read -- μm --.

Column 21,
Line 41, "fine slit." should read -- fine slit can be used. --.

Column 25,
Line 30, "in the so as to eject." should read -- so as to be ejected. --;
Line 46, "the head of respective" should be deleted;
Line 50, "ejection" (first occurrence) should read -- ejected --;
Line 54, "passage" should read -- Passage --; and
Line 66, "is" should be deleted.

Column 27,
Line 9, "to the" (second occurrence) should be deleted;
Line 15, "cross sectional" should read -- cross-sectional --;
Line 29, "is" should read -- in --;
Line 52, "head" should read -- heat --;
Line 54, "may not cause fatigue" should read -- not cause fatigue of --;
Line 59, "conventionally" should read -- conventional --; and
Line 60, "apparatus." should read -- apparatus can be used. --.

UNITED STATES PATENT AND TRADEMARK OFFICE

CERTIFICATE OF CORRECTION

PATENT NO. : 6,062,671
DATED : May 16, 2000
INVENTOR(S) : Hidehiko Kanda, et al.

It is certified that error appears in the above-identified patent and that said Letters Patent is hereby corrected as shown below:

Column 28,
Line 21, "results" should read -- result --;
Line 22, "to" should read -- so that a --; and
Line 25, insert: -- Dye Ink Viscosity 2 cp --.

Column 29,
Line 42, "For" should be deleted; and
Line 43, "further" should read -- Further --.

Column 31,
Lines 48-49, "can be assembled" should be deleted;
Lines 62, "simultaneously" should read -- simultaneously and a --; and
Line 66, "since" should be deleted.

Column 32,
Line 4, "ejection head" should read -- Ejection Head --;
Line 37, "in the" should be deleted; and
Line 59, "liquid." should read -- liquids. --

Column 33,
Line 43, "a" should read -- as --.

Column 35
Line 32, "of" should read -- of the --; and
Line 43, "discharge" should read -- discharged --.

Column 36,
Line 4, "A pressure" should read -- Pressure --.

Column 37,
Line 67, "in" (first occurrence) should read -- is --.

Column 39,
Line 32, "show" should read -- shown --.

Column 40,
Line 9, "for" should read -- to --.

UNITED STATES PATENT AND TRADEMARK OFFICE

CERTIFICATE OF CORRECTION

PATENT NO. : 6,062,671
DATED : May 16, 2000
INVENTOR(S) : Hidehiko Kanda, et al.

It is certified that error appears in the above-identified patent and that said Letters Patent is hereby corrected as shown below:

Column 41,
Line 13, "of the" should be deleted;
Line 22, "closed" should read -- a closed --; and
Line 28, "flows" should read -- flow--.

Column 42,
Line 7, "process" should read -- processed --.

Column 43,
Line 20, "the" should read -- a --;
Line 21, "easily cause" should read -- that easily causes --;
Line 58, "container," should read -- container --; and
Line 59, "container," should read -- container --.

Column 44,
Line 7, "house" should read -- houses --;
Line 18, "increase" should read -- increased --;
Line 28, "the" should be deleted; and
Line 64, "to lower" should read -- lowers --.

Column 45,
Line 10, "is easily cause" should read -- easily causes --.

Signed and Sealed this

Thirteenth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,062,671
DATED : May 16, 2000
INVENTOR(S) : Hidehiko Kanda et al.

It is certified that error appears in the above-identified patent and that said Letters Patent is hereby corrected as shown below:

Column 2,
Line 21, "work" should read -- worked --;
Line 47, "is" should be deleted;
Line 58, "to be easily degraded the quality by heat" should read -- in which the quality is easily degraded by heat --;
Line 60, "causing change" should read -- causing a change --; and
Line 62, "such" should read -- such a --.

Column 3,
Line 8, "prevention" should read -- preventing --; and
Line 34, "can not" should read -- cannont --

Column 4,
Line 4, "re-fill" should read -- refill --.

Column 7,
Line 22, "re-fill" should read -- refill -.

Column 9,
Line 42, "using" should read -- used --;
Line 46, "using" should read -- used --;
Line 50, "using" should read -- used --.

Column 10,
Line 59, "to" should be deleted.

Column 11,
Line 17, "Vs." should read -- VB. --;
Line 29, "is" should read -- is an --;
Line 32, "act" should read - acts --;
Line 41, "since" should be deleted.

Column 13,
Line 29, "forcedly" should read -- forced --;
Line 31, "passage," should read -- passage, and a --.

Column 15,
Line 32, "be" should be deleted.

UNITED STATES PATENT AND TRADEMARK OFFICE

CERTIFICATE OF CORRECTION

PATENT NO. : 6,062,671
DATED : May 16, 2000
INVENTOR(S) : Hidehiko Kanda et al.

It is certified that error appears in the above-identified patent and that said Letters Patent is hereby corrected as shown below:

Column 16,
Line 21, "down stream" should read -- downstream --.

Column 17,
Line 3, "that" should read -- than --; and
Line 59, "supply" should read -- supplying --.

Column 19,
Line 17, "liquid" (first occurrence) should read -- liquids --; and
Line 53, "passage>" should read -- Passage> --.

Column 20,
Line 2, "greater high" should read -- greater height --;
Line 11, "between" should read -- Between --, and "passage" should read -- Passage --;
Line 25, insert -- is -- after "part"; and
Line 50, "Am" should read -- $\mu$m --.

Column 21,
Line 41, "fine slit." should read -- fine slit can be used. --.

Column 25,
Line 30, "in the so as to eject." should read -- so as to be ejected. --;
Line 46, "the head of respective" should be deleted;
Line 50, "ejection" (first occurrence) should read -- ejected --;
Line 54, "passage" should read -- Passage --; and
Line 66, "is" should be deleted.

Column 27,
Line 9, "to the" (second occurrence) should be deleted;
Line 15, "cross sectional" should read -- cross-sectional --;
Line 29, "is" should read -- in --;
Line 52, "head" should read -- heat --;
Line 54, "may not cause fatigue" should read -- not cause fatigue of --;
Line 59, "conventionally" should read -- conventional --; and
Line 60, "apparatus." should read -- apparatus can be used. --.

Column 28,
Line 21, "results" should read -- result --;
Line 22, "to" should read -- so that a --; and
Line 25, insert: -- Dye Ink Viscosity 2 cp --.

UNITED STATES PATENT AND TRADEMARK OFFICE

CERTIFICATE OF CORRECTION

PATENT NO. : 6,062,671
DATED : May 16, 2000
INVENTOR(S) : Hidehiko Kanda et al.

It is certified that error appears in the above-identified patent and that said Letters Patent is hereby corrected as shown below:

Column 29,
Line 42, "For" should be deleted; and
Line 43, "further" should read -- Further --.

Column 31,
Lines 48-49, "can be assembled" should be deleted;
Line 62, "simultaneously" should read -- simultaneously and a --; and
Line 66, "since" should be deleted.

Column 32,
Line 4, "ejection head" should read -- Ejection Head --;
Line 37, "in the" should be deleted; and
Line 59, "liquid" should read -- liquids. --

Column 33,
Line 43, "a" should read -- as --.

Column 35
Line 32, "of" should read -- of the --; and
Line 43, "discharge" should read -- discharged --.

Column 36,
Line 4, "A pressure" should read -- Pressure --.

Column 37,
Line 67, "in" (first occurrence) should read -- is --.

Column 39,
Line 32, "show" should read -- shown --.

Column 40,
Line 9, "for" should read -- to --.

Column 41,
Line 13, "of the" should be deleted;
Line 22, "closed" should read -- a closed --; and
Line 28, "flows" should read -- flow--.

UNITED STATES PATENT AND TRADEMARK OFFICE

CERTIFICATE OF CORRECTION

PATENT NO. : 6,062,671
DATED : May 16, 2000
INVENTOR(S) : Hidehiko Kanda et al.

It is certified that error appears in the above-identified patent and that said Letters Patent is hereby corrected as shown below:

Column 42,
Line 7, "process" should read -- processed --.

Column 43,
Line 20, "the" should read -- a --;
Line 21, "easily cause" should read -- that easily causes --;
Line 58, "container," should read -- container --; and
Line 59, "container," should read -- container --.

Column 44,
Line 7, "house" should read -- houses --;
Line 18, "increase" should read -- increased --;
Line 28, "the" should be deleted; and
Line 64, "to lower" should read -- lowers --.

Column 45,
Line 10, "is easily cause" should read -- easily causes --.

This certificate supersedes Certificate of Correction issued on November 13, 2001 (see Official Gazette's listing of Certificate of Correction issued on November 13, 2001), since the certificate reflects the incorrect "Signed and Sealed" date, of October 13, 2001.

Signed and Sealed this

Twenty-sixth Day of October, 2004

JON W. DUDAS
*Director of the United States Patent and Trademark Office*